United States Patent [19]

Tucker et al.

[11] 4,281,722

[45] Aug. 4, 1981

[54] RETRACTABLE BIT SYSTEM

[75] Inventors: John D. Tucker, Cedar Falls; Ronald E. Cozad, Waterloo; Robert A. Kaiser, Palmer, all of Iowa

[73] Assignee: Long Year Company, Minneapolis, Minn.

[21] Appl. No.: 39,283

[22] Filed: May 15, 1979

[51] Int. Cl.[3] ..... E21B 10/66; E21B 10/02

[52] U.S. Cl. ..... 175/57; 175/260; 175/320; 175/330; 175/403; 166/84; 166/85

[58] Field of Search ..... 175/258–261, 175/403–405, 320–322, 330; 166/77, 84, 85

[56] References Cited

U.S. PATENT DOCUMENTS

| | | | |
|---|---|---|---|
| 1,597,325 | 8/1926 | Melder | 175/405 X |
| 2,262,364 | 11/1941 | Hügel et al. | 166/77 |
| 2,595,018 | 4/1952 | Stokesbary | 175/261 X |
| 2,612,348 | 9/1952 | Catallo | 175/330 |
| 3,164,215 | 1/1965 | Johnson | 175/261 |
| 3,306,377 | 2/1967 | Johnson | 175/261 |
| 3,965,996 | 6/1976 | Gross | 175/260 |

*Primary Examiner*—William F. Pate, III
*Attorney, Agent, or Firm*—Clayton R. Johnson

[57] ABSTRACT

A retractable bit system that includes a single piece annular core bit that is movable through a drill string (drill stem), had an outer diameter about the same as that of the drill stem, and can be releasably locked to the drill string, an outer barrel assembly for the drill stem that is operable for lockingly engaging the core bit and driving the core bit, bit replacement tools for moving and core bit through the drill string and operable for operating the outer barrel assembly and replacing the bit on the drill string without removing the drill string from a drill hole, a manually operated surface tool removably mounted on the drill string for clampingly engaging a wire line and retracting the wire line to operate the respective one of the bit installation tool and bit retraction tool when the respective tool extends into the outer barrel assembly, and a safety release tool for operating and withdrawing the replacement tools which will uncouple from the replacement tool when more than a predetermined force is applied.

113 Claims, 50 Drawing Figures

FIG 4
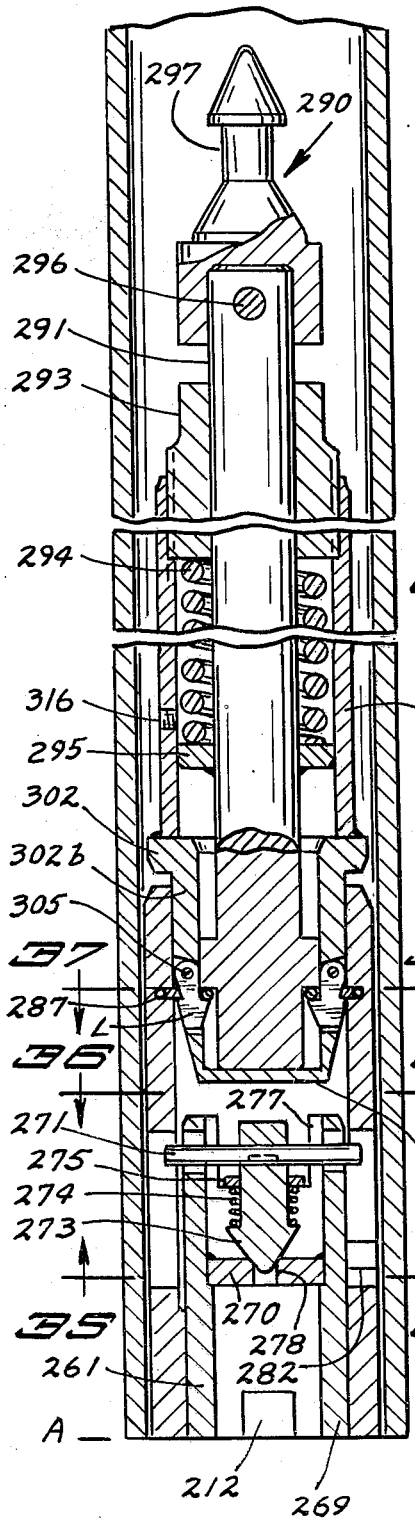
FIG. 7
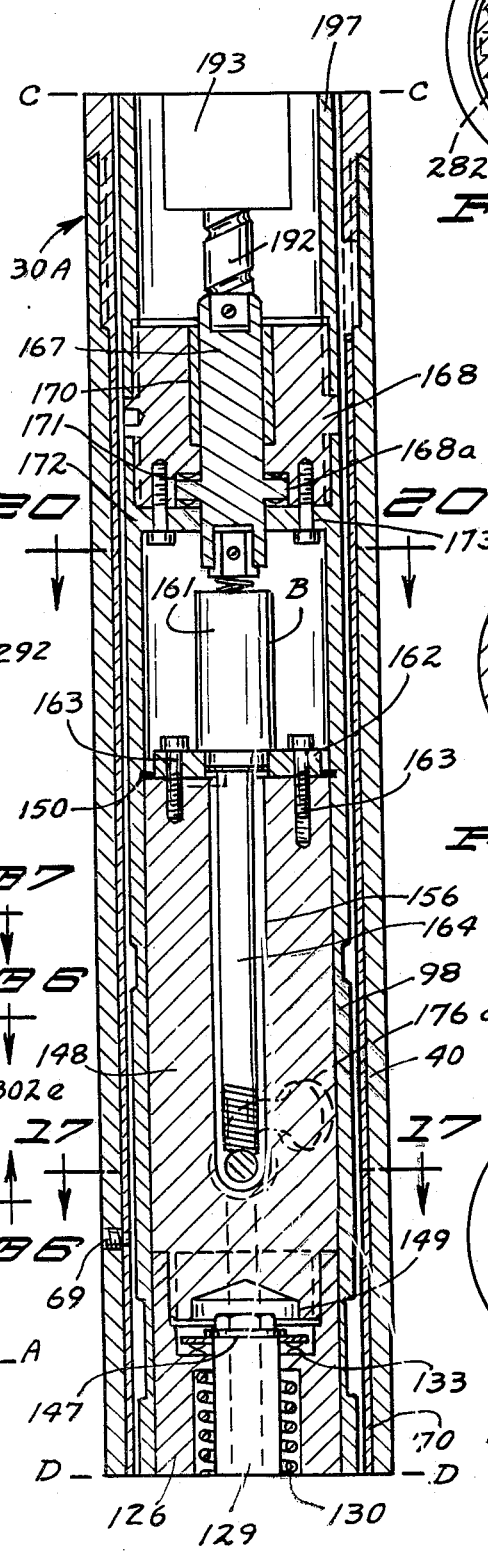
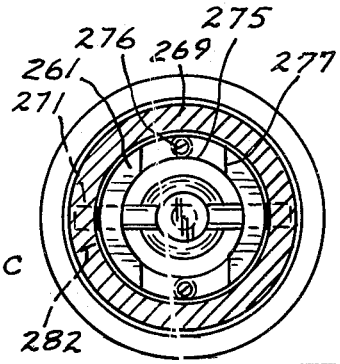
FIG. 36
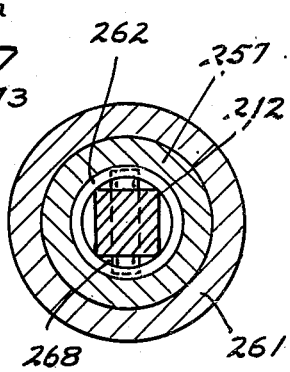
FIG. 34
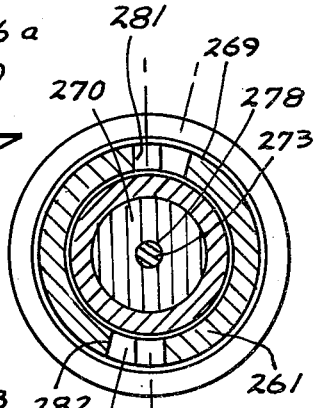
FIG. 35

FIG. 5
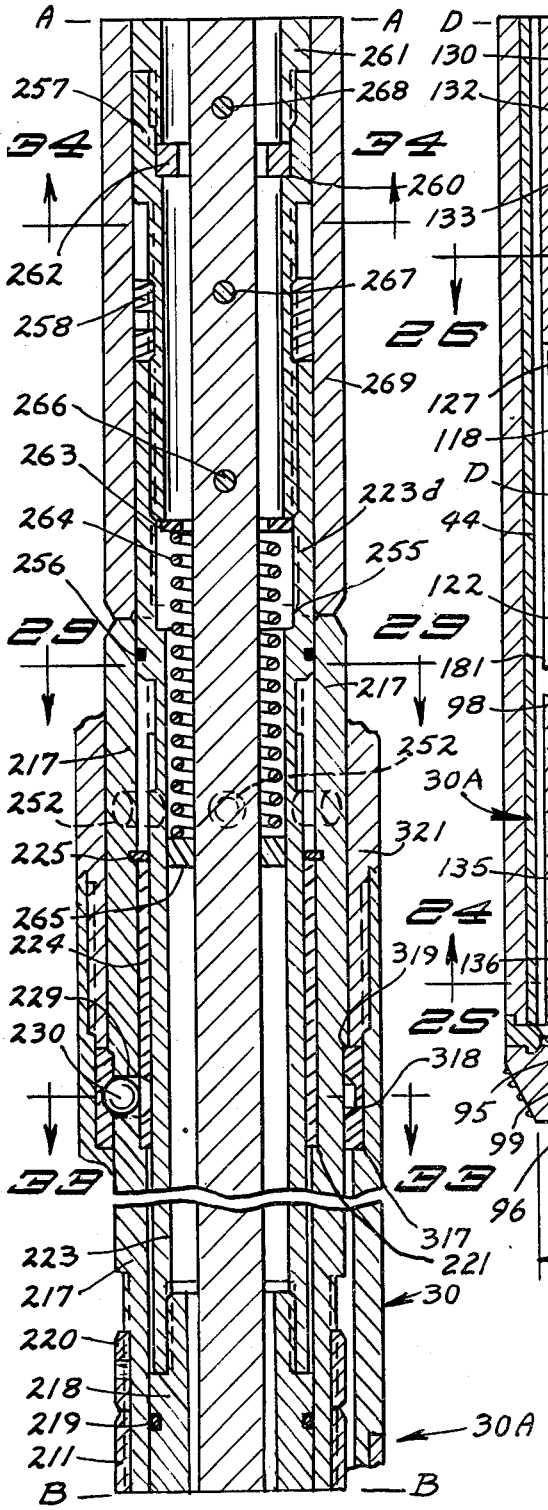
FIG. 8
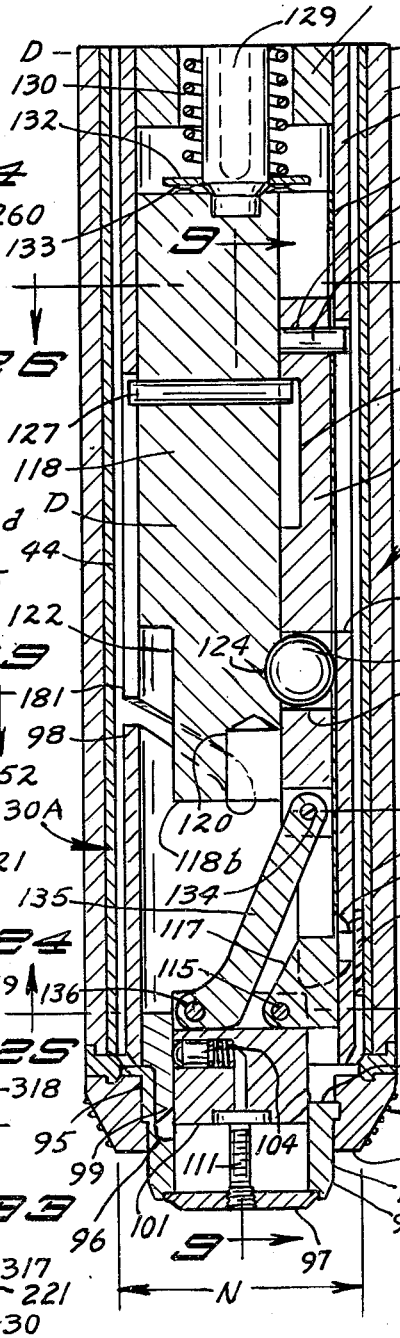
FIG. 9
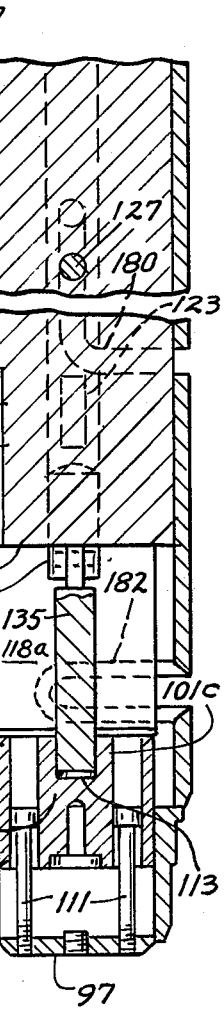
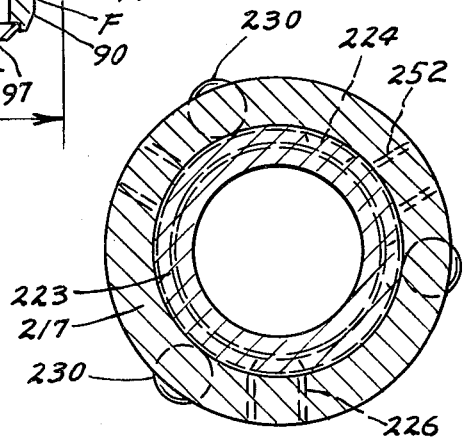
FIG. 29

RETRACTABLE BIT SYSTEM

The Government has rights in this invention pursuant to Contract No. H0272004 awarded by the Bureau of Mines, U.S. Department of the Interior.

BACKGROUND OF THE INVENTION

A core bit that is retractable through a drill string and tools for replacing the bit on the drill stem.

During drilling operations, for example exploring for minerals, the drill bit wears and has to be replaced in order to carry out an efficient operation. Withdrawing the drill string to remove, inspect and/or replace the drill bit is a time consuming task and leaves the drill hole subject to caving by unstable formations along the hole path. Drill bits have been made in the past that are replaceable on the drill string without withdrawing the drill string, but such past attempts have not been commercially successful.

Two general categories of prior art systems have been evolved to eliminate having to pull the entire drill string to replace a worn or damaged bit as follows: (1) collapsible bits and (2) pilot bit with retractable reamer. Collapsible bits are made of many segments which may travel through the drill string as a group and unfold or spread out upon reaching the axial inner end of the drill string, for example see U.S. Pat. No. 3,603,413; or in line one above the other through the drill string and guided into position at the axial inner end of the drill string where they are locked in place for drilling, for example see U.S. Pat. No. 3,437,159. Such segmented bits must be machined into intricate shapes, which is costly, and the drill operator is not always sure the bit segments are locked in place for drilling. Further, grit from the drilling operation can interfere with the proper exchange of bits.

An example of a pilot bit with an expandable reamer are U.S. Pat. Nos. 3,894,590 and 474,080. This type of system is subject to problems such as mentioned with reference to collapsible bit systems.

U.S. Pat. No. 3,965,996 discloses a bit assembly that is lowered through a drill string with its drill axis transverse to the longitudinal axis of the drill string and when locked in a drilling position has its drill axis generally aligned with the drill string axis. However, such a bit is not suitable for taking a core sample.

U.S. Pat. No. 3,545,553 discloses coupling apparatus for mounting and moving bits through a drill string, the coupling apparatus being hydraulically operated to latchingly engage the drill string. The coupling apparatus includes cam mechanism to angularly align its coupling members with drill string slots. The coupling apparatus remains latched to the drill stem while the hole is being drilled.

In order to provide a commercially feasible retractable bit system for replacing a drill bit without removing the drill string from the drill hole, and that can be used for core drilling, this invention has been made.

SUMMARY OF THE INVENTION

A retractable bit system that includes a single piece annular drill bit having axially opposite transverse surfaces, opposite outer peripheral circular surface portions axially between the transverse surfaces, opposed outer peripheral surface portions circumferential between the circular portions that are of a minimum spacing that is substantially less than that of the circular surface portions, and lock key recesses.

An operative transverse outer barrel assembly is provided for being mounted on the axial inner end of a drill string, the outer barrel assembly having drive surfaces for drivingly rotating a drill bit, lock keys for lockingly engaging the drill bit, a transverse outer tube, and an annular member that mounts the lock keys and is rotatably mounted in the outer tube for moving the lock keys between a bit locking position and a bit release position.

An annular bit replacement tool has a bit mounting member, operative detents for releasably holding a bit on the bit mounting member, latches mounted for movement between a drill string release position and a drill string latched position and operating mechanism for moving the latches to a drill string latching position and thence the bit mounting member between a drill string bit mounted position and a position the drill bit may be moved through the drill string, and if a bit is being installed on the drill string, move the detents to their release position after the mounting member has been moved to a drill string bit mounted position and locking mechanism on the drill string has been operated to a drill bit locking position; and if a bit is being removed from the drill string, move the detents to their locking position when the mounting member is in a bit installed position and thence operate locking mechanism on the drill string to release the drill bit.

One of the objects of this invention is to provide a new and novel drill bit for being replaced on a drill string without removal of drill string from the drill hole. Another object of this invention is to provide a drill bit of a novel one piece construction that may be moved axially through a drill string and that when mounted on the drill string, will cut a drill hole of a diameter that is about the same as the outer diameter of the drill string. A further object of this invention is to provide an annular drill bit having new and novel surface portions retainingly engagable by a bit replacement tool for moving the bit through a drill string and additional novel surface portions that are retainingly engagable with the drill string to mount the bit to the drill string. Another object of this invention is to provide a new and novel core bit that can be replaced without removing the drill stem from a drill hole, that is easy to manufacture and that can be used in conjunction with a standard wire line inner tube assembly.

A different object of this invention is to provide a new and novel tool for replacing a drill bit on a drill string without having to remove the drill string from a drill hole. In furtherance of the last mentioned object, it is another object of this invention to provide a tool with new and novel means for operating bit mounting mechanism on the axial inner end of a drill string between a drill bit locking position and a drill bit release position.

Still another object of this invention is to provide a new and novel bit replacement tool that is hydraulically and mechanically actuatable between a drill string latching engagement position and a drill string release position. A different object of this invention is to provide a mineral explorator drilling tool having new and novel means for operating detent mechanism between a drill string latching position and a drill string release position.

Another object of this invention is to provide a new and novel outer barrel assembly that is mountable on the axial inner end of a drill string. A further object of this invention is to provide a core barrel outer tube assembly with new and novel means for releasably mounting a drill bit and drivingly rotating a drill bit. Another object of this invention is to provide an outer tube assembly mountable on the axial inner end of a drill string that has new and novel means operable between a drill bit lockingly engaging position and a release position while the outer tube assembly remains in the axial inner end of a drill hole.

Another object of this invention is to provide a new and novel manually operated surface tool for being mounted on a drill string and retracting a wire line. A further object of this invention is to provide a surface tool mountable on a drill string that has new and novel clamp means for clampingly engaging a wire line. In furtherance of the last mentioned object, it is another object of this invention to provide a pair of new and novel clamps and clamp moving mechanism for moving one clamp relative the other.

Another object of this invention is to provide a new and novel safety release tool for releasably engaging a drilling tool that is to be moved through a drill string. A further objective of this invention is to provide a safety release tool having new and novel means for latchingly engaging a tool that is to be moved through a drill string. In furtherance of the last mentioned object an additional object of this invention is to provide new and novel means for holding a latch in a latched position and upon more than a predetermined withdrawal force being applied, allow the latch to move to a release position.

Conventional wire line inner tube assemblies can be used in the drill stem for collecting core samples with the bit of this invention on the inner end of the drill stem and the same overshot assembly that is used for withdrawing the inner tube assembly can be used for lowering, or withdrawing the combination of the safety release tool and bit replacement tool of this invention. Further the bit of this invention can be withdrawn through the drill stem, is of a single piece unitary construction, has opposed circumferential surface positions that are of about the same radius of curvature as that of the drill stem outer peripheral surface and that each extend angularly through an angle of at least 60°, and opposite drill stem drivingly engagable surfaces that angularly extend through angles of at least 60°. In the preferred embodiment described herein each of the circumferential surfaces extend through an angle of about 90°.

Even though the bit replacement tools disclosed herein are of relatively complex construction, it is to be remembered that these tools can be used over and over again for replacing a drill bit on the axial inner end of drill string without having to remove the drill string from the drill hole.

For purposes of facilitating the description of the invention, the term "inner" refers to that portion of the drill stem, or of the assembly, or an element of the assembly being described which in its position "for use" in, or on, the drill stem is located closer to the drill bit on the drill stem (or bottom of hole being drilled) than any other portion of the apparatus being described, except where the term clearly refers to a transverse circumferential, direction, or diameter of the drill stem or other apparatus being described. The term "outer" refers to that portion of the drill stem, or of the assembly, or an element being described which in its position "for use" in or on the drill stem is located axially more remote from bit on drill stem than any other portion of the apparatus being described, except where the term clearly refers to a transverse circumferential, direction, or diameter of the apparatus being described.

The invention is illustrated in the drawings in which corresponding numerals refer to the same parts and in which.

Figure 3:
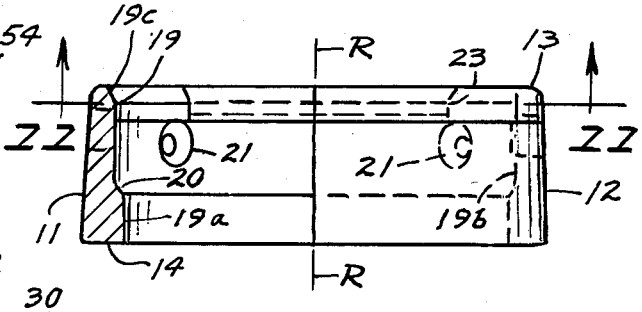
FIG. 3 is in part a transverse cross sectional view and in part an end view of the bit, said view being generally taken along the line and in the direction of the arrows 3—3 of FIG. 1.
Figure 12:
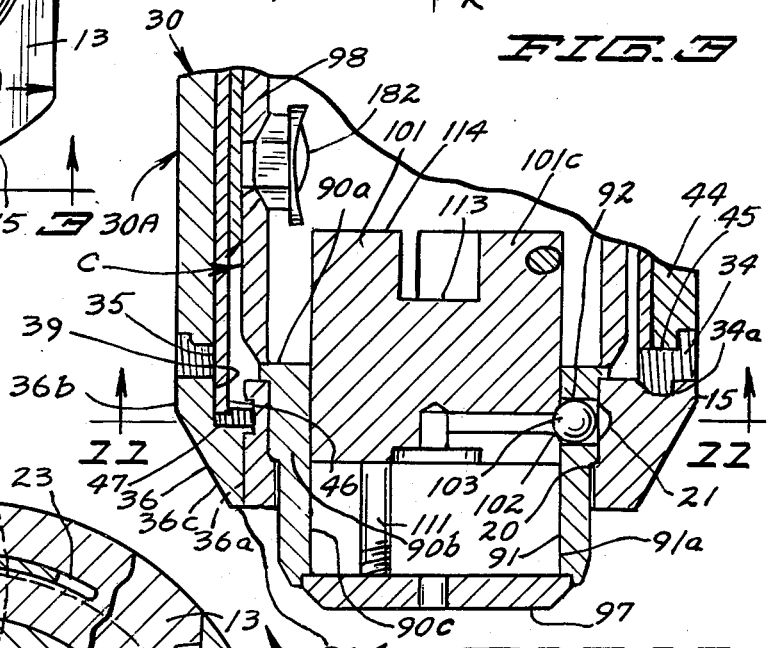
Figure 11:
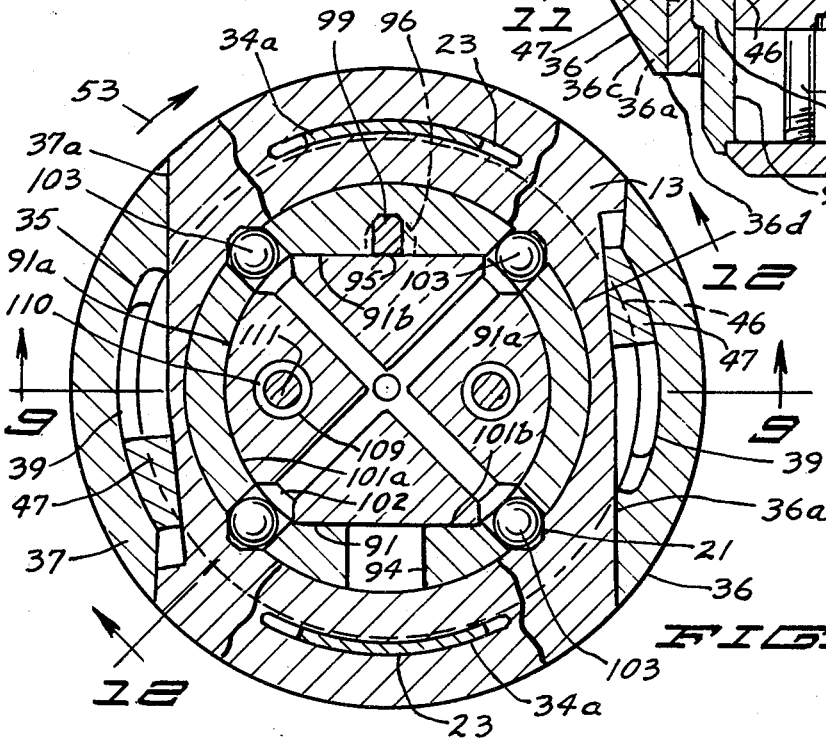
Figure 6:
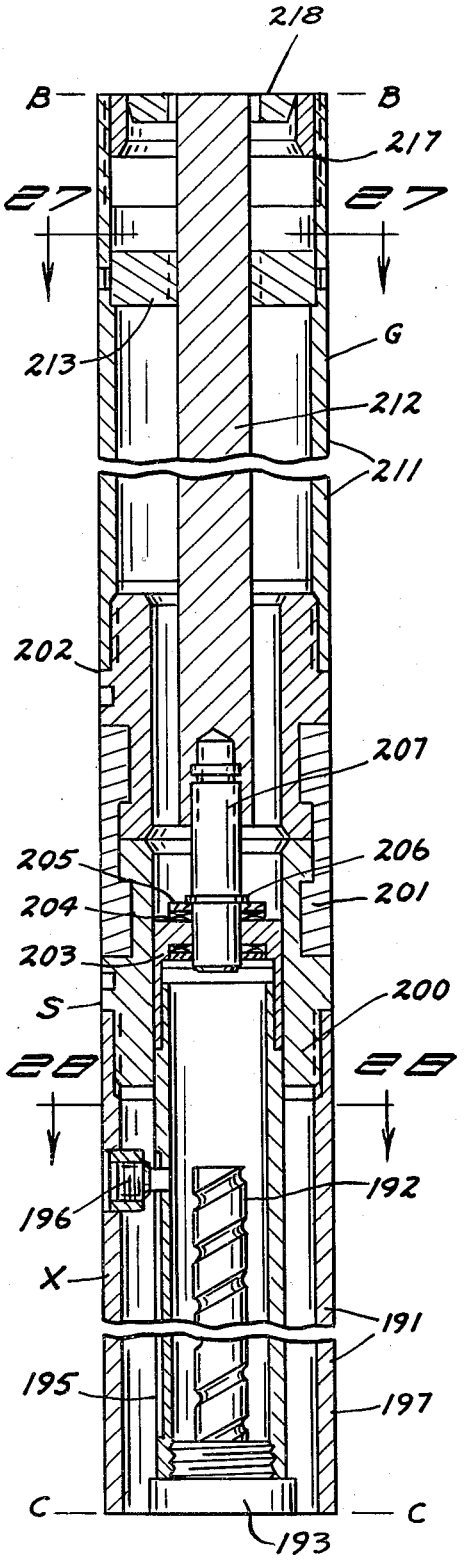
Figure 10:
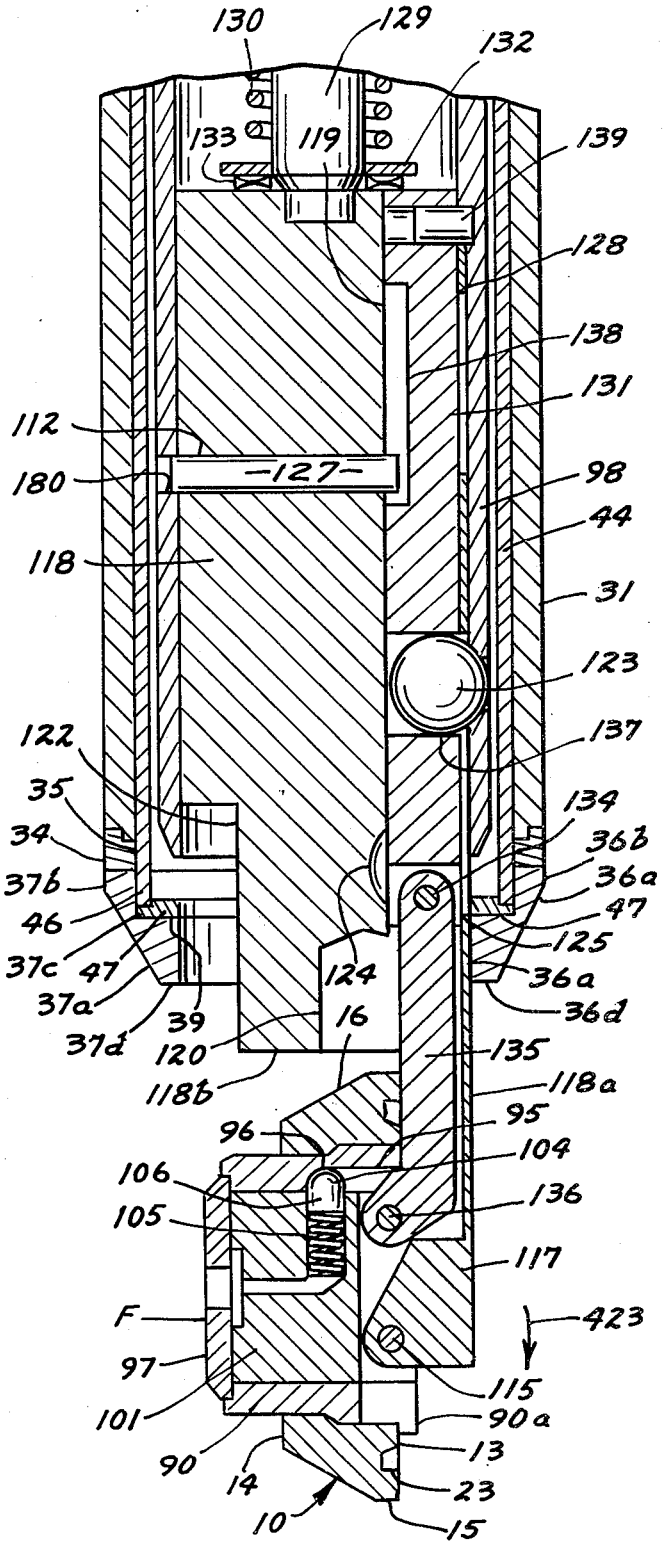
Figure 19:
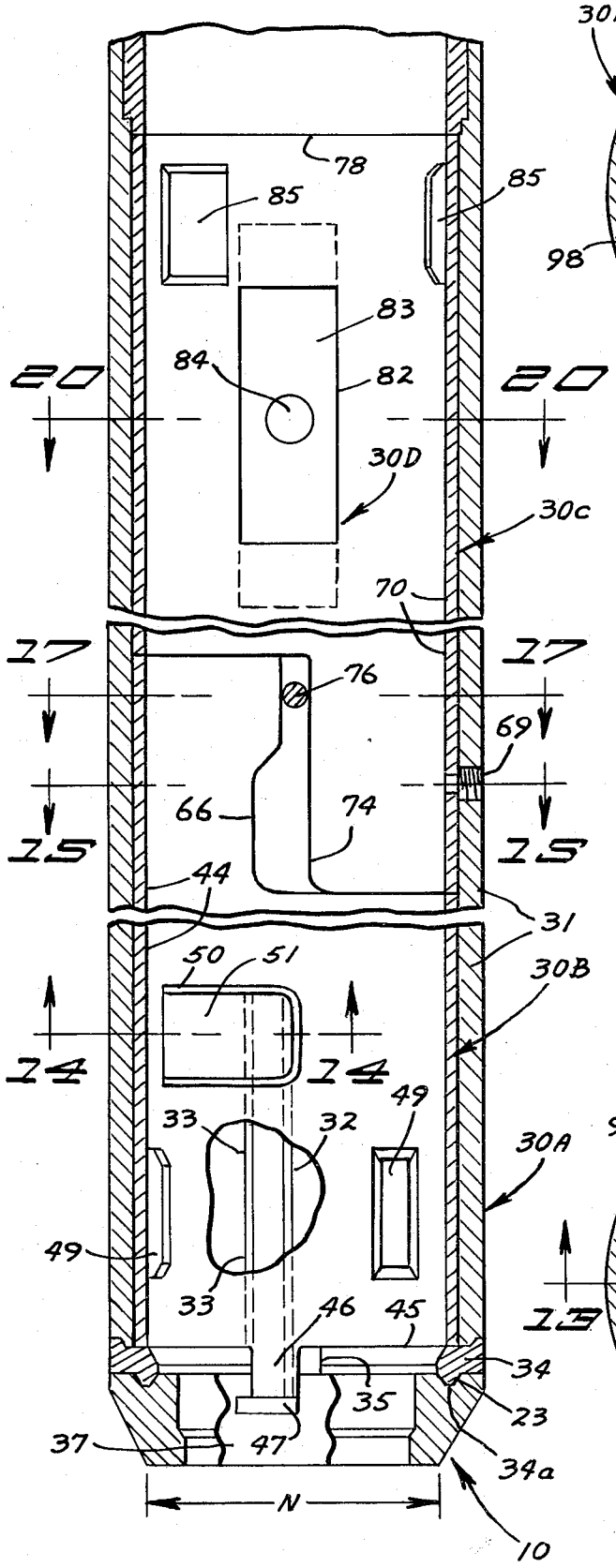
Figure 20:
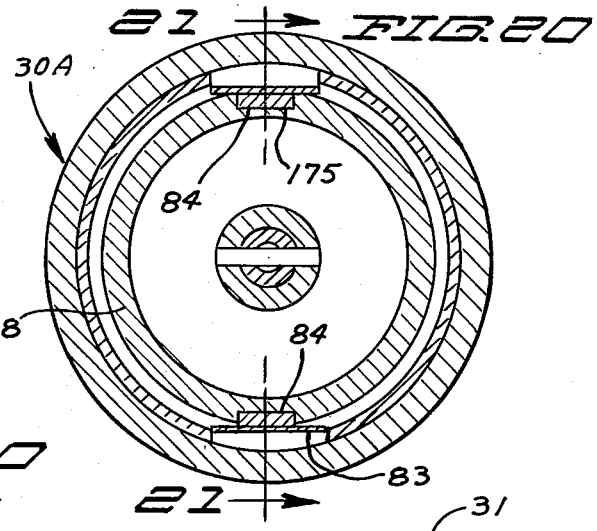
Figure 21:
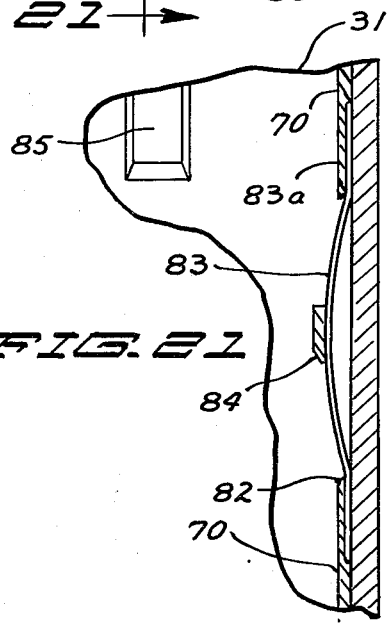
Figure 15:
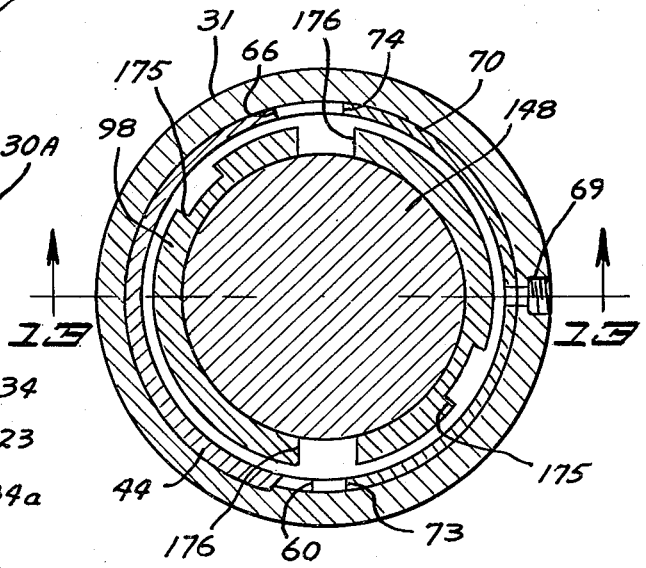
Figure 30:
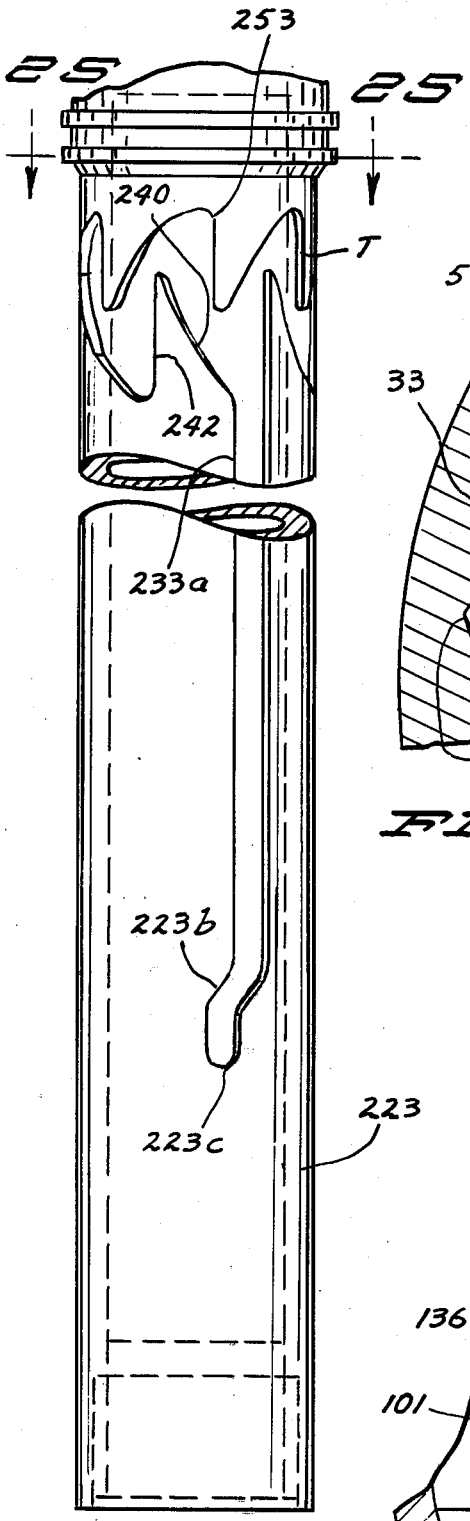
Figure 14:
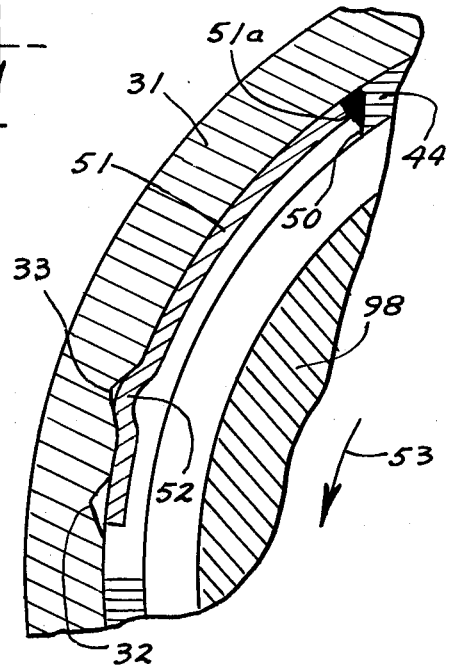
Figure 31:
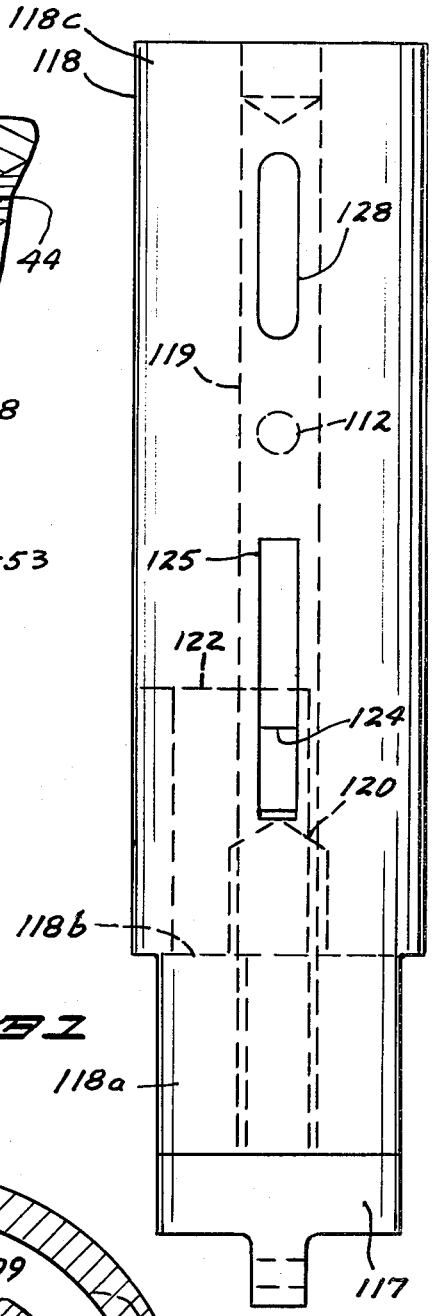
Figure 24:
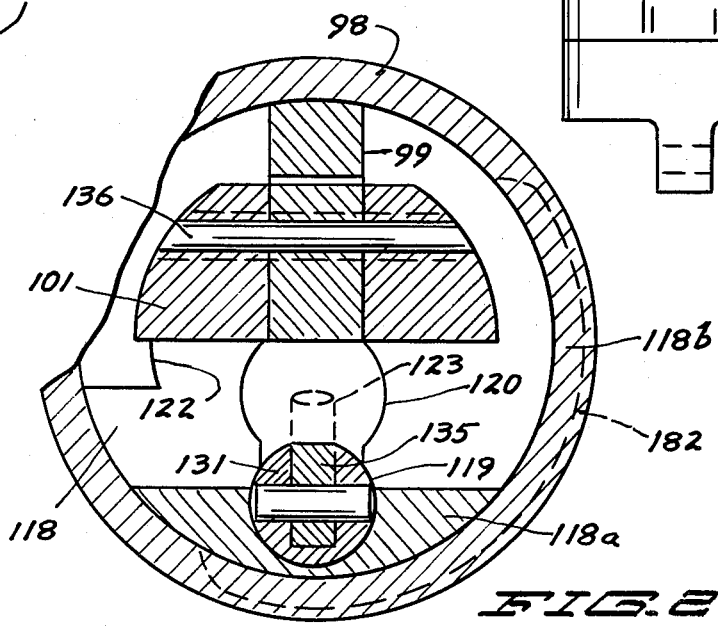
Figure 33:
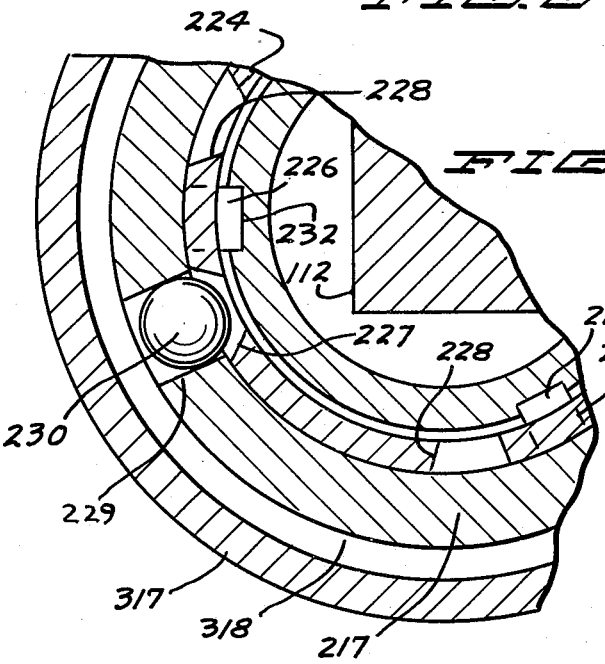
Figure 16:
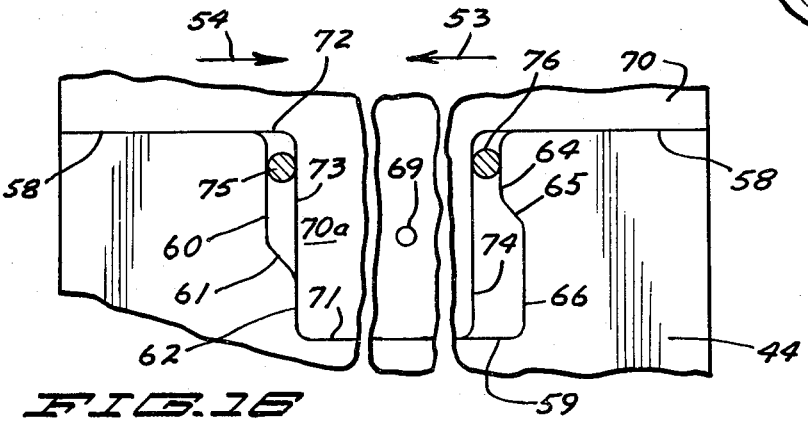
Figure 27:
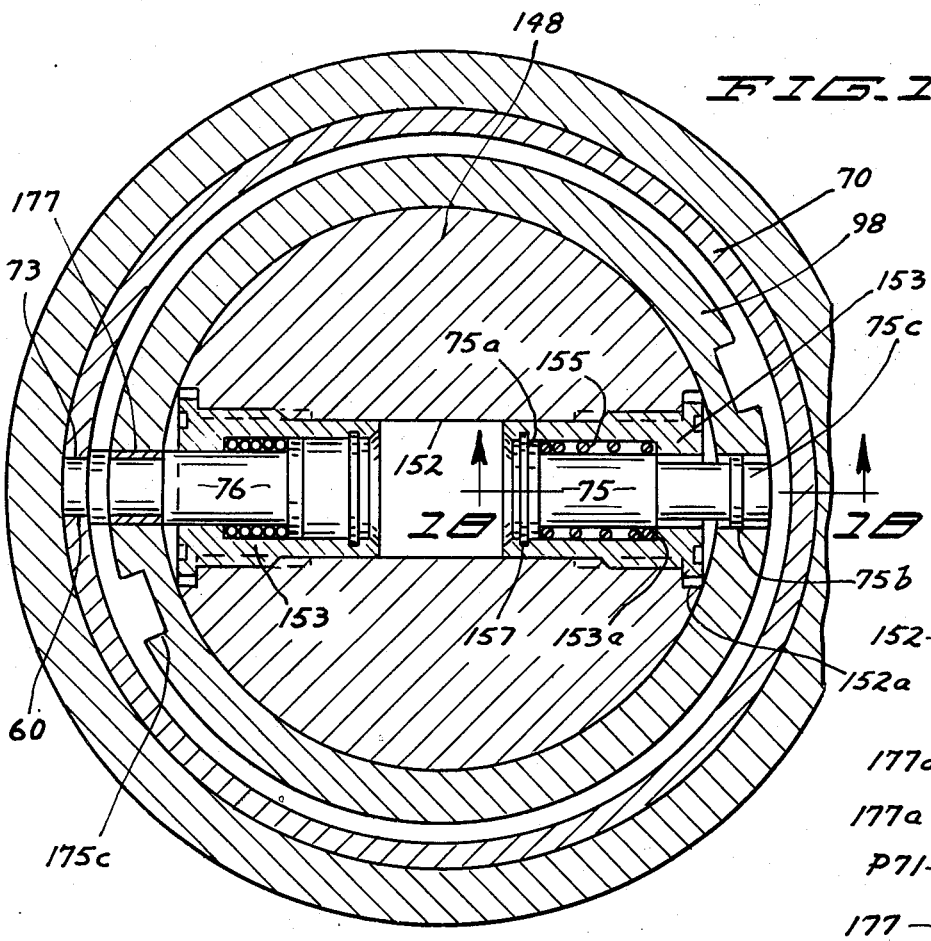
Figure 28:
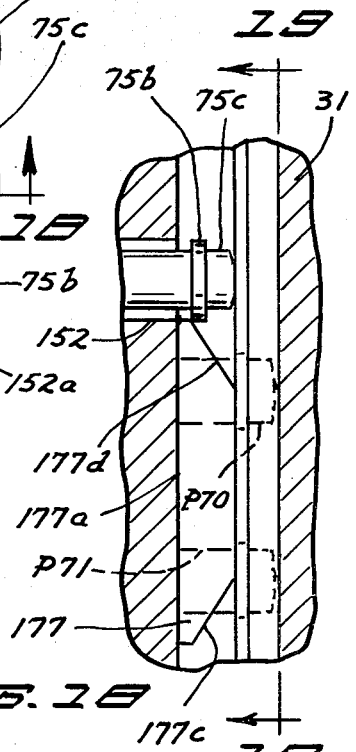
Figure 29:
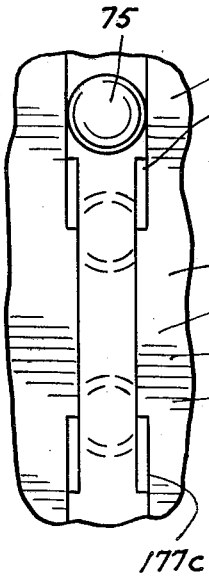
Figure 26:
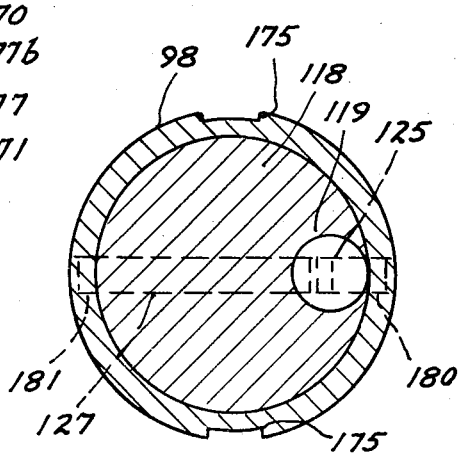
Figure 25:
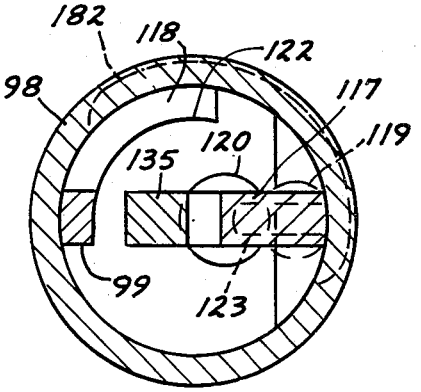
Figure 23:
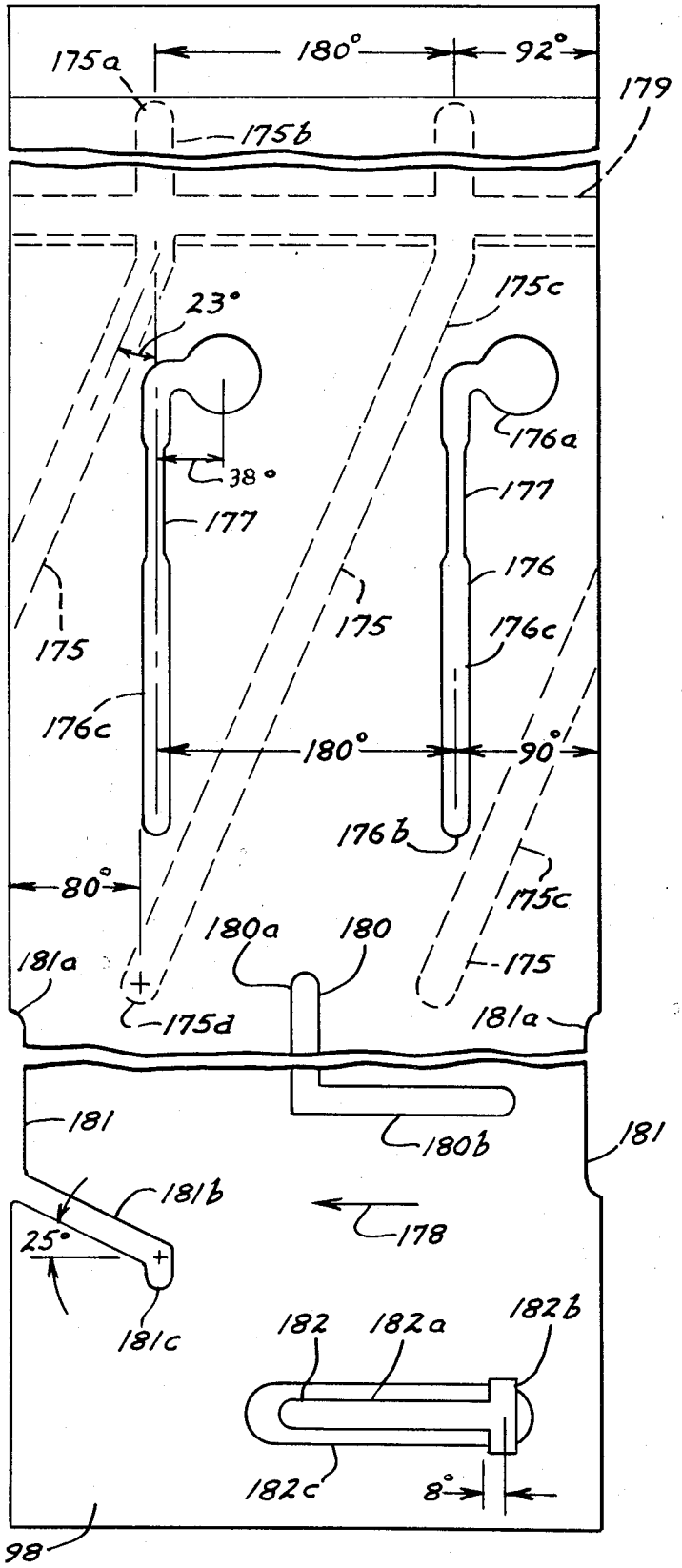
Figure 22:
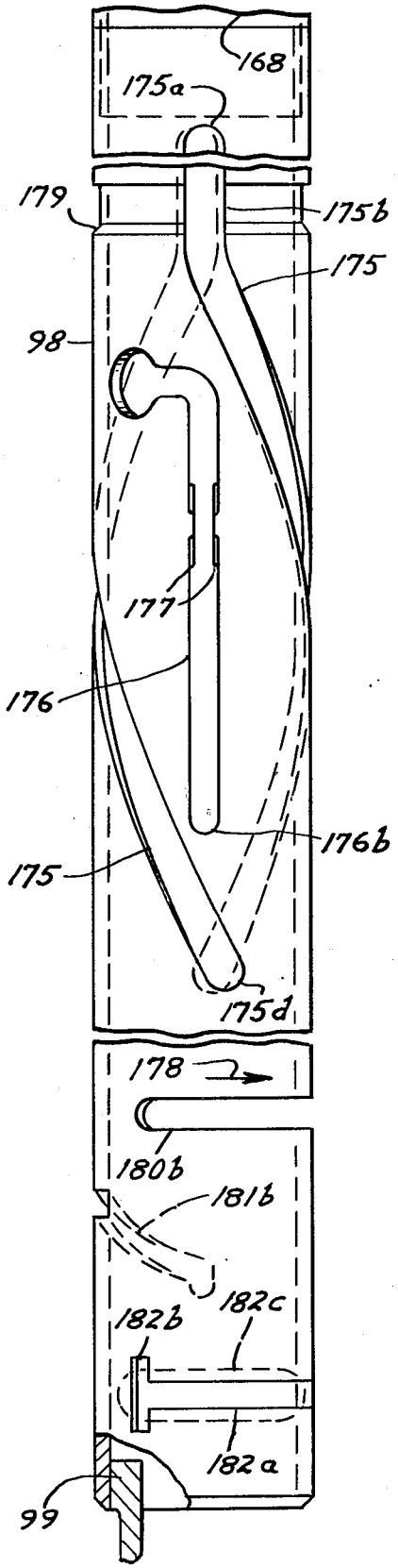
Figure 32:
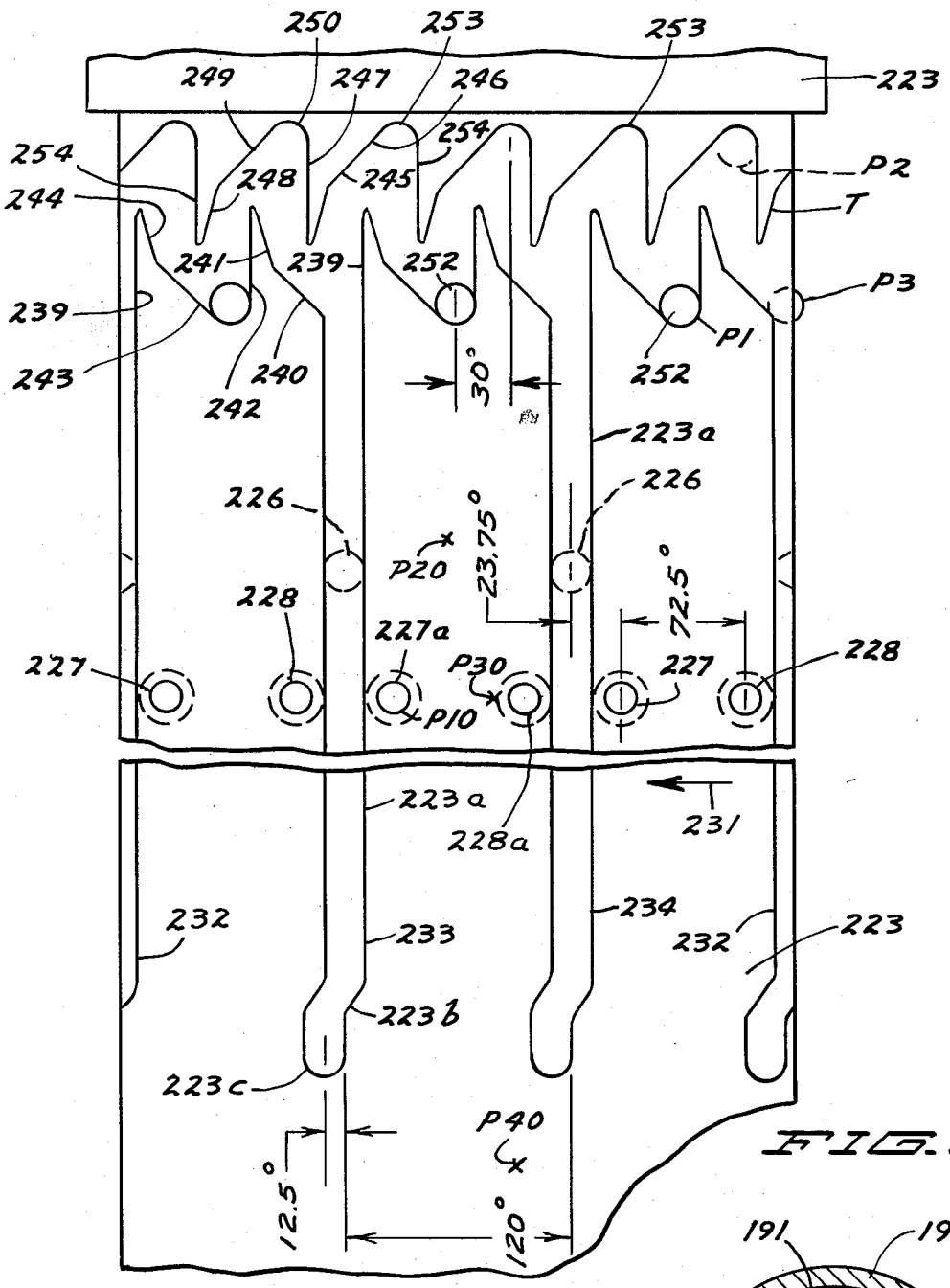
Figure 27:
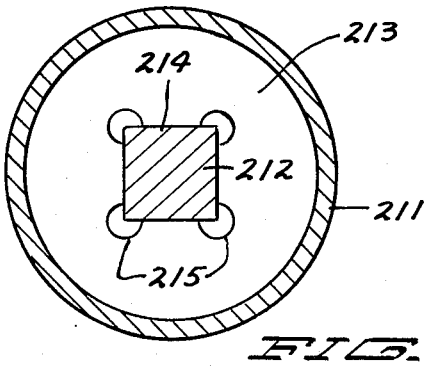
Figure 28:
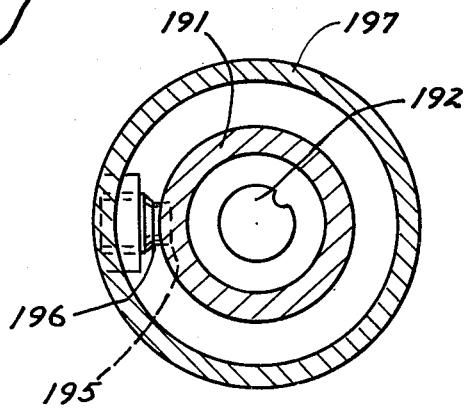

FIGS. 4-8 with one arranged above the other with the axial center lines aligned and lines A—A of FIGS. 4 and 5 aligned, and lines B—B of FIGS. 5 and 6 aligned, and lines C—C of FIGS. 6 and 7 aligned, and lines D—D of FIGS. 7 and 8 aligned, form a composite longitudinal section through the drill bit, the bit retraction tool, the safety release assembly, and the axial inner end portion of the drill stem; the cam sleeve and landing ring engaging balls being shown out of their relatively rotated positions in FIG. 5;

FIG. 8 shows the bit retraction tool in position for removing the bit from the outer tube assembly of the drill stem;

FIG. 9 is a fragmentary longitudinal sectional view of the inner end of the bit retraction tool, said view being generally taken along the line and in the direction of the arrows 9—9 of FIG. 8;

FIG. 10 is a fragmentary longitudinal sectional view of the inner end of the bit retraction tool showing the bit removed from the outer tube assembly and rotated 90° about the central axis of the drill stem and 90° about an axis perpendicular to the central axis and transversely spaced therefrom;

FIG. 11 is a transverse cross sectional view in part generally taken along the line and in the direction of the arrows 11—11 of FIG. 12 showing the bit locked on the drill stem in a position for drilling and the radially adjacent part of the floater subassembly in a position to lockingly engage the bit, and in part along the line and in the direction of the arrows 11—11 of FIG. 3 to show the adaptor ring flanges extended into the bit adaptor ring flange recesses;

FIG. 12 is a fragmentary longitudinal sectional view generally taken along the line and in the direction of the arrows 12—12 of FIG. 11;

FIG. 13 is a longitudinal sectional view of the outer barrel assembly of the drill stem with a drill bit mounted thereon with axial intermediate portions of the assembly being broken away; said view being generally taken along the line and in the direction of the arrows 13—13 of FIG. 15 other than only one of the locking pins of the bit retraction tool is shown, and the pin is shown in its radially extended position;

FIG. 14 is a fragmentary cross sectional view showing the mounting of the detent spring that releasably retains the locking sleeve in either a bit unlocked or locked position, said view being generally taken along the line and in the direction of the arrows 14—14 of FIG. 13 and showing the spring in its bit locked position;

FIG. 15 is a transverse cross sectional view generally taken along the line and in the direction of the arrows 15—15 of FIG. 13 to in part show the relationship of the inner and outer sleeves relative the outer barrel of the outer barrel assembly and the axial outer drive slug;

FIG. 16 is a view of the adjacent end portions of the stationary sleeve and locking sleeve when rolled out flat and looking at the inner surface thereof with circumferential intermediate portions broken away, said view also showing the locking pins of the axial outer drive slug assembly in an extended position with the sleeves in a bit locked position;

FIG. 17 is a transverse cross sectional view generally taken along the line and in the direction of the arrows 17—17 of FIGS. 7 and 13, the left hand half of the view showing one locking pin in an extended position and the right hand half of said view showing a second locking pin in a retracted position;

FIG. 18 is a fragmentary longitudinal cross sectional view generally taken along the line and in the direction of the arrows 18—18 of FIG. 17, said view showing the locking pin in solid lines in a retracted position and showing two other positions of the locking pin relative to the cam portions in dotted lines;

FIG. 19 is a view of a fragmentary portion of the cam tube showing one of the locking pins in a retracted position in solid lines and two other positions of the locking pin relative to the cam portions in dotted lines, said view being generally taken along the line and in the direction of arrows 19—19 of FIG. 18;

FIG. 20 is a transverse cross sectional view generally taken along the line and in the direction of the arrows 20—20 of FIGS. 7 and 13 to in part illustrate the orienting pin subassemblies;

FIG. 21 is a fragmentary longitudinal cross sectional view generally taken along the line and in the direction of the arrows 21—21 of FIG. 20 to further illustrate one of the orienting pin subassemblies;

FIG. 22 is a side elevational view of the camming tube with axial intermediate portions broken away;

FIG. 23 is a view showing the interior surface of the camming tube with the camming tube being rolled out flat, axial intermediate portions being broken away;

FIG. 24 is a transverse cross sectional view of the drive slug assembly, said view being generally taken along the line and in the direction of the arrows 24—24 of FIG. 8;

FIG. 25 is a transverse cross sectional view of the drive slug assembly, said view being generally taken along the line and in the direction of the arrows 25—25 of FIG. 8;

FIG. 26 is a transverse cross sectional view of the drive slug subassembly generally taken along the line and in the direction of the arrows 26—26 of FIG. 8;

FIG. 27 is a transverse cross sectional view showing the lift rod retaining disk in the center outer tube; said view being generally taken along the line and in the direction of the arrows 27—27 of FIG. 6;

FIG. 28 is a transverse cross sectional view generally taken along the line and in the direction of the arrows 28—28 of FIG. 6 to show the set screw for retaining the transverse outer lift inner tube in the same angular relationship to the axially inner outer tube as the lift tube moves axially relative thereto;

FIG. 29 is a transverse cross sectional view generally taken along the line and in the direction of the arrows 29—29 of FIGS. 5 and 30 to show the structure for operating the detent balls between a landing ring release position and a landing ring latching position;

FIG. 30 is a side elevational view of the piston tube with an axial intermediate portion and the end portions broken away to more clearly show the camming track and camming grooves thereon;

FIG. 31 is a side view of the drive slug (pivot rod);

FIG. 32 is an exterior view of the piston tube rolled out flat with an axial intermediate portion broken away, said view also showing the relative positions of the cam sleeve recesses and cam set screws, said view also showing different positions of one of the camming set screws and the latch ball relative to the piston tube during a cycle of operation;

FIG. 33 is a fragmentary transverse cross sectional view generally taken along the line and in the direction of the arrow 33—33 of FIG. 5 to more clearly illustrate the structure adjacent the landing ring;

FIG. 34 is a transverse cross sectional view generally taken along the line and in the direction of the arrows 34—34 of FIG. 5 showing the mounting of a pin for moving the lift rod axially outwardly relative the head tube; and the piston tube.

Figure 37:
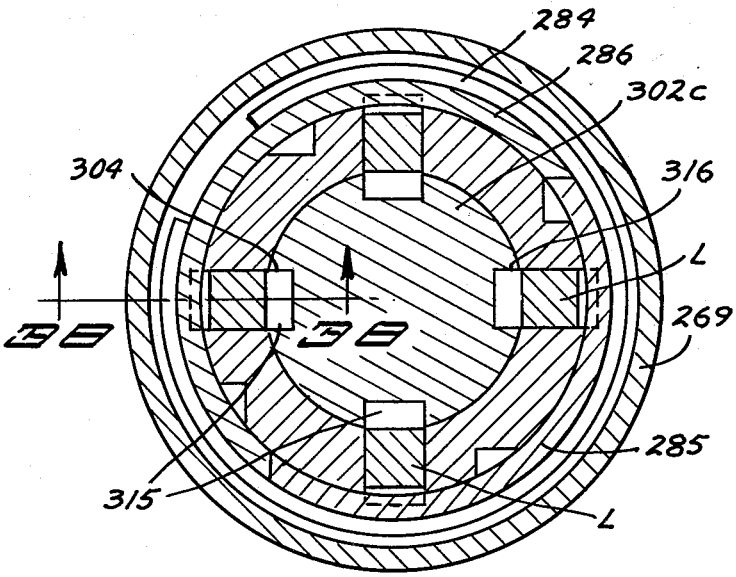
Figure 39:
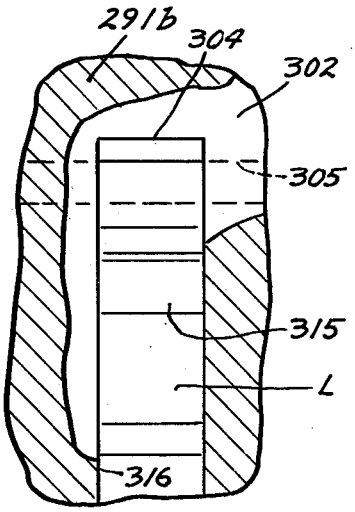
Figure 38:
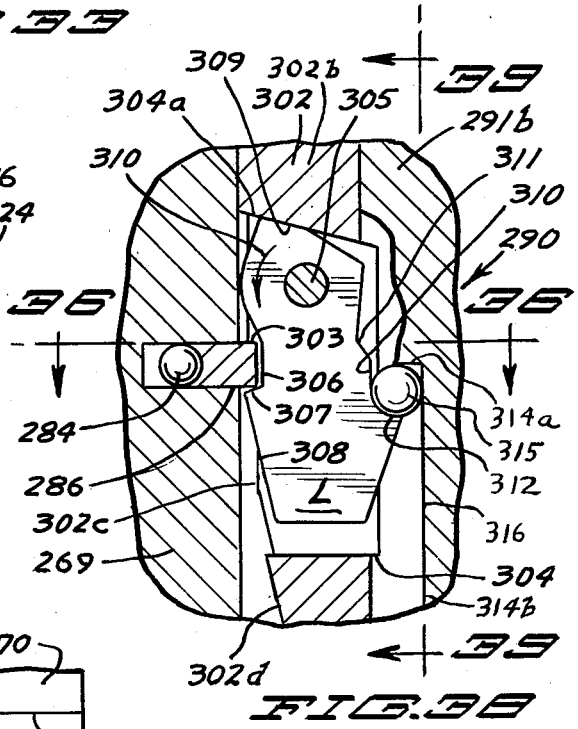
Figure 46:
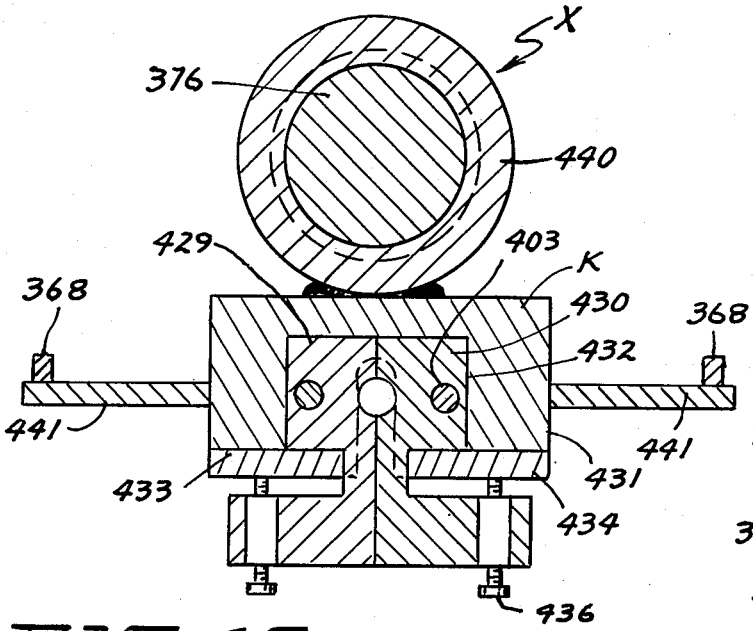
Figure 45:
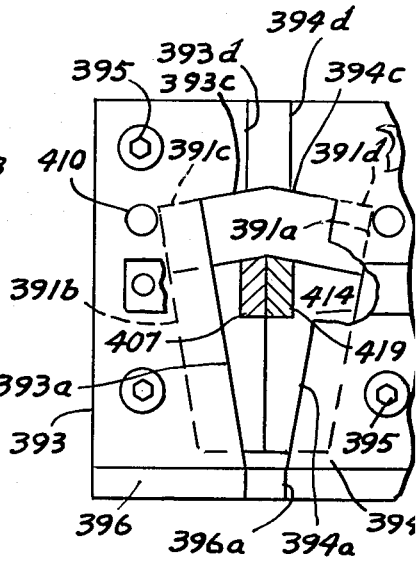
Figure 43:
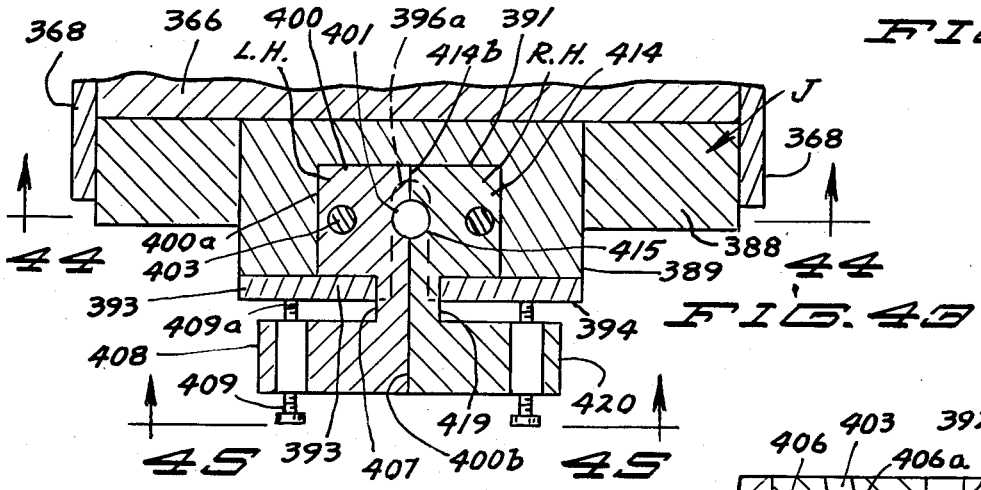
Figure 40:
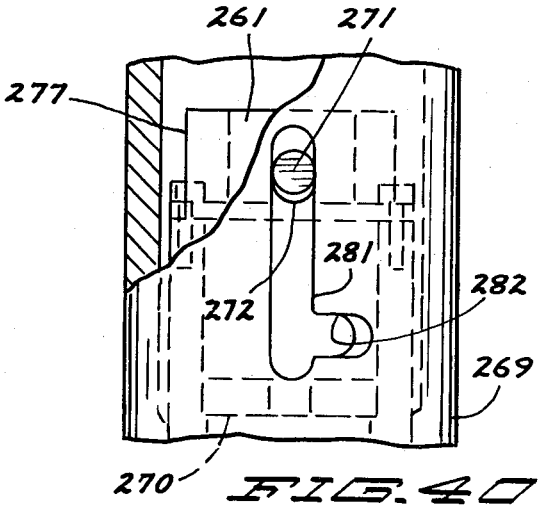
Figure 44:
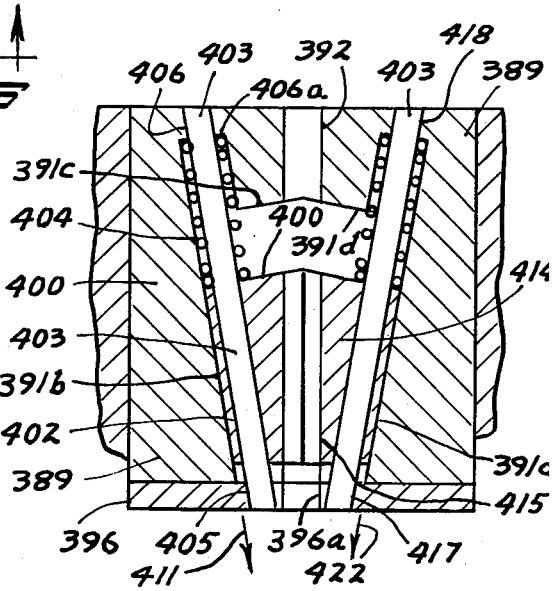
Figure 41:
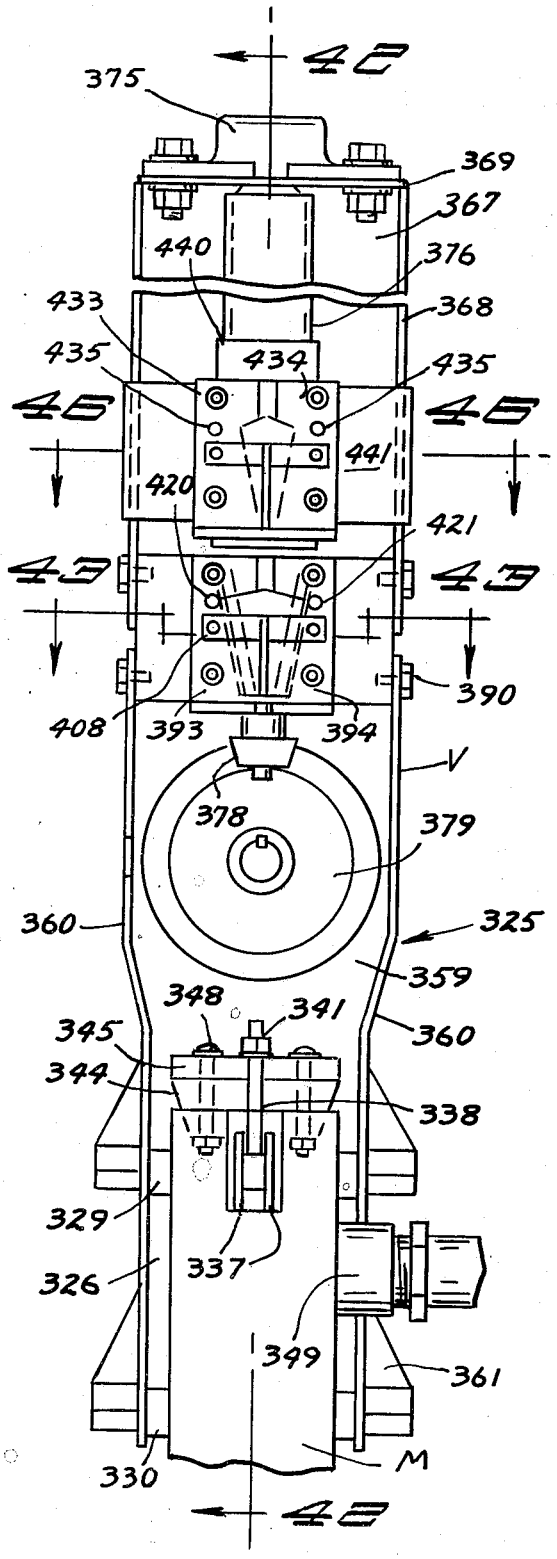
Figure 42:
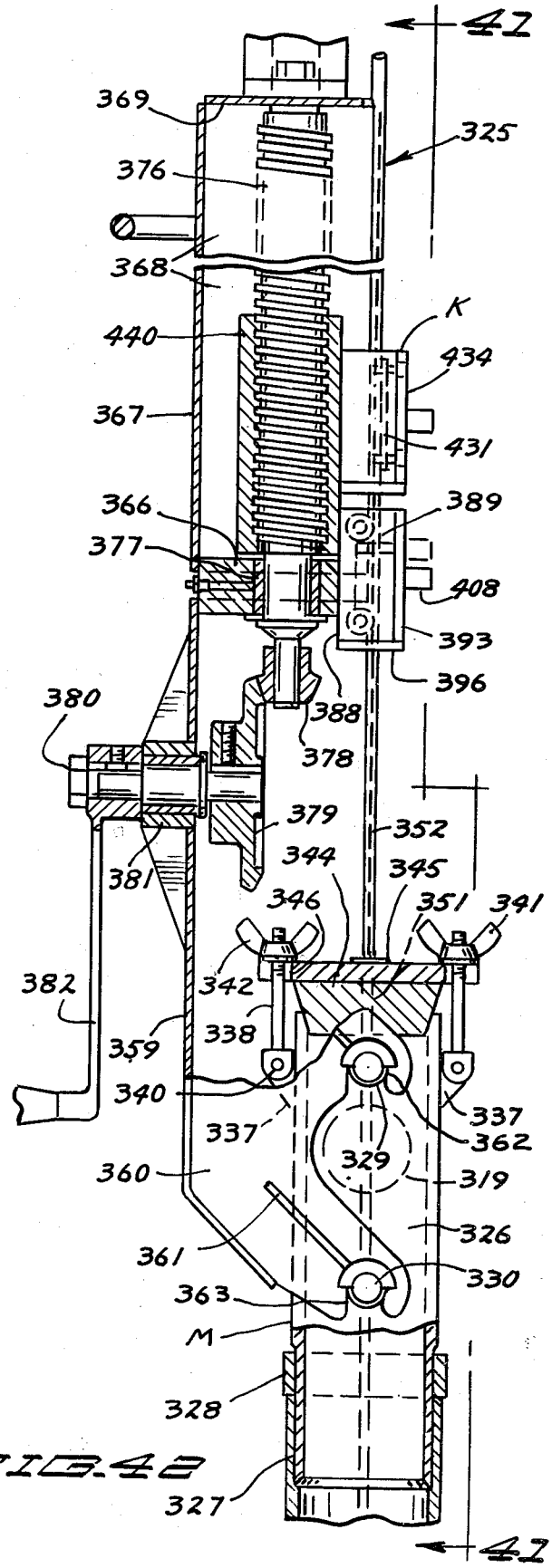
Figure 47:
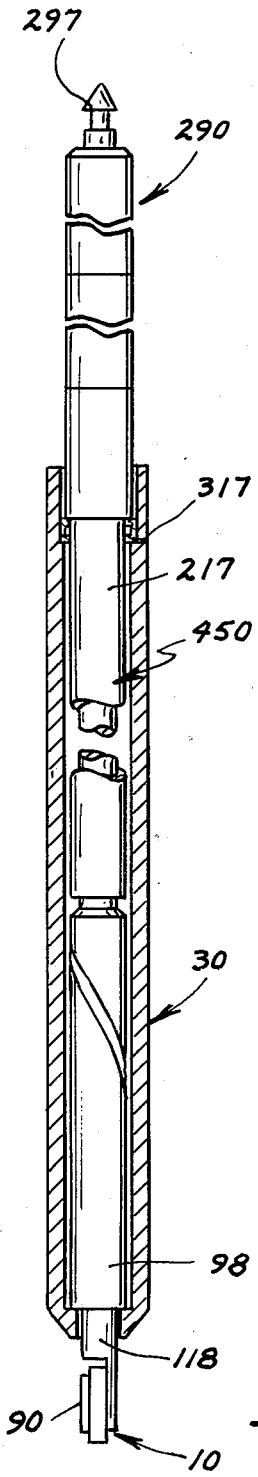
Figure 48:
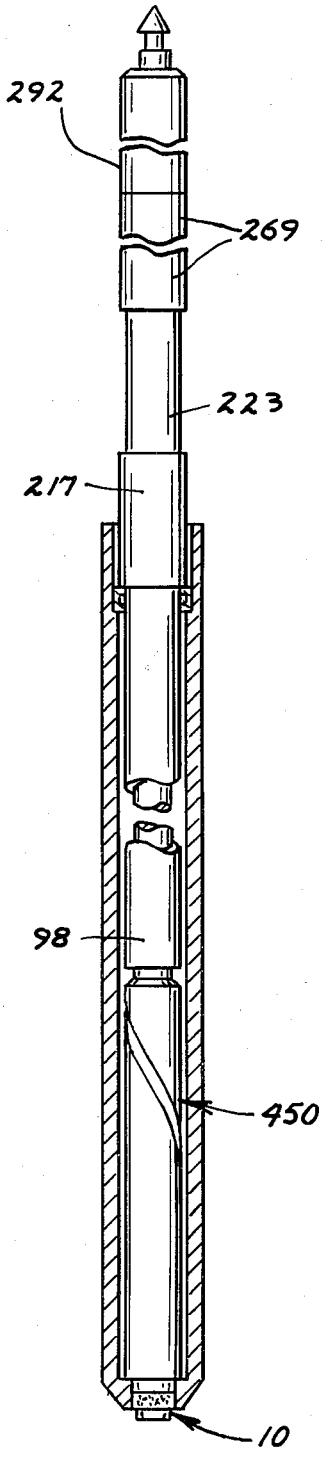
Figure 49:
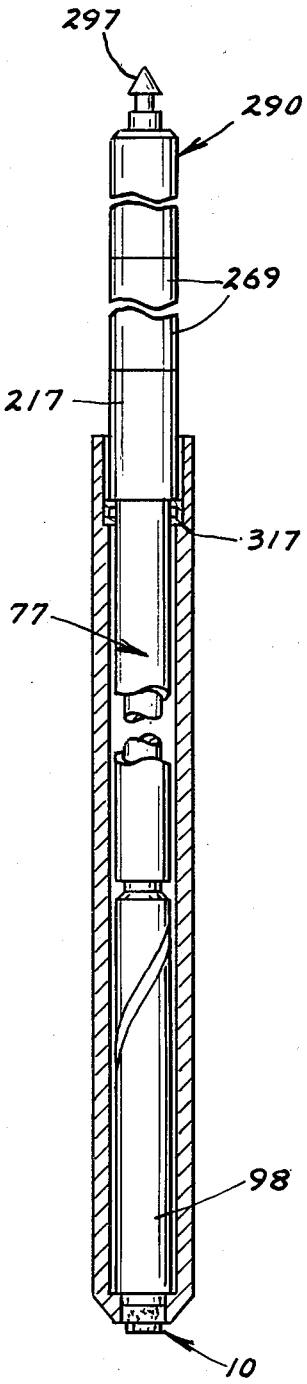
Figure 50:
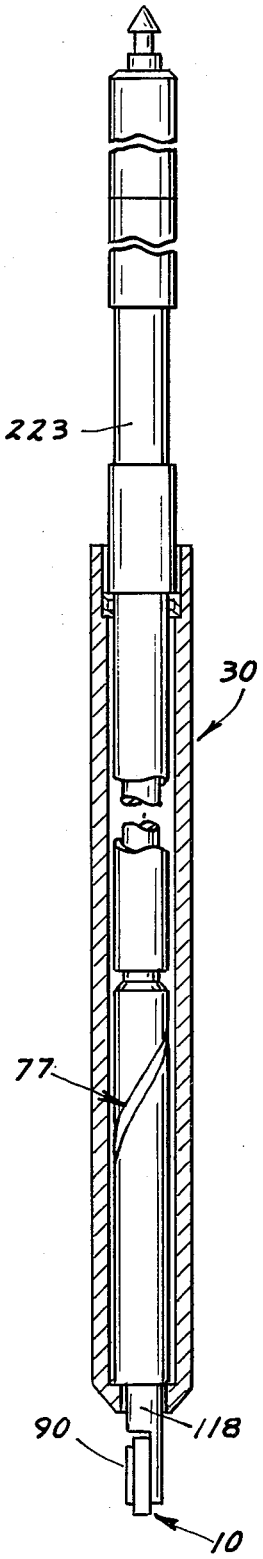

FIG. 35 is a transverse cross sectional view generally taken along the line and in the direction of the arrows 35—35 of FIG. 4 to show a portion of the stopper subassembly and the mounting thereof;

FIG. 36 is a transverse cross sectional view generally taken along the line and in the direction of the arrows 36—36 of FIG. 4 to further illustrate the construction and mounting of the stopper subassembly;

FIG. 37 is a transverse cross sectional view generally taken along the line and in the direction of the arrows 37—37 of the latching mechanism of the safety release assembly of FIG. 4 to illustrate the latching relationship to the bit retraction tool;

FIG. 38 is a fragmentary longitudinal sectional view generally taken along the line and in the direction of the arrows 38—38 of FIG. 37 to further illustrate the construction of a latch and the latch latchingly engaging a retaining ring of the bit retraction tool;

FIG. 39 is a fragmentary longitudinal cross sectional view generally taken along the line and in the direction of the arrows 39—39 of FIG. 38 to further illustrate the construction of a latch, a portion of the activating shank being broken away;

FIG. 40 is a fragmentary view of the bit retraction tool adjacent the stopper subassembly mounting pin, part of the outer lift tube being broken away;

FIG. 41 is a front view of the surface tool mounted on an axial outer end of the drill stem, with an axial intermediate portion broken away, said view being generally taken along the line and in the direction of the arrows 41—41 of FIG. 42;

FIG. 42 is in part a transverse cross sectional view generally taken along the line and in the direction of the arrows 42—42 of FIG. 41, and in part a side view of the structure of FIG. 41, an axial intermediate portion of the surface tool being broken away;

FIG. 43 is a transverse cross sectional view of the stationary clamp block subassembly, said view being generally taken along the line and in the direction of the arrows 43—43 of FIG. 41;

FIG. 44 is a fragmentary longitudinal view generally taken along the line and in the direction of the arrows 44—44 of FIG. 43;

FIG. 45 is a fragmentary front view of the stationary clamp subassembly, said view being generally taken along the line and in the direction of the arrows 45—45 of FIG. 43;

FIG. 46 is a transverse cross sectional view of the lift clamp subassembly, said view being generally taken along the line and in the direction of the arrows 46—46 of FIG. 41;

FIG. 47 is a longitudinal view somewhat diagrammatically showing the bit installation tool in latching engagement with the drill stem prior to starting retraction of the safety release tool for installing the bit on the drill stem, an axially intermediate part being broken away;

FIG. 48 is a view similar to FIG. 47 other than the safety release tool has been retracted to a position the bit is locked to the drill stem;

FIG. 49 is a longitudinal view somewhat diagrammatically showing the bit removal tool in latching engagement with the drill stem prior to starting retraction of the safety release tool for removing the bit from the drill stem, an axially intermediate part being broken away; and FIG. 50 is a view similar to FIG. 49 other than the safety release tool has been returned to a position the bit is in a position to be retracted through the drill stem.

Figure 1:
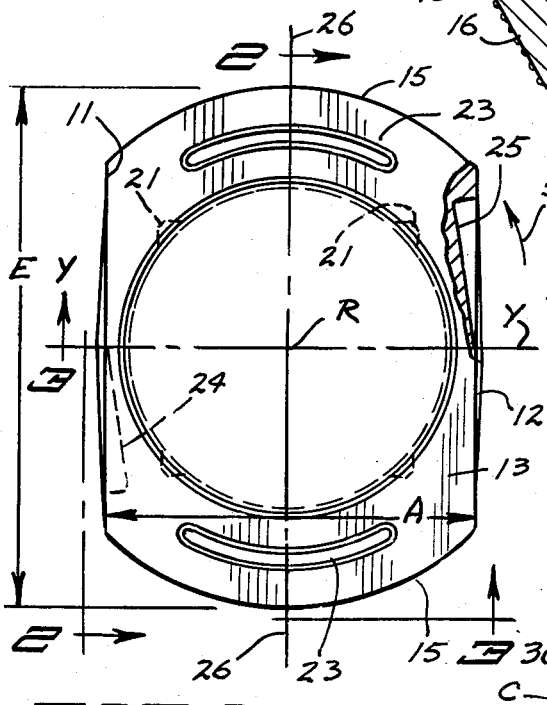
FIG. 1 is a plan view of the bit of this invention, said view being generally taken along the line and in the direction of the arrows 1—1 of FIG. 2.
Figure 2:
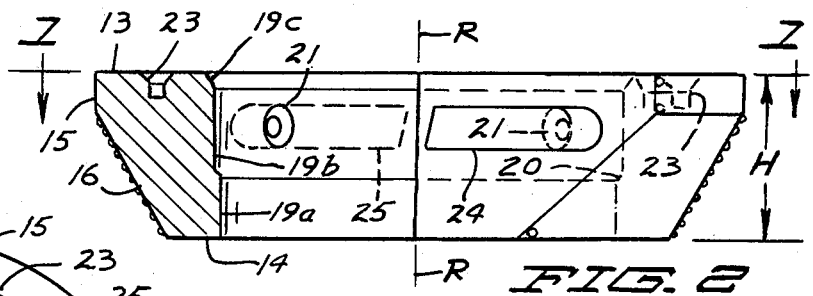
FIG. 2 is in part a transverse cross sectional view and in part a side view of the bit, said view being generally taken along the line and in the direction of the arrows 2—2 of FIG. 1.

Referring now in particular to FIGS. 1–3, the drill bit of this invention, generally designated 10, has generally planar side surfaces 11, 12 that are diametrically opposite one another and are inclined to be nearly parallel to the central axis R—R of the bit to converge in an axial outer direction. For example, the angle of one of the planar surfaces is about 3° relative the central axis. The planar surfaces extend axially between the transverse outer surface 13 and the transverse inner bottom surface 14. Further, the bit has generally cylindrical outer surface portions 15 that are diametrically opposite one another and extend between the planar surfaces 11 and 12. Extending between the axial inner edges of surfaces 15 and the bottom surface 14 are generally frustoconical surface portions 16. Industrial diamonds (not shown) are set on the surfaces 14, 16.

The bit has a central bore 19 that extends axially therethrough, the axial outer bore portion **19*c* being beveled axially and radially inwardly to intersect the axial intermediate bore portion 19*b* which is of a larger diameter than the axial inner bore portion 19*a* whereby an annular axially outwardly facing shoulder 20 is formed. Opening through the inner wall that defines bore portion 19*b* are four equally circumferentially spaced detent recesses 21**.

The planar faces 11 and 12 are respectively provided with lock key recesses 24 and 25 that are circumferentially elongated. Further, in transverse cross section the recesses are generally triangular shaped, the recesses in transverse opposite directions extending progressively closer to a plane 26—26 of the central axis of the bit that is midway between planar surfaces 11, 12. Thus in the angular direction of arrow 54, the recesses are of progressively greater depths, the minimum depth portion of the recesses being adjacent, but on transverse opposite sides of a plane Y—Y of the bit central axis that is perpendicular to plane 26—26.

The axially outer surface portion of the bit is provided with arcuatly elongated flange orienting recesses 23 that are diametrically opposite one another and are centered with reference to planar surfaces 11, 12 of the bit. The axial outer part of recesses 23 are beveled to be convergingly inclined in an inward direction. Other than for the aforementioned recesses, the axial outer surface 13 of the bit is planar and is generally parallel to the axially inner surface 14.

In order to mount the bit for drilling a bore hole, there is provided a drill stem (drill string) having an outer barrel assembly, generally designated 30, at its inner axial end (see FIGS. 8 and 13). The outer barrel assembly 30 includes a reaming shell subassembly 30A, a locking sleeve subassembly 30B, a stationary sleeve subassembly 30C, and an orienting pin subassembly 30D, each being respectively generally designated.

The reaming shell subassembly includes an axially elongated shell tube 31 that has circumferentially adjacent axially elongated lock grooves 32 and 33 respectively that open to the interior thereof and open through the inner annular edge of the tube. Welded to the inner annular edge of the shell tube is an adapter ring 34, the adapter ring having diametrically opposite, arcuately elongated flanges **34*a* that extend axially away from the tube 31 and are extendable into the orienting recesses 23 of the bit. The arcuate length of each of the flanges is substantially less than that of a recess 34. Further the adapter ring is provided with a pair of arcuately elongated recesses 35 that open toward one another, and are centered between the flanges 34*a***.

Welded to the adaptor ring to extend axially inwardly thereof are a pair of diametrically opposed drive lugs 36 and 37 respectively (see FIGS. 11, 12 and 13). Since each of the drive lugs is of the same size and shape, other that they are oppositely faced, primarily only drive lug 36 will be described. Drive lug 36 includes a generally planar face **36*a* that in axial direction is inclined at an angle substantially equal but opposite the angle of inclination of the adjacent planar side surface of the bit 10 when it is mounted on the drill stem. Further, the drive lug includes a cylindrical outer surface 36*b* that is curved to form a continuation of surfaces 15, and frustoconical surface 36*c* which is shaped from a continuation of surfaces 16. Additionally the drive lug includes an axial inner surface 36*d* that is shaped to form a continuation of the inner surface 14. The drive lugs 36, 37 are mounted by the adaptor ring to have the planar surfaces 11, 12 of the bit received between the planar surfaces of the drive lugs and the surface 14 of the bit to be a general planar continuation of the drive lug axial inner transverse surfaces. At this time the combination of drive lugs and bit provide a circular annular axial inner surface. The drive lugs are provided with diametrically opposite arcuately elongated key lock receiving recesses 39 that open axially to the adjacent adapter ring recess and radially to the bit recesses 24 and 25, respectively when the bit is locked to the outer barrel assembly 30**.

Located in the shell tube is the locking sleeve subassembly 30B which includes an axially elongated locking sleeve 44. The locking sleeve has an axial inner annular edge 45 that is in rotatable abutting relationship to the outer edge of the adapter ring, diametrically opposed extensions 46 of the sleeve extending through the adaptor ring recesses and mounting lock keys 47 that are extendable into the bit recesses 24, 25 for releasably retaining the bit in driven relationship to the drive lugs.

Mounted on the transverse inner surface of the locking sleeve adjacent the axial inner end thereof are a plurality of stabilizing pads 49. Axially outwardly of the stabilizing pads, the locking tube is provided with a general rectangular opening 50. A circumferentially elongated detent spring 51 has one axial edge **51*a*** welded to an axial edge that in part defines the opening 50 (see FIG. 14). Circumferentially remote from edge 51*a*, the detent spring has an axially elongated dimpled portion 52 that extends radially outwardly. In one angular position of the locking sleeve relative the shell tube, the dimple 52 extends into groove 33 and in a second angular position, the dimple 52 extends into groove 32. Thus the spring 51 serves to resiliently retain the locking sleeve in one of two angular positions relative to the shell tube.

Referring now in particular to FIG. 16, it is to be noted that the locking sleeve includes an axial outer transverse edge 58 and axial intermediate transverse edge 59. From one circumferential end of the transverse edge 58, the locking shell has an axial edge 60 that at the inner end thereof intersects the edge 61 that is inclined inwardly in the angular direction represented by arrows 54. The inner edge of 61 intersects an axial edge 62 which in turn intersects one end of edge 59, the opposite end of edge 59 intersecting one end of axial edge 66. The outer end of axial end 66 intersects one end of an edge 65 that is inclined axially outwardly in the angular direction represented by arrow 53. The outer end of edge 65 intersects the one end of axial edge 64, the edge 64 intersecting the transverse edge 58 circumferentially remote from edge 60. The circumferential spacing of edge of 66 from edge 62 is substantially the same as the circumferential spacing of edge 60 from edge 64, however, edge 65 is located further axially outwardly than edge 61.

The stationary sleeve 70 of the stationary sleeve subassembly 30C has an extension 70*a* that extends into the cutout defined by edges 59–62, 64–66; the sleeve having an axial intermediate edge 72 abutable against edge 58 and an axial inner edge 71 that is closely adjacent to or in abutting relationship to edge 59. Extending between one end of edge 72 and transverse edge 71 is an axial edge 73 while an axial edge 74 extends between the opposite ends of transverse edges 71, 72. The minimum circumferential spacing between edges 60, 73 is sufficiently great to have the locking pin 75 extend radially therebetween while the minimum circumferential spacing of edges 64, 74 is sufficiently great to have the locking pin 76 extend therebetween. In order to prevent the sleeve 70 from rotating when the locking pins extend between the aforementioned edges and are moved axially relative thereto, a set screw 69 is threaded through the shell tube and into the stationary tube extension 70*a*.

Referring now in particular to FIGS. 13, 20 and 21, the stationary tube 70 has diametrically opposed, axially elongated openings 82 adjacent its transverse outer edge 78. For each opening 82, an axially elongated leaf spring 83 has its axial opposite edges retained in grooved portions 83*a* of the stationary tube that opens to the shell tube while the intermediate portion thereof resiliently extends through opening 82 and a short distance into the interior of the stationary tube. The axially intermediate portion of the leaf spring mounts a radially inwardly extending button 84 to be diametrically opposite the button of the other leaf spring. Further, a plurality of circumferentially spaced stabilizing pads 85 are mounted on the inner surface of the stationary tube adjacent its transverse outer edge 78.

In order to remove the bit 10 that is being retained between the drive lugs 36, 37, there is provided the bit retraction tool, generally designated 77. Referring now in particular to FIGS. 8–12, the tool 77 includes a floater subassembly F that has an annular floater 90. The floater 90 has an outer enlarged diametric portion 90*a*, an intermediate portion 90*b* that in conjunction with portion 90*a* provides a shoulder seatable on the axial outer surface of the bit, and a reduced diameter portion 90*c* that in conjunction with portion 90*b* forms a shoulder. Additionally, the floater has a bore 91 extending axially therethrough, the bore being defined by diametrically opposed parallel planar wall portions 91*b* of the floater and diametrically opposed cylindrical wall portions 91*a* that extends between planar wall portions. The axial inner end of the bore is closed by a plug 97 other than for a central bore that extends through the plug.

Circumferential spaced apertures 92 extend radially through the intermediate portion of the floater for mounting lock balls 103 in a position to be moved into the detent recesses 21 of the bit. Circumferentially between a pair of apertures 92 of the floater is provided with a slot 94 that extends radially therethrough and opens through the transverse outer surface thereof. Diametrically opposite slot 94 the floater is provided with an axially elongated slot 95 that opens to bore 91 and through the transverse inner surface of the floater, the inner end of slot 95 opening to a plunger recess 96 which in turn opens to bore 91.

Mounted for axially movement in the floater bore 91 is a floater plunger 101 that has diametrically opposite cylindrical surface portions 101*a* that form a close sliding fit with cylindrical wall portions 91*a* and diametrically opposed planar wall portions 101*b* that form close sliding fit with wall portions 91*b*. Further, the plunger has circumferential spaced recesses 102 that when radially aligned with cylindrical apertures 92 permit the lock balls 103 moving radially relative the drill bit; but when the plunger is moving axially inwardly, the cylindrical surface portions force the balls into recesses 21 as will be more fully explained hereinafter.

Mounted within a radial aperture 106 in the floater plunger is a ball plunger 104 that is resiliently urged radially outwardly by a spring 105. At the time the finger 99 of the cam tube 98 of the cam tube subassembly, generally designated C, extends through slot 95 and the part thereof axially outwardly of its beveled inner end abutting against the ball plunger, the ball plunger is retained within the confines of the plunger aperture 106. However, when the finger 99 is axially outwardly of the recess and the ball plunger is radially adjacent recess 96, spring 105 moves the ball plunger into the recess 96 to prevent the relative axial movement between the plunger 101 and the floater 90.

The plunger 101 is provided with a pair of axial apertures 109, springs 110 being located within the apertures and bearing against the head portions of screws 111 and shoulders on the plunger 101 to resiliently urge the plunger 101 axially toward the floater plug 97. The screws 111 are threaded into the floater plug. The plunger 101 has a slot 113 extending diametrically thereacross to open outwardly and provide outwardly extending ears 101*c*. A transverse pivot 115 is mounted by one radially outer end portion of the plunger ears for pivotally mounting a pivot member 117 that extends across the slot 113. The slot 94 is of a size to have the pivot member extend thereinto when the plunger 101 is moved to be closer adjacent the floater plug 97.

The pivot member 117 forms part of the drive slug subassembly D and is welded to the inner end of the extension 118*a* of the drive slug (pivot rod) 118 (See FIGS. 8, 24 and 31). A cylindrical opening 119 extends axially through a transverse outer portion of the drive slug and continues the axial length of the extension to open radially inwardly. The inner part of the cylindrical portion 118*c* of the pivot rod 118 has an axially elongated bore 120 that opens through the inner transverse surface 118*b* of the cylindrical portion and opens to the cylindrical opening 119. Also cylindrical portion 118*c* has an arcuate recess 124 that opens to the cylindrical opening 119 just outwardly of the bore 120 and is provided for receiving a portion of the latch disk 123. On the radial opposite side of the cylindrical opening from the arcuate recess, the cylindrical portion 118*c* is provided with an axially elongated slot 125 that opens to the cylindrical recess and through the outer circumferential surface portion 118*c*, the slot being of a size to receive a portion of the latch disk and extending axially outwardly a greater distance than the arcuate recess. The diameter of the latch disk is greater than the maximum transverse dimension of the arcuate slot plus the diameter of the cylindrical opening and also is greater than the combination of the transverse dimensions of opening 119 and slot 125. Axially aligned with slot 125 and axially outwardly thereof the cylindrical portion has an axially elongated transfer pin slot 128 that opens through the transverse outer surface of the portion 118*c* to the cylindrical opening. Axially intermediate slots 125, 128 the cylindrical portion is provided with a transverse aperture 112 that opens to the cylindrical opening and to the transverse outer surface thereof on the diametrically opposite side from slots 125, 128 for mounting a rotation pin 127. An axially elongated spring shaft 129 has its inner end mounted by the outer end of the drive slug.

The axially inner end portion of the cylindrically portion 118*c* is provided with a transverse outer arcuate cutout that provides a recess 122 of a size to have the finger 99 extended thereinto and at the same time permit the drive slug to be rotated through an angle of approximately 90° relative the finger.

Mounted in the cylindrical opening of the drive slug for slideable movement relative thereto is an axially elongated cylindrical actuating rod 131, the clevised inner end of the actuating rod being pivotally connected at 134 to the outer end of a pivot arm 135. The inner end of the pivot arm is pivotally connected by a pivot member 136 to the ears of the plunger 101. As may be noted in FIG. 8, pivot 136 is transversely opposite pivot 115 and is parallel thereto. Outwardly of the pivot 134, the actuating rod has a disk slot 137 for rotatably receiving a latch disk 123 while permitting very limited axial movement of the latch disk relative the actuating rod. Outwardly, of the disk slot, the actuating rod has an axially elongated rotation pin slot 138 for having one end of the rotation pin 127 extended thereinto. The outer end of slot 138 limits the axial inward movement of the actuating rod relative the drive slug. Outwardly of slot 138 the actuating rod has an aperture 140 for mounting the transfer pin 139 to extend into the transfer pin slot 128. The relative position of the rotation pin and transfer pin and their slots are such that the actuating rod cannot move to a position that the latch disk can move into the transfer pin slot 128.

Referring to FIGS. 7 and 8, the spring shaft 129 slidably extends through the reduced diameter bore portion of the spring cap 126, there being provided a spring 130 having one end abutting against the spring cap and an opposite end abutting against a washer 132 that in turn abuts against a thrust bearing 133 which abuts against the drive slug. This structure permits limited axial movement of the drive slug relative the spring cap and the drive slug rotating relative the spring cap. On the outer end of the spring shaft there is provided a snap ring 147 abutting against a washer which in turn abuts against a thrust bearing 133 that is on the axial opposite side of the reduced diameter bore portion from spring 130. This structure limits the axial inward movement of the drive slug relative the spring cap. An axial outer drive slug 148 is threaded into the spring cap bore and has a recess 149 into which the spring shaft may be extended to permit limited axial movement of the spring shaft relative thereto. The axial outward movement of the drive slug 148 relative the cam tube 98 is limited by abutting against a snap ring 150 that is mounted in a groove in the cam tube.

The drive slug 148 has a bore 152 extending diametrically therethrough (see FIG. 17), an annular locking pin body 153 being mounted at each end of the bore and having a transverse outer, enlarged diametric flange seated against the adjacent enlarged bore portion shoulder 152*a*. In each of the locking pin bodies there is mounted one of the locking pins 75, 76 for radial movement, a snap ring 157 being provided in body to limit the radial inward movement of the respective pins. A spring 155 at one end bears against the inner enlarged flange 75*a* of the pin 75 and at opposite end abuts against shoulder 153*a* of the body for resiliently urging pin 75 radially inwardly. Pin 75 also has a transverse outer enlarged annular flange 75*b* and a head portion 75*c* extending transversely outwardly of flange 75*b*. Spring 155 resiliently retains pin 75 in a position that head 75*c* does not extend radially outwardly of the outer peripheral wall of the cam tube 98, and flange 75*b* is located transversely between the inner and outer peripheral walls of the cam tube as will be more fully set forth hereinafter. Locking pin 76 is of the same construction and mounted in the same manner as pin 75 but is oppositely faced.

The axial inner ball screw assembly B includes a ball nut 161 that is secured to a flange 162 that is bolted by bolts 163 to the outer end of the drive slug 148 to prevent rotation of the ball screw nut relative the drive slug. An axial inner ball screw 164 is threadedly extended through the ball 161 and into the bore 156 of the drive slug 148 whereby as the ball screw is rotated relative the ball nut 161, the drive slug 148 is moved axially relative to it. The other end of the ball screw is mounted by bearing shaft 167 to be rotated thereby, the bearing shaft rotatably extending axially through a coupling 168. A bushing 170 is provided between part of the coupling and the outer end portion of the bearing shaft. Thrust bearings 171 are provided on either axially side of the enlarged diametric flange 168*a* of the bearing shaft. The coupling cap 172 is bolted at 173 to the coupling 168 for removably retaining the bearing shaft in a fixed axial position relative the coupling. The outer end of the cam tube 98 is threadably mounted on the coupling 168.

Referring now to FIGS. 22 and 23, the cam tube includes a pair of axially elongated diametrically opposite orienting pin grooves 175 in the transverse outer surface portion thereof. The outer ends 175*a* of the grooves are located a short distance inwardly of the coupling 168, the grooves including outer linear portions 175*b* that at their lower ends are joined to groove portions 175*c*. Groove portions 175*c*, as they extend axially inwardly, are curved around the circumference of the cam tube in the angular direction of arrow 178, the groove portions 175c extend angularly through an angle of 188°. Just axially outwardly of groove portions 175c, groove portions 175b open to an annular groove 179.

Diametrically opposed locking pin slots 176 are located between groove portions 175c and have enlarged outer slotted end portions 176a, axially elongated linear portions 176b, and inner ends 176b that are located axially outwardly of the inner ends 175d of the orienting pin grooves. Referring to FIGS. 18, 19, a short distance inwardly of the slotted portion 176a, on each wall defining the respected slotted portion 176c has a generally trapezoidal cam portion 177, which is of an altitude substantially the same as the radial thickness of the cam tube and has its minor base 177a substantially coextensive with the outer periphery of the cam tube. The outer edges 177d of the cam portions 177 are inclined transversely outwardly in an axial inward direction while the opposite edges 177c of the cam portions are inclined axially inwardly in the transverse inward direction. As the locking pins 75, 76 are moved in the slots 176 to a position that their flanges 75b, 76b engage surfaces 177d, the locking pins are cammed transversely away from one another to positions to extend between the circumferentially spaced, axially extending edges of the locking sleeve 44 and the outer sleeve 70 such as shown in FIG. 16. As the locking pin flanges 75b, 76b moveover surfaces 177c, the locking pins are resiliently urged toward one another to be retracted from extending between sleeves 44, 70.

A generally L-shaped transfer pin slot 180 is provided in the cam tube, the slot 180 having an axially extending leg 180a, that has its outer end located circumferentially between the inner ends of the orienting pin grooves 175. Further, the transfer pin slot has a circumferentially extending leg 180b that extends arcuately through an angle of about 122° and arcuately in a direction opposite arrow 178 from the inner end of leg 180a.

Additionally, the cam tube is provided with a rotation pin slot 181 that has an axially extending leg 181a with an upper end circumferentially between orienting pin groove ends 175d and on the diametrically opposite side of the tube from leg 180a. Leg 181a extends a substantial distance axially inwardly of leg 180b, and at its inner end intersects an arcuately curved, axially inwardly extending leg 181b. Leg 181b extends arcuately through an angle of about 90° (in a direction opposite arrow 178) and at its inner end intersects the short axial leg portion 181c.

Inwardly of the inner slot portion 181c, the cam tube is provided with a roller (latch disk) slot 182. The slot has a circumferentially elongated slotted portion 182a that extends arcuately (through an angle of about 120°, one end portion of slot portion 182a opening to an axial slotted portion 182b. The axial dimension of the transverse inner peripheral wall portion of the slot is greater than the axial dimension of the outer wall portion whereby the wall portions that in part define the slot are somewhat dished-shaped at 182c.

Referring now in particular to FIGS. 6 and 7, the lift tube subassembly X includes an axial inner, transverse outer tube 197 having its inner end threadedly mounted on coupling 168. The inner end of the axial outer ball screw 192 is connected to the bearing shaft 167 to rotate the bearing shaft therewith. The ball screw 192 extends through the axial outer ball nut 193 whereby as the ball nut is moved axially, the ball screw is caused to rotate. Located within the transverse outer lift tube 197 is a transverse inner lift tube 191 that has its inner end attached to the ball nut 193 to move the ball nut therewith. A set screw 196 is threadedly mounted by the outer lift tube and extended into the axially elongated groove 195 of the inner lift tube to prevent the inner lift tube rotating relative the outer lift tube as the inner lift tube is moved axially relative the outer lift tube.

The axial outer end of the transverse outer lift tube 197 is threadedly connected to the inner one of the coupling half section 200 of the swivel subassembly S. A swivel connector 201 connects the swivel half section 200 to the outer swivel half section 202 which in turn is threadedly connected to the inner end of the axial center, transverse outer tube 211 of the axial center, transverse outer tube subassembly G.

The inner lift tube 191 is axially movable in the swivel subassembly, the outer end of the lift tube 191 being threadedly connected to the lift cap 203. A lift stud 207 is extended through the lift cap, there being provided snap rings 206, washers 205 and thrust bearings 204 on either side of the outer portion of the lift cap to prevent the lift cap moving axially relative the stud but to permit rotation of the lift cap relative to the stud.

The outer end of the lift stud 207 is threadedly connected to the axially elongated lift rod 212 that is rectangular in transverse cross section. The lift rod extends axially outwardly through a rectangular aperture 214 in the plate (shaft retaining disk) 213 that is welded in a fixed position in the tube 211 (also see FIG. 27). The disk has a plurality of fluid bypass apertures 215 that open to the rod aperture 214.

The lift rod extends axially outwardly of the retaining disk 213 and axially slideably through a piston 218 that is threadedly secured to the lower end of a piston tube 233 to be moved therewith (see FIG. 5). The piston has an O-ring 219 for forming a fluid seal with the head tube 217. The inner end of the head tube is threadedly connected to the center outer tube 211, a lock ring 220 being threaded on the head tube and abutting against the outer tube to retain the outer tube in an adjusted threaded position on the head tube.

An axial intermediate portion of the piston tube is rotatably and axially slidably extended through a cam sleeve 224, the outer transverse edge of the cam sleeve abutting against a retainer ring 225 that is mounted by the head tube to prevent the cam sleeve moving axially outwardly relative the head tube. The inner end of the cam sleeve abuts against an annular shoulder 221 of the head tube, the cam sleeve being rotatable relative the head tube but not axially movable relative thereto. Three pins 226 are mounted in equal circumferentially spaced relationship by the cam sleeve to respectively extend into one of the equally circumferentially spaced, transversely outwardly opening, axially elongated grooves 232–234 of the piston tube to prevent relative rotation between the cam sleeve and the piston tube (see FIG. 33). Axially inwardly of the pins 226, the cam sleeve is provided with three latch recesses 227 that are circumferentially equally spaced from one another and three latch recesses 228 that are equally circumferentially spaced from one another (see FIGS. 30 and 33). With the pins 226 extended into the axially elongated portion of 223a of groove 232–234, the recesses 227, 228 are located such that one recess 227 is located on one side of groove portion 223a and one recess 228 is located on the circumferential opposite side and closely adjacent the same groove portion. With reference thereto, the relative positions of the recesses 227, 228 and the pins 226 are illustrated in dotted lines in FIG. 32 to show their positions relative the grooves.

The inner end of each groove portion 223*a* opens to the inclined groove portion 223*b* that extends circumferentially in a direction of the arrow 231 in an inward direction, the inner end of groove portions 223*b* opening to the short axial groove portions 223*c*.

The outer end of each groove 232–234 opens to the cam track T. For each of the aforementioned grooves, the cam track includes an axial edge 239 and an inclined edge 240 that at their inner ends open to the respective groove, portion 223*a*, edge 240 being inclined to diverge away from edge 239 in an outward direction. The outer end of edge 240 is joined to an inclined edge 241 which extends outwardly about the same distance from the respective groove as edge 239 but diverges at an angle that is substantially smaller than the angle of divergence of edge 240. The outer end of edge 241 is joined to the outer end of an axial edge 242 while the inner end of edge 242 is joined to the inner end of an inclined edge 243, which in turn is joined to the inner end of inclined edge 244. The angle of divergence of edges 243 and 244 relative edge 242 is the same as that of edges 241 and 240 to edge 239. The outer end of edge 244 is joined to the edge 239 of the next adjacent one of groove portions 223*a*.

Approximately midway between the edges 239, 242, for each groove, the cam track has an axial edge of 247 that at its upper end is joined through a reversely curved edge portion 250 to an inclined edge portion 249. Edge portion 249 at its inner end is joined to an edge portion 248, edge portion 249 in an inward direction diverging from edge 247 at a substantially greater angle than the angle of divergence of edge portion 248 from edge 247. The inner end of edge portion 248 is approximately midway between the circumferentially adjacent parts of edges 244, 242. The inner end of edge 247 is joined to an edge 245 which, in turn, is joined through edge portions 246 and 253 to the outer end of axial edge portion 254. The shape of edge portion 245, 246, 253 and 254 is the same as that of edge portion 248, 249, 250 and 247, respectively. Mounted by the head tube to extend into the cam track groove T are three equally circumferentially spaced set screws 252, screws 252 being axially outwardly of the cam sleeve 224.

Just axially outwardly of the cam track T, the piston tube has an enlarged diametric portion 223*d* in which there is provided a groove that mounts an O-ring 256 to form a fluid seal with the head tube axially outwardly of the apertures 229.

The reduced diameter inner end portion of an adjustment sleeve 257 is threadedly mounted in the outer end of the piston tube, a locking sleeve 258 being threaded on the adjustment sleeve in abutting relationship to the piston tube to hold it in an adjusted axial position relative the adjustment sleeve. The reduced diameter end portion of an axial outer sleeve 261 is threaded into the enlarged diameter portion of the adjustment sleeve 257 and bears against a thrust collar 262 that abuts the outwardly facing annular shoulder 260 of the adjustment sleeve. The inner diameter of collar 262 is substantially less than the minimum inner diameters of each of sleeves 257 and 261, the lift rod 212 extending through the thrust collar in spaced relationship to the inner peripheral wall thereof.

A spring washer 263 is retained in abutting relationship with the inner transverse edge of the adjustment sleeve 257 by spring 264, the inner end of spring 264 abutting against the spring collar 265 that is welded to the lift rod 212.

Axially between the spring washer 263 and the thrust collar 262, axially spaced pins 266 and 267 are mounted by the lift rod. The axial length of each of the pins is greater than the inner diameters of the washer and collar, pin 266 serving to abut against the washer 263 for retaining the spring in compression during assembly. Pin 267 provides an indication of proper adjustment of the threading of the adjustment sleeve in the piston tube and the head tube in the outer tube 211. Axially outwardly of the thrust collar, the lift rod mounts a pin 268 that is of a greater axial length than the inner diameter of the thrust collar.

Axially outwardly of the lift rod 212 and in the outer end portion of the outer sleeve 261, there is welded a plug 270 that has a central aperture 278 therethrough (see FIGS. 4, 36 and 40). Outwardly of the plug, the sleeve has diametrically opposed slots 272, a spring pin 271 being extended through the slots and movable a limited amount in the slots in an axial direction. The spring pin is mounted by a stopper 273 which slidably extends through the central aperture in a retainer plate 275. The retainer plate is bolted at 276 to the inner circumferential wall portions of diametrically opposed retainer plate slots 277 of sleeve 261. As may be noted in FIG. 4, the retainer plate is axially between the plug 270 and the spring pin 271. A coil spring 274 has one end abutting against the retainer plate and an opposite end abutting against the annular flange at the base of the generally frustoconical head portion of the stopper for resiliently urging the stopper to a position to block fluid flow through the plug aperture 278 when pin 271 is in the inner end portions of slots 272.

The transverse outer end portions of pin 271 slidably extends into axially elongated slots 281 that are provided in the axial outer lift tube 269. Transverse slots 282 open to the slots 281 at a slight distance above the inner ends thereof whereby the tube 269 can be rotated relative the pin 271 a limited amount in a transverse plane. Slots 281 are of a substantially greater axial length than that of slots 272.

Referring to FIGS. 4, 37 and 38, axially outwardly of the lift tube slots 281, the lift tube is provided with a transverse inner, angular recess 287, a wire snap ring 284 being mounted in the recess to resiliently retain the two retainer ring half sections 285, 286 with their ends closely adjacent or in abutting relationship whereby the retainer ring has a smaller inner diameter than the inner diameter of the adjacent part of the inner peripheral wall of the lift tube 269.

A reduced diameter portion 302*c* of a latch mounting cylinder 302 is extended axially through the retaining ring 285, 286, the latch mounting cylinder being part of a safety release assembly, generally designated 290. The inner end of portion 302*c* of the cylinder is joined to the major base end of a frustoconical tapered portion 302*d* which has its inner end close by a wall 302*e*. The outer end of portion 302*c* is joined to an intermediate diameter cylindrical portion 302*b* to form a shoulder 303 therewith that abuts against the retaining ring 285, 286 to limit the inward movement of the safety release tool relative the bit retraction tool. The outer end of cylindrical portion 302*b* is joined to enlarged diametric flange 302*a* that has a greater outside diameter than the inner diameter of the adjacent end of the lift tube 269.

The axial outer reduced diameter end portion of an activating shank 291 extends through a compression spring cylinder 292 that has its inner end welded to the latch mounting cylinder 302. Adjustment member 293 is threadedly mounted by the outer end of the compression spring cylinder, the activating shank being slideably extended through the adjustment member and at its outer end having a spear point head 297 mounted thereto by a pin 296. A spring 294 is provided on the activating shank and has one end abutting against the adjustment member and an opposite end abutting against a compression collar 295 that is welded to the shank whereby the activating shank is resiliently urged inwardly. A set screw 316 is mounted by the spring cylinder to extend into a position to limit movement of the compression collar in the event an axial outer force of greater than a preselected value is exerted on the spear point head while the spring cylinder is prevented from moving axially outwardly. Prior to the compression collar abutting against screw 316, the latches L will have moved to a retainer release position as will be set forth hereinafter. The movement of the activating shank in an axial inward direction is limited by the shank abutting against the transverse wall 302*e* of the latching mounting cylinder.

The latching mounting cylinder has four circumferentially spaced latch slots 304, a latch pin 305 mounting a latch L in each of the slots. In a retainer ring latching position, each latch has a transverse outer axial edge 306 that at its inner end intersects with the transversely extending edge 307 to provide a shoulder for abutting against the inner surface of the retainer ring. Edge 307 is inclined transversely outwardly and slightly axially inwardly; and is transversely outwardly and axially inwardly of the pivot axis of pivot pin 305 whereby the latch can pivot in the direction of the arrow 310 as will be set forth herein after. Inwardly of the edge 307, the latch has edge 308 that is inclined both axially and transversely inwardly to provide a camming surface for expanding the retainer ring 285, 286 and snap ring 284 transversely outwardly further into recess 287 when the activating shank is abutting against wall 302*e* and the safety release tool is moved axially inwardly relative the lift tube to a position to latchingly engage the retainer ring such as shown in FIGS. 4 and 38. Further, each latch has a transversely and axially outwardly tapered edge 309 that is abuttable against adjacent edge 304*a* that in part defines latch slot 304 for limiting the pivotal movement of the latch about latch pin 305 in a direction opposite arrow 310. Transversely opposite from edges 306, 307, the latch is provided with a rounded transverse inner, axially outwardly facing shoulder 312 for abutting against a roller 315 whereby the roller is retained adjacent the transverse outer and axial inner portion of the activating shank that in part is defined by the axially elongated roller groove 314. The groove opens through the transverse inner surface of the activating shank. Latch edges 309 and slot edges 304*a* limit the movement of the latches in the direction opposite of the arrow 310 whereby shoulders 312 abut against the rollers to retain the rollers in the roller grooves.

Axially outwardly of shoulder 312, each latch has a rounded transverse inner shoulder 311 that is curved to face transversely inwardly in an axial outward direction. A generally axially extending edge 310 extends between shoulders 311, 312. When the pull on the activating shank exceeds a preselected value, the shank 291 moves axially outwardly relative the cylinder 302. As a result the axial outer transverse wall portions 314*a* of grooves 314 move outwardly and the rollers roll outwardly between edges 310 and the axial wall portions 314*b* that in part define grooves 314 to a position to abut against shoulders 311. At this time the latches can pivot in the direction of arrow 310 to release the tool 290 from latching engagement with the retainer ring 285, 286.

In order to mount a surface tool, generally designated 325, on the outer end of the drill stem rod 327 that extends above the surface from which the drilling operation is carried out, there is provided a mounting tube subassembly M (see FIGS. 41 and 42). The mounting tube subassembly includes a tube 326 that is threadedly connected to drill stem rod 327, a lock ring 328 being threaded on tube to abut against the drill stem rod. Diametrically opposed inner studs 330 and outer studs 329 are mounted in axial alignment on tube 326 to extend transversely outwardly of the tube for mounting the surface tool. The outer end of the tube 326 on diametrically opposite sides thereof has a pair of ears 327 for mounting a pivot 340 which mounts the inner end of a swing bolt 338 for pivotal movement between a position extending into the slot 346 of a plate 345 and a position out of the slot. A washer 342 and a wing nut 341 are threaded on a swing bolt to releasably retain plate 345 and the frustoconical plug 344 thereon in a position to close the axial outer end of tube 326. The plug is bolted to the plate by bolts 348. An inclined slot (not shown) opens to the plug axial aperture 351 and a slot (not shown) is provided in the plate to permit a wire line 352 being extended through the center portions of the plug and plate and at the same time prevent any substantial loss of fluid through the plug and plate when the wire line 352 is moved axially relative said plug and plate. A fluid inlet 349 is provided on a tube for being connected to a source of fluid under pressure (not shown).

The surface tool 325 includes a vertical channel subassembly (housing) V that is axially elongated and includes a rear plate 359 and opposite side plates 360 that are secured together to be open at the front. The front portions of the side plates are cut out to provide axially inwardly opening stud slots 362 and 363 for having the studs 329 and 330 extended therethrough to mount the subassembly V on the tube 326 such as shown in FIG. 42. With this type of mounting, the surface tool may be removed from tube 326 by being initially moving axially outwardly and then transversely away from the tube. Reinforcing gussets 361 are provided on the side walls adjacent the slots 362, 363.

A transverse plate 366 is secured to the outer ends of plate 359, 360 while the inner ends of rear plate 367 and side plates 368 are secured to the transverse plate. The plates 367, 368 are joined so that they are generally U-shaped in transverse cross section to provide a front opening. To the outer end of plates 367, 368 there is attached an end plate 369, the end plate 369 mounting a bearing mount 375 that in turn rotatably mounts the axial outer end of a screw shaft 376. The inner end portion of screw shaft 376 is rotatably mounted by a thrust bearing 377 that in turn extends through and is mounted by the transverse plate 366.

The reduced diameter inner end portion of the screw shaft has a pinion gear 378 fixed thereto in driven relationship to a bevel gear 379. The beveled gear is keyed to a transverse shaft 380 that extends through wall 359 and is rotatably mounted by a shaft mount 381 that is welded to said wall. A handle 382 is keyed to shaft 380 for manually rotating the shaft.

Referring now to FIGS. 41–45, a stationary clamp block subassembly J includes a clamp block 389 secured to mounting blocks 388 that in turn are bolted to side walls 360 and 368 by bolts 390. The clamp block has a front opening recess 391, the recess being defined by opposite walls 391*a*, 391*b* that diverge in an axial outward direction and walls 391*c*, and 391*d* that converge in an outward axial direction.

As may be noted in FIG. 44, walls 391*c*, 391*d*, extend primarily in a transverse direction while walls 391*a*, 391*b* extend predominently in an axial outward direction. The inner end of the recess opens through the transverse inner surface of the block 389 while the other end of the recess opens to a slot 392 that is generally U-shaped in transverse cross section and opens through both the transverse outer surface and the front surface of the clamp block.

A left hand front cover plate 393 and a right hand front cover plate 394 are bolted at 395 to the clamp block, the cover plates having diverging edges 393*a*, 394*a* that diverge at the same angles as walls 391*b*, 391*a*, but are substantially transversely more closely adjacent one another. Further, the cover plates have edges 393*c*, 394*c*, that coverge in an outward direction at the same angles as walls 391*c*, 391*d*, and are located at the same elevations.

Further, the cover plates have spaced axial edges 393*d*, 394*d* that are spaced the same as the transverse width of slot 392 to permit the wire line being moved into notch 392. A plate 396 is welded to the transverse inner edges of the cover plates and has a notch 396*a* that opens to the inner end of the recess 391 and is axially aligned with slot 392.

The stationary clamp block assembly J also includes a right hand lift lug RH and a left hand lift lug LH. The left hand lift lug includes a jaw portion 400 having a surface (edge) 400*a* transversely and axially outwardly inclined at an angle opposite that of a recess wall portion 391*b* but is of a substantially smaller axial length as may be seen in FIG. 45. Opposite edge 400*a*, the jaw portion has an axial planar surface 400*b* and an axial, semi-circular recess 401. Jointed to the jaw portion to extend outwardly between the cover plate edges 393*a*, 394*a* is a neck portion 407, the opposite end of the neck portion being joined to a transversely extending arm portion 408. The arm portion mounts a spring actuated plunger device 409 that resiliently urges its plunger member 409*a* into engagement with the cover plate 393. An aperture 410 is provided in the cover plate 393 for receiving the plunger member and thereby retaining the jaw portion in a wire line released position.

To mount the left-hand lug for movement in a direction parallel to that of wall 391*b*, there is provided a guide rod 403 that is extended through the jaw portion aperture 402, the inner end of the rod being mounted in the aperture 405 of plate 396 and the outer end of the rod being mounted in the aperture 406 of the block 389. A spring 404 is provided on the rod and has its inner end abutting against jaw portion 400 and its outer end abutting the shoulder 406*a* of the enlarged diametric part of aperture 406 to resiliently urge the jaw member in the direction of arrow 411 to its wire line clamping position that is shown in FIG. 44.

The right hand lift lug is of the same construction as the left hand lift lug other than being oppositely faced. That is the right hand lift lug includes a jaw portion 414 having a surface tapered at an angle opposite that of recess wall 391*a* to slideably abut thereagainst, a transversely opposite surface 414*b* that is planar to the surface 400*b* of the jaw portion 400 and contains a semi-circular recess 415 that opens to recess 401, a neck portion 419 that extends outwardly between the cover plate edges 393*a*, 394*a*, and an arm portion 420 joined to the neck portion to extend transversely away from the arm portion 408. Arm portion 420 mounts a spring actuated plunger device 409 that resiliently urges its plunger member into engagement with the cover plate 394, and when the plunger is extended into aperture 421 of cover plate 394, it retains the right hand lift lug in a wire line release position. The jaw portion 414 is mounted for slideable movement in a direction parallel to recess wall 391*a* by a guide rod 403 that has its inner end extended into aperture 417 of plate 396 and its outer end into block aperture 418. A spring 404 is provided on the rod to resiliently urge the right hand lift lug in the direction of arrow 422 to its wire line rod clamping position as shown in FIG. 44. When the right hand and left hand lift lugs are respectively moved in the direction opposite arrows 411, 422, their planar faces are moved apart, and when the lugs are moved in the opposite direction their planar faces are progressively more closely adjacent one another.

Referring to FIGS. 41, 42 and 46, the movable clamp subassembly K includes a left hand lift lug 429, a right hand lift lug 430, and a clamp block 431 having a clamp recess 432, left and right hand cover plates 433 and 434 respectively that have cover apertures 435 to receive the plungers of spring actuated plunger devices 436 whereby the lugs 429 and 430 are releasably retained in a wire line nonclamping position. Since members 429–436 are of the same construction, including size and shape and are in the same relationship to one another as described with reference to the corresponding elements of the stationary clamp assembly J, they will not be further described.

Welded to the rear of clamp block 431 (transversely opposite the side to which its recess 432 opens) is a nut 440 that has internal threads forming a mating fit with the screw shaft 376. To prevent the nut rotating with the shaft as it is rotated, stop plates 441 are welded to the clamp block to extend transversely outwardly from one another and abut against the front edge of the adjacent side plate 368. Accordingly, as the screw shaft is rotated, the nut, the clamp block 431 and the structure mounted thereon is moved axially, the direction of axial movement depending on the direction of rotation of the screw shaft.

Referring to FIGS. 1, 2 and 11, the maximum dimension A of the bit that is taken midway between the transverse opposite end of the planar surfaces 11 and 12 is about three-quarters of the outer diameter E of the cylindrical outer surface 15 of the bit. Further, the height (axial dimension) H in conjunction with the dimension A of the bit is such that when the bit is rotated about its central axis R—R approximately 90° and approximately 90° about a transverse axis that is parallel to axis Y—Y relative its position of use, the bit will pass through the adaptor ring 34 which has a minimum inner diameter N (see FIG. 8) and will pass through all portions of the drill stem thereabove. Axis Y—Y passes through the central axis R—R and transversely is midway between cylindrical surfaces 15.

For purposes of facilitating the description of the use of the invention, it will be assumed that the bit is locked in a position of use on the lower end of the drill stem (position shown in FIGS. 8, 9, 12 and 13). At this time, keys 47 extend into recesses, 24, 25 to retain the bit transversely between the planar faces of the drive lugs 36, 37 and the adapter ring orienting flanges 34*a* extend into the bit orienting recesses 23. Due to the relative dimensions of the parts, and in particular the axial height of the keys relative the recesses 24, 25, the driving force imparted to the bit is from the planar surfaces of the drive lugs to the planar surfaces of the bit and the axial inward force is transmitted from the inner transverse surface of the adapter ring between the orienting flanges to the planar surface 13 of the bit. In this connection, at the time the bit is cutting the core, the inner and outer transverse surfaces of the keys are axially spaced from the axially inner and outer transverse walls that in part define recesses 24, 25 whereby the cutting force is transmitted other than through the keys. At the time the lock keys are in their locking position, the dimple 52 of the detent spring 51 extends into groove 33 to prevent the locking sleeve rotating relative the shell tube 31 (FIG. 14).

When it is desired to remove the bit while retaining the drill stem in the drill hole, the drill stem is moved axially outwardly a short distance, and if core is being taken, the core barrel inner tube assembly is withdrawn. Thereafter, with the surface tool 325, plug 344 and plate 345 removed from the drill stem, and tube 326 mounted on the drill stem, the bit retraction tool 77 has a conventional wire line overshot assembly (not shown) coupled to the spear point plug 297 of the safety release device, with the wire line extended through plug 344 and plate 345 and the coupled overshot assembly, safety release assembly and retraction tool is lowered in the drill stem by use of conventional hoist mechanism. Plate 345 with plug 344 are secured to tube 326. At this time the plunger 101 is in the position relative the annular floater 90 shown in FIG. 12 whereby the recesses 102 are aligned with the cylindrical apertures 92 so that balls 103 either do not extend radially outwardly of the outer circumference of the annular floater or they freely move to a position inwardly of the outer circumferential surface of floater portion 90*b*. Further, due to the weight of the tool, the pin 271 abuts against the inner axial ends of slots 281 whereby the adjacent transverse annular surfaces of the axial outer lift tube 269 and the head tube 217 are substantially axially spaced from one another; the amount of axially spacing being limited by the set screws (cam pins) 252 abutting against the rounded shoulders formed at the intersection of cam track edges 242, 243 such as shown by the solid line positions P1 of the pins in FIG. 32. The above separation also results in pin 271 moving axially outwardly in slots 272 whereby stopper 274 is moved away from aperture 278.

As the retraction tool moves axially inwardly, the inner beveled surface of the cam tube 98 comes into abutting relationship with orienting pins 84 and moves the orienting pins radially outwardly. Further inward movement of the cam tube results in the cam tube moving to a position that the orienting pins are in radial alignment with the cam tube slots 175, and thereupon the orienting pins are resiliently urged into the cam tube slots. The amount of axial inward movement of the cam tube relative the outer tube before the pins 84 snap into the cam slots 175 depends upon the angular relationship of the cam tube relative to the stationary upper sleeve 70. Continued inward axial movement of the cam tube relative the orienting pins results in the cam tube being rotated in the direction of arrow 178 relative the drill stem, it being assumed that the oriented pins initially extended into the groove portions 175*c*. The inward movement of the cam tube with the orienting pins extending into grooves 175 results in the pins moving from groove portions 175*c* to groove portions 175*b* whereupon no further rotation of the cam tube relative the upper sleeve or drill stem takes place. Thus, due to the position of the orienting pins and the grooves 175, the cam tube is rotated so that balls 103 will be radially aligned with floater recesses 21 when the retraction tool has been moved sufficiently axially inwardly; and the locking pins 75, 76 will be angularly aligned to be moved radially between cam edges 60 and 73, and 64 and 74 (FIG. 16).

At the time the tool 77 has been lowered so that the shoulder 319 of the lift tube seats on the landing ring 317, the annular floater extends through the bit with the shoulder defined by floater portions 90*a*, 90*b* axially adjacent to outer bit surface 13, and the floater recesses 92 radially aligned with the bit recesses 21. The head tube shoulder 319 in seating on the landing ring provides a high pressure signal at the surface that indicates the tool 77 is in position to be latched to the drill stem. Due to the weight of the axial outer lift tube 269, the safety release tool and the overshot assembly; the lift tube moves axially inwardly relative the lift rod to abut against the head tube whereby pin 271 is located axially outwardly of the inner ends of slots 281 and stopper 273 is resiliently urged to block aperture 278.

With plug 344 and plate 345 in place about the wire line, fluid under pressure is pumped through inlet 319 to exert an inward force on the stopper and plug 270, which provide a piston surface. It is noted that if O-ring 256 is not presently in fluid sealing relationship with the head tube, there is a fluid seal between the head tube and piston tube that is provided by O-ring 219 and piston 218. The amount of fluid that can escape through apertures 229 prior to O-ring 256 moving into fluid sealing relationship with the head tube, if not in such relationship, is not sufficient to preclude the fluid under pressure acting against the stopper and plug to move the piston tube 223 and the axial outer sleeve 261 axially inwardly relative the lift rod and the head tube. An opening (not shown) is provided in tube 211 inwardly of retainer disk 213 to permit the escape of fluid from within the tube that is below the piston. The lift rod can not move axially inwardly with the piston tube since the drive slug 148 abuts against snap ring 150 (FIG. 7), and the axial movement of the piston tube from pin position P1 to pin position P2 is not sufficiently great that the thrust collar abuts against either of pins 267, 268.

Since the cam screws 252 are fixed to the head tube, as the piston tube 223 moves axially inwardly relative the head tube, the cam screws are moved in the cam tract T from the position P1 shown in FIG. 32 to abut against cam track edges 248 and thence edges 249 to a position P2 abutting against the rounded track portion 250. Due to the inclination of edges 248 and 249, this also results in the piston tube 223 rotating in the direction of the arrow 231 relative the head tube 217, the cam sleeve rotating with the piston tube due to pins 226 extending into grooves 232–34.

During the time the tool 77 was being lowered, the head tube apertures 229 were aligned with the cam sleeve recesses 227 so that the latch balls 230 extended thereinto. As the piston tube moved axially inwardly relative the head tube so that the pins 252 moved from position P1 to position P2, the cam sleeve was rotated so that the recesses 227 are moved out of radially alignment with head tube apertures 229. As a result, the latch balls 230 are forced to extend into the landing ring recess 318 to prevent axial movement of the head tube relative the drill stem (tool 77 being in a drill stem latched condition at this time). That is, when the piston tube is in position P1, the latch ball extending into cam sleeve recess 227*a* is at position P10, and when the piston tube is at pin position P2 the location of the latch ball relative the piston tube is indicated by position P20.

Now the safety release tool is moved axially outwardly, preferably by using the surface tool in the manner such as described hereinafter. The axial outward movement of the safety release tool results in the inner ends of slots 281 again moving to engage pin 271, and thence the resulting movement of the pin moves the stopper 273 away from plug 270. Pin 271 in engaging the outer ends of slots 272 moves the outer sleeve 261 outwardly and thereby the piston tube axially outwardly relative to pins 252. This movement of the piston tube results in pins 252 being relatively moved from their position P2 (FIG. 32) so that first edges 241 abuts against the pins 252 and thence edges 240 whereby the piston tube and cam sleeve are again rotated in the direction of arrow 231 relative the head tube. As the piston tube rotates from pin position P2 to pin position P3, the cam sleeve is rotated relative the latch balls and the piston tube moves relative the latch ball that was in recess 227*a* from position P20 to a position P30 that indicates the position of the latch ball relative the piston tube. At this time the latch balls are still out of radial alignment with cam sleeve recesses 227. Thus the latch balls are retained in their landing ring latching position.

At the time the cam screws have moved to the cam screw position P3, the ends of the cam screws that extended into cam track T are in direct axial alignment with cam grooves 232–234.

The continued axial outward movement of the piston tube moves the thrust collar 262 to abut against pin 268 and thereby move the lift rod 212 axially outwardly. The axial movement of the lift rod moves the outer lift tube 191 and thereby the axial outer ball nut 193 in the same direction. Since pin 196 that is mounted by the outer tube 197 extends into slot 195 of the transversely inner lift tube 191, tube 191 cannot rotate relative to tube 197 as it is moved axially relative thereto. Further, since the outer ball screw is prevented from moving axially relative the outer tube 197, the axial outward movement of the ball nut 193 drivingly rotates the outer ball screw. The rotary movement of the outer ball screw is transmitted through bearing shaft 167 to drivingly rotate the inner ball screw 164. Due to the threading of the inner ball screw being opposite of the outer ball screw, the rotation of the inner ball screw results in the inner ball nut 161 being moved axially inwardly. The threading on the ball screws is such that every rotation of the outer ball screw results in the outer ball nut being moved a greater axial distance than the inner ball nut.

Since the outer drive slug 148 mounts the locking pins 75, 76 to extend into the linear cam tube slot portions 176*c*, the cam tube cannot rotate relative the drive slug 148. Further, the orienting pins 84 now prevent the cam tube rotating relative the drill stem. As a result the cam tube cannot now rotate with the lower ball screw, and thus the drive slug 148 moves axially inwardly as the lower ball screw is rotated.

As the drive slug is moved axially inwardly by the inner ball nut relative the inner ball screw, the structure mounted in the cam tube from the ball nut axially inwardly is moved in the same axial direction. During the initial inward axial movement of the outer drive slug 148 relative the cam tube, the transfer pin 139 extends into the linear portion 180*a* of the transfer pin slot and the rotation pin 127 extends in the axial linear portion 181*a*, thus preventing pivot rod 118 and the actuating rod 131 from rotating relative one another and relative the cam tube as they move axially relative the cam tube. As a result the plunger 101 is translatory moved axially inwardly relative the floater to move the plunger recesses 102 out of radial alignment with the floater apertures 92. This forces the lock balls 103 to extend into the bit recesses 21 to prevent any substantial movement of the bit relative the floater. Since the bit is still lockingly retained on the reaming shell subassembly by keys 47, the floater at this time cannot move further inwardly as the drive slug 148 is continually moved inwardly, and accordingly the continued inward movement of the spring cap 126 compresses spring 130.

After the floater plunger 101 is moved relative the floater to force the lock balls out of the plunger recesses, the plunger 101 has been moved axially inwardly sufficiently relative to the floater so that the plunger 104 is radially aligned with floater recess 96. At the time the lock keys are moved to their unlocked position, springs 110 resiliently retain the floater wall 97 in abutting relationship to the plunger 101.

After the bit has been latchingly engaged to the floater by the lock balls, but prior to the inward movement of the drive slug 148 being blocked by abutting against shaft 129 or the spring cap abutting against washer 132, the lock keys have been moved out of the bit lock key recesses 24, 25.

The above mentioned movement of the lock key takes place due to the locking pins 75 and 76 in moving axially in locking pin slots 176 are moved to bring their transverse outer annular flanges (flange 75*b* for pin 75) into abutting relationship with the downwardly and transversely outwardly inclined surfaces 177*d* of cam portions 177. This cams the pin radially outwardly to position P70 of FIG. 18 such that as said flanges ride over the axial surface 177 of the cams 177, the pin 75 is extended between edges 60 and 73 of the locking sleeve 44 and the stationary sleeve 70, respectively (see FIG. 16), and pin 76 extends between edges 64 and 74. Now, as the inward movement of the pins continues with the drive slug 148, first pin 76 moves axially inwardly of the inclined edge 65 and thereafter pin 75 moves into abutting relationship to the inclined edge of the locking sleeve. Since the stationary sleeve is pinned to the reaming shell tube 31, the locking sleeve 44 is forced to rotate in the direction of the arrows 53 (for example, angularly about 10°). This rotation of the locking sleeve rotates the lock keys in the same direction to move the lock keys out of the bit recesses 24, 25 whereby the bit is free to move axially with the floater. After pin 75 has moved axially inwardly of edge 61, the transverse outer flanges of the locking pins move into engagement with the axial and transverse inward surfaces 177*c* of the cam plates whereby the locking pins are resiliently retracted from between the edges of sleeves 44, 70.

Upon the lock keys being moved out of the bit recesses, the bit and floater can move axially relative the cam tube and the above mentioned compression of spring 130 results in the pivot member 118, the floater and the bit moving axially inwardly relative drive slug 148; but plunger 101 does not move relative the floater, initially since springs 110 resiliently retain the plunger in abutting relationship to floater wall 97, and after the floater has moved to locate its recess 96 inwardly of finger 99, the plunger 104 extends into the recess 96 to prevent plunger 101 and the floater moving relative one another. Thence further inward movement of the drive slug also moves the floater and bit axially inwardly.

After the bit is freed to move axially with the floater, and the outer drive slug 148 has been moved sufficiently axially inwardly that the transverse inner surface of the bit is adjacent or axially inwardly of the transverse inner surfaces of the drive lugs, the transfer pin 139 moves to the inner end of the axial slot portion 180*a* and the latch disk 123 is moved axially adjacent slot portion 182. As a result the actuating rod 131 cannot move inwardly with the inward movement of the outer drive lug 148 and pivot member 118, slightly further inward movement of the pivot rod 118 forcing the latch disk 123 out of the pivot rod recess 124 and into cam tube slot 182*a*.

After the bit has been moved axially so that it no longer extends transversely between the drive lugs, and pin 139 abuts against the inner end of slot portion 180*a*, further axial movement of the drive slug 148 does not move pivot member 134 axially, however, it does continue the axial inward movement of pivot member 118. This results in pivot member 136 being pivoted in the direction of the arrow 423 about the pivot axis of pivot member 115 whereby the annular floater and the bit that is locked thereto is pivoted about the axis of pivot member 115 which extends transversely. It is to be noted that bit axis Y—Y is parallel to the pivot axis of pivot 115. As the bit is pivoted about the axis of pivot 115, it continues to be moved axially inwardly.

After the bit has been rotated about the axis of pivot 115 and moved axially inwardly sufficiently that the arcuate edge of the bit transversely opposite pivot member 115 will clear the drill hole cylindrical walls, the reaming shell and its drive lugs, the rotation pin is at the inner end of the cam tube slot portion 181*a* and in position to move into the circumferentially and axially inwardly inclined slot portion 181*b*. Now, as the drive slug 148 continues to move axially inwardly, the floater is continued to be pivot about the axis 115, an at the same time due to the rotation pin moving in slot portion 181*b*, the pivot rod 118 is forced to rotate about the central axis of the cam tube and drill stem, and accordingly the bit is also rotated about said central axis. As the pivot rod is rotated about the drill stem central axis, the transfer pin 139 moves in the slot portion 180*b* in the direction circumferentially away from slot portion 180*a* while the latch disk is moved relative the cam tube and slot portion 182*a* towards slot portion 182*b*. When the rotation pin has moved in slot portion 181*b* of the camming tube to be axially aligned with slot portion 181*c*, the lateral rotation of the bit (about pivot axis 115) and the axial rotation of the bit (about the central axis of the drill stem) has been completed. The rotation pin moves into the inner end of slot 181*c*, the transfer pin 139 being adjacent the end of slot portion 180*b* that is remote from the slot portion 180*a* and the latch disk 123 being adjacent but spaced from slot portion 182*b*. This prevents any further rotation of the pivot member 118 in the direction opposite arrow 178 relative the cam tube and axial inward movement of the pivot member relative the cam tube. It is noted that slot portion 182*b* is provided to facilitate assembly of parts and that during operation of the tool, disk 123 is not moved over to slot portion 182*b*.

Not previously mentioned is that during the time the pivot rod was rotating relative the cam tube, the arcuate slot 122 was adjacent the finger 99. Thus, even though the pivot rod surface 118*b* extends transversely inwardly of the finger, the finger does not prevent rotation of the pivot member 118 in the above discussed manner. The drive slug 148 is moved slightly further axially inwardly, this resulting in spring 130 being compressed in a manner previously indicated. Prior to the time shaft 129 can abut against drill slug 148, the latching of tool 77 to the drill stem is released as will be set forth.

After the lateral and axial rotation of the bit has been completed, the axial inner and outer, general planar surfaces 13 and 14 of the bit extend generally parallel to the central axis of the drill stem with surface 13 transversely more remote from the central axis than surface 14; and the bit axis Y—Y is generally parallel to the drive lug planar surfaces 36*a*, 37*a*. Thus other than being axially inwardly of the drive lugs, bit surfaces 13, 14 are generally parallel to lug surfaces 36*a*, 37*a* and bit surfaces 11, 12 are generally perpendicular to lug surfaces 36*a*, 37*a*. Now the bit is in a position that it can be retracted through the drill stem.

Prior to the time the last mentioned inward movement of the pivot rod 118 relative the cam tube 98 has been completed, the piston tube 218 has been moved axially outwardly relative the cam sleeve 224 and head tube 217 so that pins 226 are located closely adjacent and just axially outwardly of the cam groove portions 223*b* (FIG. 32). A continuing application of axial outward force on the safety release tube moves the piston tube relative pins 226 so that the pins pass through slot portions 223*b*, this rotating the cam sleeve in the direction of the arrow 231 relative the piston tube. This last rotation of the cam sleeve results in it moving relative to the latch balls to a position the latch balls 230 are radially aligned with recesses 228 to move there into and out of latching engagement with the landing ring. When the cam sleeve has moved to a position that the latch balls are radially aligned with recesses 228, the position of the ball that was in recess 227*a* relative the piston tube is indicated by P40, this ball now being radially aligned with recess 228*a*. Slightly further outward movement of the safety release tool results in the piston tube being moved adjacent the inner ends of cam groove positions 223*c* but slightly spaced therefrom, and the piston 218 moved into abutting relationship to the inner end of cam sleeve 224. This last mentioned movement of the piston tube occurs while spring 130 is being compressed, pin 139 now preventing further inward movement of pivot member 118. Since the cam sleeve 224 is retained in a fixed axial position in the head tube and the piston now abuts against the sleeve, further axial outward movement of the safety release tool retracts the retraction tool 77 and the bit attached thereto through the drill stem.

The bit installation tool, generally designated 450, is of a construction that is the same as tool 77 other than the threading on the lower ball screw shaft is just opposite that of the lower ball screw shaft for the tool 77. In installing a bit, the installation tool has the cam tube, pivot rod, actuating rod, latch disk, floater, and floater plunger in the same relative positions described with reference to the corresponding members of the bit removal tool at the time the rotation of the bit about the axis of pivot 115 and central axis of the drill stem have been completed. Thus the latch disk is in slot portion 182*a* adjacent to 182*b* (but does not extend thereinto), the rotation pin in slot portion 181*c*, the transfer pin in the end of slot portion 180*b* remote from slot portion 180*a*, the locking pins 75 and 76 in the axial inner end portion 176*b* of slots 176, plunger 104 extends into recess 96, and the plunger recesses 102 are axially inwardly of the floater apertures 92 whereby balls 103 are retained extended into bit recesses 21 to lock the bit to the floater. Further the lower ball nut is at the inner axial end of the lower ball shaft. However, the relative positions of the portions of the bit installation tool above the inner (lower) ball screw is the same as that described for the bit removal tool, including the outer ball nut 193 being at the axial inner end of the ball screw 192 as shown in FIG. 7. As the bit installation tool is lower in the drill stem, the orienting pins 84 move into slots 175 and the cam tube rotates to be in proper angular relationship to the outer barrel assembly 30 as described with reference to the bit removal tool.

After the bit installation tool has been lowered in the drill stem so that its head tube shoulder 319 seats on the landing ring, first fluid under pressure is applied in the drill stem to move the piston tube inwardly and rotate the cam sleeve 224 so that the latch balls 230 are moved to a landing ring latching position in the manner indicated for tool 77. At this time the bit on the installation tool is located axially inwardly of the drive lugs with bit faces 13 and 14 parallel to the central axis of the drill stem and axially inwardly of and generally parallel to the planar faces 36*a* and 37*a*, respectively of the drive lugs and bit surfaces 11, 12 are generally perpendicular to faces 36*a*, 37*a*; and bit axis Y—Y is generally parallel to drive lug surfaces 36*a*, 37*a*. Additionally, at this time the lock keys are in their unlocking position.

After the bit installation tool is latched into position and the safety release tool is pulled axially outwardly to move the lift rod 212 in same direction, the upper ball nut is moved axially outwardly to rotate the outer (upper) ball screw and therethrough the inner (lower) ball screw in the direction to move the inner (lower) ball nut axially outwardly. As the rotational pin moves from slot portion 181*c* into slot portion 181*b*, the pivot rod rotates relative the cam tube and moves axially inwardly whereby the drill bit is pivoted about both the central axis of the drill stem and about pivot 115 in the direction opposite arrow 423. After the rotational pin moves out of slot portion 181*b* into slot portion 181*a*, the drill bit has been rotated about the drill stem control axis sufficiently that the planar faces of the bit are located between inwardly extensions of the planar faces of the drive lugs (axis Y—Y generally perpendicular to the drive lug planar faces). Further axial outward movement of the drive slug 148 results in the rotation pin being moved into slotted portion 181*a* and to the outer end of slot 138 whereupon the actuating rod 131 commences moving axially with the pivot rod 118. This movement of rod 131 moves the latch disk out of slot 182 and into recess 124 of the pivot rod so that the actuating rod moves axially with the pivot rod. At the time the rotation pin moves into slot portion 181*a*, transfer pin 139 has been moved into slot portion 180*a*.

At the time the latch disk moves into recess 124, the floater has been pivoted about pivot axis 115 to a position that the plane of the central axis of pivot members 136, 115 is perpendicular to the central axis of the drill stem. Further axial movement of the drive slug 148 results in the floater being translated axially outwardly with the orienting recesses 23 of the bit axially aligned with the adapter flanges. Due to the bevel inner surfaces of the recesses 23 and the orienting flange 34*a*, as the bit is moved axially outwardly, it is centered relative the central axis of axis of the drill stem. At this time the floater has been moved to a position that the plunger 104 is closely adjacent the finger 99, further inward axial movement of the floater resulting in the finger camming the plunger 104 out of the recess 96.

After the bit has been moved to a position that the lock recesses 24, 26 are radially opposite the lock keys, the locking pins 75, 76 have been moved outwardly in slots 176 to positions to engage cam portions 177. As the transverse outward flanges (75*b* for pin 75) of the locking pins move along cam surfaces 177*c*, to position P71, the pins moves radially away from one another to a position that pin 75 extends between edges 73 and 62 of sleeves 70, 44; and pin 76 extending between edges 74, 66. The axial outward movement of the pins with the drive slug moves pin 75 outwardly of edge 61 and then pin 76 is moved into abutting engagement with edge 65. Further axial outward movement of pin 76 results in the locking sleeve being rotated in the direction of the arrow 54 and thereby the locking keys into the bit locking recesses 23, 24. Now the pins ride over the cam surfaces 177d and resiliently move radially inwardly of sleeves 44, 70. As the locking sleeve was rotated, the dimple 52 of detent spring 51 was moved out of groove 32 and into groove 33 of the shell tube 31.

After the locking keys have been moved into the bit recesses, the bit is in abutting relationship with the adapter ring and can no longer move axially inwardly with the floater since the lock balls 103 are still extending into the bit recesses 21 the floater remains stationary. However, the continued axial outward movement of the drive slug 148 results in the plunger 101 moving outwardly relative to the floater to a position that plunger recesses 102 are radially aligned with floater aperture 92. Now the balls 103 are cammed into recesses 102 and thence the floater moves axially with the plunger 101. The recesses 102 are axially elongated to permit limited movement of the plunger 101 relative the floater after the lock keys move into bit recesses and prior to latch balls 230 being to their release position.

While recesses 102 are moving into radial alignment with recesses 21, can slots 232–234 of the piston tube move relative pins 226 so that the pins move through slot portions 223*b* to rotate the cam sleeve relative the head tube to a position the cam sleeve recesses 228 are radially aligned with the latch balls 230. This results in the installation tool being released from latching engagement with the drill stem; and accordingly, further axial outward movement of the safety release tool withdraws the installation tool through the drill stem. After the tools and tube 326 have been removed from the drill stem, the core drilling operation may be continued until it is time to replace another bit.

Even though an overshot can be coupled directly to the respective one of the bit installation and removal tools, it is preferred that the overshot is coupled to the safety release tool described which in turn is coupled to the respective installation and removal tool.

If it were not for the provision of the safety release tool and the respective one of the bit installation tool and bit removal tool should become lodged in the drill stem and an overly great pulling force were exerted thereon, the respective removal or installation tool could be damaged. However, due to the provision of the safety release tool, exerting a greater than a predetermined pulling force on the tool, will result in the latching engagement between the safety release tool and the respective installation or removal tool being released. That is, the adjustment member 293 is threaded into the compression spring cylinder 292 a distance that more than a predetermined amount of force is required to compress the spring 294 sufficiently to allow rollers 315 to roll axial outwardly into alignment with shoulders 311. When rollers 315 are axially aligned with shoulders 311 the latches can pivot in the direction of arrow 310 to release the latching engagement with the retaining ring 285, 286. Now the safety release tool may be withdrawn while the respective one of the bit installation tool and bit removal tool remains in the drill stem.

After the safety release tool has been removed, the drill stem may be moved to see if such dislodges the respective one of tools 77, 450; and/or fluid under pressure may be pumped into the drill stem. In the event the lift rod has been moved axially relative the head tube prior to the safety release releasing from the respective bit replacement tool, fluid under pressure can exert a force on the piston surfaces of the tool to move the piston tube axially inwardly relative the head tube and upon thrust collar abutting against pin 267 move the lift rod axially inwardly to recock the replacement tool, and thereafter the safety release tool lowered to again latchingly engage the tool retaining rings 285, 286. Now another attempt may be made to withdraw the replacement tool, it being understood the replacement tool may be lodged such that it cannot be recocked or cannot be withdrawn through the drill stem through use of the safety release tool.

To recock the bit removal tool after it has been removed from the drill stem, the outer lift tube 269 is moved axially relative the axial outer sleeve 261 to a position that pin 272 is circumferentially aligned relative slots positions 282. Now the lift tube 269 is rotated relative sleeve 261 to a position pin 271 is located in slot portions 282 and then the lift tube moved axially inwardly relative the head tube. Further inward movement of the lift tube moves the sleeve relative to the lift rod so that spring 264 is compressed sufficiently (or the thrust collar 262 abuts against pin 267) to move the lift rod inwardly, the lift rod moving inwardly results in the ball nuts moving on the ball screws and the floater and other structure mounted for movement relative the cam tube moving to relative the positions shown in FIGS. 5–8 for the removal tool whereby the bit may be slipped off the floater. The above movement also results in the piston tube moving axially relative the pins 252 whereby the piston tube is rotated to radially align the cam sleeve recesses 227 with the latch ball apertures 229. Thus the removal tube is recocked for use.

An analogous procedure is used for recocking the bit installation tool after it has been removed from the drill stem. Advantageously another bit is slipped on the floater of the bit installation tool after it has been removed from the drill stem and prior to recocking.

One way of adjusting retraction tool to properly sequence to relative movement of parts is to first adjust the threading of the head tube in tube 211 so that the tool is of a proper length relative the outer barrel assembly 30 with which it is to be used. Thereafter, with the locking sleeve 258 loosen and pins 252 abutting against either of cam track shoulders 250, 253, the adjustment sleeve 257 is threaded in the piston tube until pin 267 abuts against collar 262 and then is backed off about a quarter of a turn, and then the locking sleeve is tighten. Upon being properly adjusted the piston tube can be moved axially between a position that pins 252 abut against the shoulders defined by edges 242, 243 of the cam track and shoulders 253 without moving the lift rod. When the lift rod is in its axial inner position, drive slug 148 abuts against snap ring 150 whereby the lift rod inward movement is limited while the lift rod outward movement is limited by piston 218 abutting against cam sleeve 224.

As to the installation tool the above mentioned length adjustment is made. With the lift rod in its axial outer position, sleeve 257 and the piston tube are relatively threadedly adjusted so that pin 268 is abutting against collar 268 and the piston 218 abuts against the cam sleeve. When the installation tool is properly adjusted and the lift rod is in its axial inner position, drive slug 148 abuts against washer 132.

In both of the removal and installation tools spring 264 cushions movement of the piston tube relative the lift rod during a lowering operation so that the lift rod does not move the structure in the cam tube through a cycle of operation; for example relative movement resulting from the tool temporarily hanging up in the drill stem.

The threaded adjustment of the sleeve 257 relative the piston tube can be made by first removing the pin 271 and the lift tube 269 to expose the sleeve 257 and the piston tube, or with pin 271 left in place and tube 269 axially spaced from the head tube, tube 261 can be unthreaded from sleeve 257 and thence removed to expose sleeve 257.

Referring now to FIGS. 41–45, the manner of using the surface tool 325 will now be set forth. After the bit installation tool has been lowered in the drill stem to a position the latch balls are radially opposite the latch ring and pressure exerted so that the latch balls are cammed into latching engagement with the landing ring, the surface tool is mounted on the mounting tube subassembly M in a manner previously described. At the time or after the surface tool is mounted on the mounting tube subassembly, the spring actuated plunger devices 409 and 436 are moved to positions that their plungers extend into the respective one of cover plate apertures 410, 435 whereby the left hand and right hand lift lugs of the respective subassembly are retained transversely spaced in their wire line release (nonclamping) position. Further, at this time it will be assumed that the nut 440 is in a position closely adjacent the transverse plate 366. With the surface tool thus mounted on the mounting tube subassembly, the wire line extends through the lug recesses 401, 415. Now the plungers of the spring actuated plunger devices 436 are moved out of the cover apertures 435 and the lugs are moved axially toward the drill stem so that the walls defining the wire line recess portions 401, 415 of lugs 429, 430 abut against the wire line. Upon rotating the handle 382 in the appropriate direction, the screw shaft 376 is rotated to move the nut 440 axially away from the drill stem, stops 441 abutting against side walls 368 preventing the nut rotating with the shaft. Once the nut has moved to the opposite end of the screw shaft and it is desired to use a surface tool to continue to move the line in the same direction, the spring actuated plunger devices 409 may be operated to remove the plungers from apertures 410 and the lugs of the stationary clamp assembly move to their wire line clamping position. Now the handle 382 may be rotated in the opposite direction to allow slack in the wire line intermediate the movable and stationary clamps K and J and thence the spring actuated plunger devices 436 moved to retain the right and left hand lugs of the movable clamp in their wire line released position. Then the handle 382 is rotated to move the movable clamp assembly closely adjacent the stationary clamp assembly, and thereafter the right and left hand lugs of movable clamp assembly again move to a wire line clamping position. Upon rotating the handle to move the nut 440 a slight distance above plate 366, the downward pull of the wire line on the stationary right and left hand lugs is removed and the lugs may be moved to their wire line released position. This operation may be repeated a number of times if desired for removing the wire line a limited distance. Further, with the nut 440 remote from the plate 366 and the lugs of the movable clamp assembly in clamping engagement with the wire line, and lugs of the stationary clamp assembly out of clamping relationship with the wire line, the handle 382 may be rotated in the direction to move the nut toward plate 366 and thereby allow the weight on the inner end of the wire line to move the wire line downwardly in the drill stem. Thus the surface tool may be used to move the wire line in an axial outward direction, or control the rate of movement of the wire line in an axial inward direction. By using the surface tool the operator has a greater feel of what is happening at the axial inner end of the drill hole.

When the wire line is being retracted and after it is extended between the jaw members, the jaw members of the stationary clamp assembly do not have to be manually moved to their release position after the first time since the wire line in being retracted by the movable clamp assembly will move the jaws member of the stationary clamp assembly sufficiently relative the clamp block to permit the wire line moving therethrough. Likewise when the wire line is clampingly held by the stationary clamp assembly and the movable clamp assembly is remote from the stationary clamp assembly, the wire line may be held on the opposite side of the movable clamp assembly from the stationary clamp assembly and upon moving the movable clamp assembly toward the stationary clamp assembly, the jaw members of the movable clamp assembly will be moved relative their clamp block sufficiently by moving along the wire line that the jaw members do not have to be manually moved to their release position, i.e. the plunger devices do not have to be operated after the first time they are moved out of the cover plate apertures 435.

To be mentioned is that the surface tool can be used with wire line equipment other than with the bit removal and installation tools herein described. Also even though it is advantageous to use the surface removal tool, other conventional equipment can be used for moving the wire line to operate the installation and removal tools described herein.

In the event the safety release tool is not to be used in combination with the bit replacement tool, in place of slot 287, snap ring 284 and retainer rings 285,286, the axial outer end portion of the lift tube 269 can be provided with an overshot coupling head portion, for example a spear point (not shown), that extends into the lift tube axial outer end and is secured thereto by a pin (not shown) whereby the head portion axial inner transverse surface is located at least as far axially outwardly of slots 281 as wall portion 302*e*.

In using a conventional wire line core barrel inner tube assembly (not shown), for example the first embodiment of U.S. Pat. No. 3,333,647 or U.S. Pat. No. 3,103,981, the drill string is provided with a latch recess shoulder (not shown) axially outwardly of the landing ring 317 to be latchingly engaged by the inner tube assembly latches while the annular shoulder of the latch body seats on the axial outer transverse surface of landing ring 317 and the core lifter is retained slightly spaced from the bit 10 to have core cut by the bit move into the core lifter. Since the orienting pins 84 are resiliently mounted, they are moved radially outwardly by the core barrel inner tube (core lifter case) moving axially inwardly to a core receiving position adjacent the bit.

Even though the bit has been described as having frustoconical surface portions, it is to be understood that surfaces 16 may be of a cylindrical shape between surfaces 11 and 12 and of diameters the same as or substantially the same as the diameters of surfaces 15.

Alternately, surface portions 16 may be of a stepped configuration, for example cylindrical arcuate surface portions that are of progressively smaller outer radii of curvature in an axially inner direction.

What is claimed is:

1. A drill bit having a central axial axis, an inner peripheral wall defining a central bore extending axially therethrough, an axially inner transverse surface, an axially outer transverse surface, a transversely outer, axially extending first side surface, a transversely outer, axially extending second side surface diametrically opposite the first side surface, each side surface having first and second axially extending edges, an outer peripheral, generally circular surface portion extending between the first side surface first edge and the second side surface second edge, an outer peripheral, generally circular surface portion extending between the first side surface second edge and the second side surface first edge, the minimum diametric spacing between the first and second side surfaces being substantially less than the diametric spacing of the outer peripheral circular surface portions, wall portions defining a plurality of circumferential spaced detent recesses opening transversely to said bore and means defining transversely opening lock portion receiving recesses that are adapted to receive a drill string outer barrel lock member portions.

2. The bit of claim 1 further characterized in that first and second side surfaces are generally planar.

3. The bit of claim 1 further characterized in that each of the side surfaces is generally planar and extends through an angle of at least about 60° relative the central axis.

4. A drill stem transverse outer barrel assembly comprising an outer barrel having a central axis, an axial outer end, an axial inner end, and an inner peripheral wall, a drill bit drive lug mounted on the outer barrel inner end to extend axially inwardly thereof, a locking sleeve rotatably mounted in the outer barrel and having an axial outer end portion and an axial inner end portion adjacent the outer barrel inner end, said locking sleeve inner end portion having a drill bit engagable locking portion, said outer barrel and locking sleeve having cooperating means for selectively retaining the locking sleeve in a drill bit engagable locking portion locked position relative the outer barrel and a drill bit engagable locking portion unlocked position angularly spaced from the locked position.

5. The outer barrel assembly of claim 4 further characterized in that the cooperating means comprises outer barrel wall portions defining a pair of circumferential spaced grooves opening toward the central axis and a locking sleeve spring member having an end portion urged toward the outer barrel peripheral wall, the spring member end portion having a detent extending radially outward of the central axis for extension into the adjacent one of the grooves.

6. The outer barrel assembly of claim 4 further characterized in that the locking sleeve outer end portion has an axially extending cam edge.

7. The outer barrel assembly of claim 4 further characterized in that the locking sleeve inner end portion has an axial inner end and that the drill bit engagable portion comprises a first locking key and there is provided a second drive lug that is mounted on the outer barrel inner end to extend axially inwardly thereof and circumferentially spaced from the first drive lug and a second locking key mounted on the locking sleeve inner end.

8. The outer barrel assembly of claim 7 further characterized in that each drive lug has a lock key recess opening toward the central axis and axially toward the outer barrel, the locking keys being retractable into the lock key recesses in their unlocked position and extending transversely outwardly of the recesses in a locked position.

9. The outer barrel assembly of claim 8 further characterized in that the drive lugs have drive surfaces, the recesses opening transversely to the drive surfaces.

10. The outer barrel assembly of claim 4 further characterized in that there is provided a stationary sleeve mounted in the outer barrel and having an axial inner end adjacent the locking outer end, a drill bit replacement tool orienting pin and spring means for mounting the orienting pin on the stationary sleeve and resiliently urge the pin toward the central axis.

11. The outer barrel assembly of claim 4 in that there is provided means on the outer barrel for retaining the locking sleeve in a substantially fixed axial position relative the outer barrel.

12. The outer barrel assembly of claim 11 further characterized in that the last mentioned means comprises a stationary sleeve mounted in the outer barrel that has an axial inner end adjacent the locking sleeve outer end portion.

13. Drilling apparatus comprising a drill bit and a drill string transverse outer barrel assembly that includes an axially elongated transverse outer tube having a circular outer peripheral surface, an axial inner end portion, operable first means rotatably mounted by the outer tube that is rotatable operable between a drill bit release position and a drill bit locking position for supportingly holding the drill bit, and second means mounted by outer tube inner end portion for drivingly engaging the drill bit, the drill bit being of a size to move through the outer tube and having a central axis, a circumferential outer peripheral surface portion of a radius of curvature emanating from the bit central axis that is about the same as the radius of curvature of outer tube peripheral surface, a surface for being driveningly engaged by the second means, and third means for lockingly receiving the first means in its bit locking position.

14. A drill stem surface tool for controlling the movement of an axially elongated wire line comprising an axially elongated tool housing having an axial inner end, an axial outer end and means for mountingly engaging a drill stem, a first clamp subassembly mounted on the housing for releasably clampingly engaging a wire line, a second clamp subassembly mounted on the housing for releasably clampingly engaging a wire line in axial spaced relationship to the first clamp subassembly and manually operated means mounted by the housing for mounting the second clamp subassembly and selectively moving the second clamp subassembly axially toward and away from the first clamp subassembly.

15. The tool of claim 14 further characterized in that the manually operated means includes an axially threaded shaft mounted in a fixed axial position by the tool housing for rotatable movement and means for rotating the shaft, the second clamp subassembly including a clamp block means mounted by the clamp block to block rotation of the clamp block relative said housing, and means mounted by the clamp block for axially moving the clamp block as the shaft is rotated.

16. A safety release tool for couplingly engaging a drilling tool comprising detent means for couplingly engaging a drilling tool, a detent mounting member for mounting the detent means for movement between a drilling tool coupled position and a release position, the mounting member having an axial outer end, an axial inner end portion, and an axially extending bore opening to the detent means, plunger means mounted by the mounting member for movement in said bore between an axial inner position for retaining the detent means in its coupled position and an axial outer position permitting the detent means moving to its release position, said plunger means having an axial outer overshot coupling portion, a plunger member joined to the head portion to extend axially inwardly thereof and mounted by the mounting member for movement between an axial outer position and an axial inner position, and means movably retained between the plunger member and the detent means for retaining the detent means in the drilling tool coupled position when the plunger member is in its axial inner position and moving relative to the detent means as the plunger member is moved to its axial position to permit the detent means moving to the release position, and resilient means acting between the plunger means and the mounting member for resiliently urging the plunger means axially inwardly.

17. The safety release tool of claim 16 further characterized in that the plunger means includes an abutment member, and that the mounting member includes an axially elongated annular portion mounting the detent means, the resilient means having one end abutting against the abutment member and an opposite end, and an adjustment member threadedly mounted on the annular portion in abutting relationship to the resilient means opposite end for selectively varying the force that has to be exerted on the overshot coupling portion to move the plunger member sufficiently axially outwardly to permit the detent means moving to the release position.

18. The safety release tool of claim 16 further characterized in that the detent means comprises a latch having a transversely outwardly, axially outwardly facing shoulder for latchingly engaging a drilling tool in the detent means coupled position and a latch portion defining a transversely inwardly, axially outwardly facing shoulder, the plunger means having a wall portion defining a groove, the latch portion extending into said groove.

19. The safety release tool of claim 18 further characterized in that the groove is axially elongated, the wall portion defining the plunger means groove including a transverse wall portion defining the axial outer end of the groove and that the means movably retained between the plunger member and the detent means includes a roller in the groove that bears against the transverse wall portion and the transverse inner shoulder when the plunger means is in the detent means coupled position.

20. The safety release tool of claim 19 further characterized in that the mounting member has a wall portion defining the transverse inner end of said bore, and that the plunger means has an axial inner surface abuttable against the last mentioned wall portion to limit the axial inward movement of the plunger means relative the mounting member.

21. The safety release tool of claim 19 further characterized in that the latch has a second shoulder axially outwardly of the first mentioned shoulder that cooperated with the plunger member for retaining roller when the plunger member has been moved axially outwardly to permit the detent means moving to a release position, and an axially linear surface portion between said shoulders.

22. A safety release tool for couplingly engaging a drilling tool comprising detent means for couplingly engaging a drilling tool, an annular detent means mounting member having an inner peripheral wall portion, an axial inner end and an axial outer end, and mounting the detent means for movement between a drilling tool coupled position and a release position, a wall portion joined to mounting member inner end axially inwardly of the detent means, plunger means extending within the mounting member and movable between an axial inward position abutting against said wall portion to retain the detent means in a drilling tool coupled position and an axial outward position permitting the detent means moving to the release position, and resilient means acting between the mounting member and the plunger means for constantly urging the plunger means to its axial inner position, the plunger means having an axial outer overshot couplingly engagable portion.

23. An annular drill bit replacement tool comprising a head tube having a central axis, detent first means mounted by the head tube for movement between a drill stem latch seat engaging position and a release position, operative second means on the head tube for moving the detent means between the detent means release and latch seat engaging positions, operative third means having a central axis for releasably mounting an annular drill bit and being operative between an annular drill bit locking position and a drill bit release position, operative fourth means connected to the drill bit mounting means for rotating it about its central axis and an axis generally perpendicular thereto, moving the drill bit mounting means in the general direction of the extension of the head tube central axis, and when the drill bit is locked against axial movement along the head tube central axis, operate the third means between its locking and release positions, and fifth means mounted by the head tube for movement relative thereto for operating the detent operative means between its positions and the fourth means to move the third means between its positions.

24. The tool of claim 23 further characterized in that drill bit mounting means comprises a drill bit mounting member, drill bit detents mounted by the drill bit mounting member for movement between a drill bit locking position and a drill bit release position, sixth means mounted by the drill bit mounting member for movement relative thereto for moving the drill bit detents between their positions and seventh means for movably connecting the drill bit detent moving means to the fourth means.

25. The tool of claim 24 further characterized in that the fourth means comprises a cam tube having an axial inner end portion and an axial outer end portion, eighth means for mounting the cam tube axial outer end portion to the head tube to extend axially relative thereto, drive slug ninth means mounted in the cam tube for rotatable and axial movement relative thereto for moving the drill bit mounting means axially and rotating it about its central axis and said axis that extends perpendicular thereto, said cam tube and drive slug means having cooperating means for rotating the drive slug means during at least part of its axial movement in the cam tube, said drive slug means being connected to the fifth means for being moved thereby.

26. The tool of claim 25 further characterized in that the seventh means comprises first and second pivots that have spaced generally parallel pivot axes that extend generally perpendicular to drill bit mounting means central axis, that the drive slug means comprises a pivot member mounted in the cam tube for axial and pivotal movement relative thereto, said pivot member being connected to the first pivot, and actuating member mounted by the pivot member for axial movement relative thereto, linkage means connected to the second pivot and pivotally connected to the actuating member for pivoting the second pivot about the first pivot axis as the actuating member moves axially relative the pivot member and means for connecting the pivot member to the fifth means for being moved thereby and rotational movement relative thereto, said cooperating means including means to permit limited axial movement of the actuating member relative the pivot member whereby the drill bit mounting member is pivoted about the pivot axis of the first pivot.

27. The tool of claim 25 further characterized in that cooperating means comprises a cam surface on the cam tube that in an axial direction toward the cam tube inner end initially extends predominately axially and thence extends both axially and angularly through a substantial angle, and a cam follower on the drive slug means for following the cam surface as the drive slug means moves axially relative the cam tube and rotate the drive slug means as the follower abuts against the surface that extends both axially and angularly.

28. The tool of claim 25 further characterized in that the cam tube has an axially elongated slot extending radially therethrough, and that the drive slug means includes a drive slug axially movable in the cam tube radially adjacent said slot, an outer barrel assembly locking sleeve operating stud mounted by the drive slug for radially movement between a retracted first position within the cam tube and a second position extending radially outwardly through the slot beyond the cam tube, and means on the cam tube for moving the stud from its first position to its second position as the drive slug moves axially in the cam tube and thence permitting the stud to move to its first position.

29. The tool of claim 28 further characterized in that the drive slug means includes resilient means for resiliently urging the stud to its first position and that the means for moving the stud comprises a cam portion on the cam tube for moving the stud from its first position to its second position when the drill bit mounting means central axis extends in substantially the same direction as the head tube central axis.

30. The tool of claim 25 further characterized in that the drive slug means includes a pivot member mounted in the cam tube for axial and rotational movement relative thereto and having an axial inner end portion and an axial outer end portion, means for connecting the inner end portion of the pivot member to the seventh means for moving the seventh means axially with the pivot member and pivot the seventh means about the generally perpendicular axis, a drive slug mounted in the cam tube for axial movement relative thereto, and means connecting the pivot member outer end portion to the drive slug for rotation about an axis that extends generally in the same direction as the head tube axis and resiliently urge the pivot member away from the drive slug to permit limited axial movement of the drive slug in the cam tube while the pivot member remains in a given axial position in the cam tube.

31. The tool of claim 30 further characterized in that the eighth means and the drive slug have cooperating means for retaining the drive slug in a fixed angular rotative position relative the cam tube as the drive slug moves axially in the cam tube.

32. The tool of claim 31 further characterized in that the fifth means includes a rotatable member having an axis of rotation that extends in generally the same direction as the head tube central axis, means connected between the rotatable member and the drive slug for moving the drive slug axially as the rotatable member is rotated, and operable means mounted by the head tube for movement relative thereto to rotate the rotatable member as it moves relative the head tube.

33. The tool of claim 23 further characterized in that the second means includes a cam member mounted by the head tube for rotation about the head tube central axis for moving the detent means from its release position to its latch seat engaging position, and that the fifth means includes coupling means mounted by the head tube for axial movement for rotating the cam member.

34. The tool of claim 33 further characterized in that the detent means comprises a latch ball, the head tube having a latch ball mounting aperture extending radially therethrough, and that the cam member has a recess for the ball to extend into in the release position and a radially outer surface portion for forcing the ball to the detent means latch seat engaging position.

35. The tool of claim 33 further characterized in that the cam member is a cam sleeve, and that the coupling means includes an axially elongated member axially moveably extended through the cam sleeve in fixed angular relationship thereto, the elongated member having a cam track and a cam follower mounted by the head tube and extended into the cam track for rotating the elongated member relative the head tube during axial movement of the elongated member relative the head tube.

36. The tool of claim 35 further characterized in that the coupling means includes a latch engageable member connected to the elongated member for moving the elongated member axially.

37. The tool of claim 35 further characterized in that the coupling means includes an overshot coupling member and means for connecting the coupling member to the elongated member.

38. The tool of claim 35 further characterized in that the coupling means includes a safety release tool having a main body portion, latch means mounted by the main body portion for movement between a latching position and a release position, an overshot head coupling portion, means joined to the head portion and mounted by the main body portion for axial movement between a position for retaining the latch means in a latching position and a release position and means for resiliently retaining the means joined to the head portion in its latching position, and means connected to the elongated member for being latchingly engaged by the latch means in its latched position.

39. The replacement tool of claim 38 further characterized in that the means joined to the head portion has a transverse terminal surface remote from the head portion, a slot opening to the latch means and through the terminal surface to permit the latch means moving to its release position and means movably mounted in the slot to retain the latch means in its latching position until the means joined to the head portion has been moved axially outwardly against the action of the resilient means a preselected amount.

40. The tool of claim 35 further characterized in that the elongated member extends axially outwardly of the head tube and that the coupling means includes a tubular member having the elongated member extended thereinto, means mounted by the tubular member for mounting the elongated member for limited axial movement relative the tubular member between an axial inner position and an axial outer position and means for cooperating with the elongated member and the head tube for forming a piston to move the elongated member axially inwardly in the head tube when the tubular member is in its axial inner position and an axially inward fluid force is applied thereto and to provide an open fluid passageway when the tubular member is in its axial outer position.

41. The tool of claim 40 further characterized in that the elongated member is tubular and has an axial outer end portion extending within the first mentioned tubular member and has axial slots in its outer end portion, that the first mentioned tubular member has axial slots of a greater length than the first mentioned slots, that the means to connect the elongated member to the tubular member comprises a transverse pin extended through said slots, and that the means to form a piston includes a plate mounted within the elongated member axially inwardly of its slots, the plate has an aperture extending therethrough, a stopper mounted on the pin to move therewith, resilient means acting between the stopper and the elongated member to urge the stopper to a position to block said aperture when the first mentioned tubular member is in its axial inner position, and means to form a fluid seal between the head tube and the elongated member.

42. The tool of claim 35 further characterized in that the coupling means includes means mounted on the elongated member and forming a fluid seal with the head tube for moving the elongated member axially inwardly a limited amount relative the head tube when an axial inward fluid force is applied within the head tube.

43. The tool of claim 42 further characterized in that the elongated member comprises a piston tube, that the means for forming a fluid seal includes a piston mounted in a fixed position on the piston tube, a lift rod axially slidably extended through the piston and means for mounting the lift rod on the piston tube for limited axial movement relative thereto, the fourth means being connected to the lift rod for being operated thereby when the lift rod is moved axially relative the head tube.

44. The tool of claim 43 further characterized in that the fourth means includes means connected between the lift rod and the third means that, when the lift rod is moved axially outwardly, initially moves the third means axially inwardly and thence rotates the third means while it is being moved axially inwardly.

45. The tool of claim 43 further characterized in that the fourth means includes means connected to lift rod and the third means to both rotate and move the third means axially outwardly and thence just move the third means axially outwardly when the lift rod is being moved axially outwardly.

46. The tool of claim 23 further characterized in that the fourth means includes a cam tube having an axial outer end connected to the head tube in a fixed axial position relative thereto, and a drive slug assembly axially movable in the cam tube and cooperating therewith for moving the third means, and that the fifth means includes a rotatable member, means connected to the rotatable member for moving the drive slug assembly axially when the rotatable member is rotated and means mounted by the head tube and connected to the rotatable member to selectively rotate the rotatable member.

47. The tool of claim 46 further characterized in that the means for rotating the rotatable member includes operable means mounted in a fixed axial position relative the cam tube for rotating the rotatable member.

48. The tool of claim 47 further characterized in that the first mentioned means for rotating the rotatable member includes an overshot coupling portion and means mounted by the head tube for axial movement relative thereto and connected between the operative rotatable means and the overshot coupling portion for rotating the operative rotatable means when the overshot coupling portion is moved axially.

49. The apparatus of claim 48 further characterized in that the means connected between the overshot coupling portion and the operative rotatable means includes a lift rod having an axially outer first end and an axially inner second end, said lift rod being axially movable relative the head tube, means for connecting the lift rod first end to the overshot coupling portion and means connected to lift rod second end portion for rotating the operative rotatable means when the lift rod is moved axially relative the head tube.

50. The tool of claim 49 further characterized in that each of the opeerative rotatable means and the rotatable member includes a ball screw, that the means connected to the lift rod second end portion includes a ball nut mounted on the operative rotatable means ball screw to rotate it as the above ball nut is moved axially and that the means connected to the rotatable member for moving the drive slug assembly axially includes a ball nut mounted on the rotatable member ball screw to move axially as the last mentioned ball screw is rotated.

51. The tool of claim 49 further characterized in that the means for connecting the lift rod to the overshot coupling portion includes a tubular member having the lift rod extended thereinto, means for mounting the lift rod on the tubular member for limited axial movement relative the tubular member, means acting between the tubular member and the lift rod for resiliently urging the lift rod axially inwardly and means for connecting the tubular member and the overshot portion for limited axial movement relative one another.

52. The tool of claim 51 further characterized in that the tubular member has a cam track and that the second means includes a cam sleeve rotatably mounted by the head tube and in fixed angular relation to the tubular member and a cam member mounted by the head tube and extended into the cam track to rotate the tubular member during at least part of the axial movement of the tubular member relative the head tube.

53. A drill bit replacement tool comprising a head tube having an axial outer end and an axial inner end, operative first means for lockingly engaging a drill bit and alternately for releasing the drill bit, second means for being coupled to an overshot assembly, operative third means connected to the first means for moving the first means between a drill string bit mounted position and a drill bit pass through the drill string position and operate the first means between a drill bit lockingly engaging condition and a drill bit release condition, and fourth means mounted by the head tube for axial movement relative thereto and connected between the overshot coupling means and the third means for operating the third means when the overshot coupling means is moved axially outwardly relative the head tube.

54. The tool of claim 53 further characterized in that the third means includes means for operating the first means from its drill bit release condition to its drill bit locking engaging condition and thence moving the first means from its drill string bit mounted position to its drill bit pass through the drill string position when the overshot coupling means is moved axially outwardly.

55. The tool of claim 53 further characterized in that the third means includes means for moving the first means from the drill bit pass through the drill string position to its drill string bit mounted position and thence operating the first means from its drill bit locking engaging condition to its drill bit release condition when the overshot coupling means is moved axially outwardly.

56. The tool of claim 53 further characterized in that the third means includes an axially elongated tubular member having an axial inner end portion adjacent the first means and an axial outer end portion, tubular means for rotatably connecting the tubular member outer end portion to the head tube and a drive slug assembly mounted for axial movement in the tubular member, and that the fourth means includes fifth means connected to the overshot means for moving the drive slug assembly axially inwardly as the overshot means is moved axially outwardly.

57. The tool of claim 53 further characterized in that the fourth means includes a detent mounted by the head tube for movement between a drill string locking position and a drill string release position, fifth means mounted by the head tube for movement from a first position to a second position to move the detent from its release position to its locking position, sixth means connecting the overshot coupling means to the third means, the fifth and sixth means having cooperating means for moving the fifth means from its first position when the overshot coupling means is moved axially.

58. The tool of claim 57 further characterized in that the overshot coupling means has a datum position relative the head tube and that the sixth means includes piston means for moving the overshot coupling means axially inwardly a limited amount relative the head tube when the overshot coupling means is axially outwardly of its datum position and an axial inward fluid force is applied to the piston means.

59. The tool of claim 53 further characterized in that the first means comprises an annular floater having a central axis, an outer peripheral surface and an inner peripheral surface, a detent mounted for radial movement by the floater between a retracted bit release position and a drill bit locking position extending radially outwardly of the outer peripheral wall, and a plunger mounted by the floater for movement between a first position relative the floater to retain the detent in its drill bit locking position and a second position for the detent to move to its release position.

60. The tool of claim 59 further characterized in that the first means includes means for mounting the plunger on the annular member for limited axial movement thereto and that the third means includes means connected to the plunger for pivoting the plunger as the first means is moved between its positions.

61. The tool of claim 53 further characterized in that the third means includes an axially elongated tubular member having an axially inner end portion adjacent the first means and an axial outer end portion, tubular means for rotatably connecting the tubular member outer end portion to the head tube, and a drive slug assembly mounted for axial movement in the tubular member, and that the fourth means includes fifth means connected to the overshot means for moving the drive slug assembly axially inwardly as the overshot means is moved axially outwardly.

62. The tool of claim 61 further characterized in that the fifth means includes a lift rod, means for connecting the lift rod to the overshot means to move axially outwardly therewith and ball screw means connected between the lift rod and the drive slug assembly to move the drive slug assembly axially inwardly as the lift rod is moved axially outwardly.

63. The tool of claim 61 further characterized in that fourth means includes a detent mounted by the head tube for movement between a drill string locking position and a release position and sixth means operated by the axial movement of the fifth means for moving the detent from its release position to its drill string locking position prior to the first means being moved from its drill bit drill string mounted position to its drill bit pass through the drill string position and after the first means is in the last mentioned position operate the sixth means to its detent release position.

64. The combination of a drill string that has a detent seat and includes a transverse outer barrel assembly having a transverse outer barrel that has an axial inner end and a central axis, a drill bit drive lug mounted on the outer barrel, a bit locking member, and operative first means mounted by the outer barrel for mounting the locking member and moving the locking member between a bit locking position and a bit release position, a drill bit that is axially movable through the drill string and that has an earth boring portion, second means for cooperating with the locking member in its locking position to mount the earth boring portion on the outer barrel and third means defining a drive surface that is driven engagable with the drive lug, and a drill bit replacement tool that includes an axially elongated tubular member, detent fourth means mounted by the tubular member for movement between a drill string seat engaging position and a release position, fifth means for mounting a drill bit, operative sixth means mounted on the drill bit mounting means for movement between a position lockingly engaging a drill bit to retain the drill bit on the drill bit mounting means and a release position, and seventh means mounted on the tubular member for moving the detent means from its release position to its locking position and thereafter moving the drill bit mounting means between a position the drill bit is axially movable through the drill string and a drill string mounted position, the locking means on the drill bit mounting means between its position and the first means between its positions, the drill bit having eighth means for being lockingly engaged by the sixth means in its locking position.

65. The combination of claim 64 further characterized in that the seventh means includes operative ninth means movable between a retracted position and an extended position to operate the first means from its locking position to its release position, operative tenth means for moving the sixth means from its release position to its locking position and thereafter the drill bit mounting means from a drill string drill bit mounted position to a position to move the drill bit through the drill string, and means for operating the tenth means to move the sixth means to its locking position, than the ninth means to operate the first means to its release position and thereafter the tenth means to move the bit mounting means to its position to move the drill bit through the drill string.

66. The combination of claim 64 further characterized in that the seventh means includes operative ninth means movable between a retracted position and an extended position to operate the first means from its release position to its locking position, operative tenth means for moving the drill bit mounting means from a position to move the drill bit through the drill string to a drill string drill bit mounted position and thereafter moving the sixth means from its locking position to its release position, and means for operating the tenth means to move the drill bit mounting means from its position to move the drill bit through the drill string to its bit mounted position, than the ninth means to operate the first means to its locking position and thereafter the sixth means to its release position.

67. The combination of claim 64 further characterized in that the seventh means includes means for moving the fifth means only axially during part of the movement thereof and during another part of the movement of the fifth means move the fifth means pivotally about the outer barrel assembly axis and pivotally about an axis that extends perpendicular to the outer barrel assembly axis.

68. The combination of claim 67 further characterized in that the second means comprises a drill bit wall portion defining a lock member recess that opens to drill bit drive surface, and that the eighth means comprises a drill wall portion defining an axial bore and a recess opening to the bore for having the sixth means extended thereinto.

69. In a drilling tool, a head tube having a central axis, an axial inner end and an axial outer end, detent means mounted by the head tube for movement between a drill string latching engagement first position and a release second position, an axially elongated member axially movably extended into the head tube and having an axial inner end portion and an axial outer end portion, cooperating means on the elongated member and the head tube for moving the detent means from its second position to its first position as the elongated member moves axially, an overshot coupling head portion, and means for connecting the head portion to the elongated member for moving the elongated member axially, the cooperating means including a cam member mounted by the head tube for rotation relative thereto for moving the detent means and means for rotating the cam member relative to the head tube as the elongated member is moved axially relative the head tube.

70. A drilling tool comprising a head tube having a central axis, an axial inner end and an axial outer end, detent first means mounted by the head tube for movement between a drill string latching engaging position and a release position, second means movable relative the head tube between a first position permitting the detent means moving to its release position, a second position for moving the detent means to its latching engaging position and a third position permitting the detent means moving to its release position, third means mounted by the head tube for moving the second means between its position, the third means including fourth means axially movable relative the head tube for moving the second means, the fourth means being movable relative the head tube from a datum position that the second means is in its first position, a second axial position extending axially inwardly of the datum position that the second means is in its second position, and a third axial position extending axially outwardly of datum position that the second means is in its third position, piston means connected to the fourth means for moving the fourth means from its datum position to its second position when an axial inward fluid force is applied thereto and overshot coupling means connected to the fourth means for moving it from its second position to its third position.

71. The tool of claim 70 further characterized in that the second means comprises a cam sleeve mounted by the head tube in substantially fixed axial relationship thereto and for rotation relative the head tube about said central axis.

72. The tool of claim 70 further characterized in that there is provided means connected between the head tube and the fourth means for carrying a drill bit through a drill string, and when the second means is in its second position, operate drill string bit locking mechanism between a drill bit locking position and a drill bit release position and move a drill bit between a locked to drill string position and a position to move a drill bit through a drill string as the fourth means is moved from its second position to its third position.

73. In a method of mounting a drill bit having a central axis and diametrically opposed portions of about the same diameter as the outer diameter of a drill string that has operative bit locking mechanism thereon without withdrawing the drill string from a drill hole, comprising passing the drill bit through the drill string and axially inwardly of the drill string with the drill bit central axis extending generally perpendicular to the drill string central axis, then while moving the drill bit axially outwardly, rotate the bit about the drill string central axis and about an axis generally perpendicular to the drill string axis to align the drill bit central axis with the drill string axis and thereafter mechanically operate the lock mechanism to lock the drill bit to the drill string.

74. In a method of removing a drill bit that will pass through a drill string and has a central axis and diametrically opposed portions of about the same diameter as the outer diameter of the drill string that has operative bit locking mechanism thereon without removing the drill string from a drill hole, the steps of mechanically lockingly engaging the drill bit while it is locked to the drill string, than mechanically operating the bit locking mechanism to release the bit from the drill string, thence moving the bit axially inwardly of the drill string and rotating the entire bit to a position to pass through the drill string and thereafter retracting the bit through the drill string.

75. The method of claim 74 further characterized in that the bit moving axially inwardly and rotating step comprises first moving the bit axially inwardly relative to the drill string with its central axis substantially aligned with the drill string central axis and thence both rotating the bit about an axis that extends generally perpendicular to both the bit and drill string central axis and moving the bit axially inwardly.

76. The method of claim 75 further characterized in that the first mentioned bit moving axially inwardly and rotating step includes rotating the bit about the drill string axis after the bit has begun to rotate about the axis that extends generally perpendicular.

77. A tool for couplingly engaging a drilling tool comprising an axially elongated annular mounting portion having a central axis and a latch slot extending axially therethrough, a plunger extended into the mounting portion and axially movable relative thereto between an axial inner latch means coupling position and an axial outer latch means release position, coupling means joined to the plunger for moving the plunger to its axial outer position, means acting between the plunger and the annular mounting portion for resiliently urging the plunger to its axial inner position, a roller, and latch means for retaining the roller in abutting relationship to the plunger and movable relative the roller between a roller abutting first position to extend transversely outwardly of the mounting portion to a drilling tool coupling position when the plunger is in its axial inner position and a roller abutting drilling tool release second position when the plunger is in its axial outer position, said latch means being pivotally mounted by the mounting portion to extend within the slot.

78. The tool of claim 77 further characterized in that the mounting portion has a wall portion that in part defines said slot and limits the movement of the latch means from its release position toward its coupling position to its coupling position.

79. The tool of claim 78 further characterized in that the plunger has a groove to have the roller extended thereinto and limit the movement of the roller relative thereto in an axial outer direction.

80. The tool of claim 71 further characterized in that the latch means has a first shoulder for abutting against the roller when the plunger is in its axial inner position and a second shoulder for abutting against the roller when the plunger is in its axial outer position.

81. A drill bit comprising a single piece member having a central axial axis, an inner peripheral wall defining a central bore extending axially therethrough, an axially inner transverse surface, an axially outer transverse surface, a transversely outer, axially extending first side surface, a transversely outer, axially extending second side surface diametrically opposite the first side surface, the first and second side surfaces being generally planar and converging in an axial direction from the axial inner transverse surface toward the axial outer transverse surface, each side surface having first and second axially extending edges, an outer peripheral, generally circular surface portion extending between the first side surface first edge and the second side surface second edge, and an outer peripheral, generally circular surface portion extending between the first side surface second edge and the second side surface first edge, the minimum diametric spacing between the first and second side surfaces being substantially less than the diametric spacing of the outer peripheral circular surface portions.

82. A drill bit comprising a single piece member having a central axial axis, an inner peripheral wall defining a central bore extending axially therethrough, an axially inner transverse service, an axially outer transverse surface, a transversely outer, axially extending first side surface, a transversely outer, axially extending second side surface diametrically opposite the first side surface, each side surface having first and second axially extending edges, an outer peripheral, generally circular surface portion extending between the first side surface edge and the second side surface second edge, an outer peripheral, generally circular surface portion extending between the first side surface second edge and the second side surface first edge, the minimum diametric spacing between the first and second side surfaces being substantially less than the diametric spacing of the outer peripheral circular suface portions, wall portions defining lock recesses opening to the side surfaces, the recesses being axially spaced from each of the inner and outer transverse surfaces; and wall portions defining a plurality of circumferential spaced detent recesses opening to said bore, each lock recess in a plane perpendicular to said axis being of a greater radial dimension adjacent the respective side first edge than the radial dimension thereof more closely adjacent the respective side second edge and about midway between the first and second edges of the respective side surface, each of the side surfaces being generally planar.

83. A drill bit having a central axial axis, an inner peripheral wall defining a central bore extending axially therethrough and a plurality of circumferentially spaced detent recess opening transversely to the bore, an axially inner transverse surface, an axially outer transverse surface, a transversely outer, axially extending first side surface, a transversely outer, axially extending second side surface, each of the side surfaces having axially extending first and second side edges, wall portions defining a lock recess opening transversely outwardly through each of the first and second side surfaces, the lock recess being of increasing radial depths in the same circumferential direction, and an outer peripheral, generally circular surface portion extending between the first side surface first edge and the second side surface second edge, each of the first and second side surfaces being generally planar and extending axially from the inner transverse surface to the outer transverse surface, the minimum radial spacing of each of the first and second side surfaces from the central axis being substantially less than the radial spacing of the circular surface portion from the central axis, and the planar surfaces converging toward the central axis in a direction from the inner transverse surface toward the outer transverse surface.

84. A drill stem transverse outer barrel assembly comprising an outer barrel having a central axis, an axial outer end, an axial inner end, and an inner peripheral wall, a drive lug mounted on the outer barrel inner end to extend axially inwardly thereof, a locking sleeve rotatably mounted in the outer barrel and having an axial inner end adjacent the outer barrel inner end and an axial outer end, the locking sleeve outer end having an axially extending camming edge, a locking key mounted on the locking sleeve inner end, said outer barrel and locking sleeve having cooperating means for selectively retaining the locking sleeve in a locking key locked position relative the outer barrel and a locking key unlocked position angularly spaced from the locked position, and a stationary sleeve mounted on the outer barrel and having an axial inner end adjacent the locking sleeve outer end and an axial outer end remote from the locking sleeve, said stationary sleeve inner end having an axially extending camming edge circumferential adjacent the locking sleeve camming edge.

85. The outer barrel assembly of claim 84 further characterized in that the locking sleeve outer end has a first circumferentially elongated terminal edge, a second circumferentially elongated terminal edge a substantial distance axially inwardly of the locking sleeve first circumferential edge, the locking sleeve camming edge extending between the locking sleeve first and second circumferential edges and an axially extending edge extending between the locking sleeve first and second circumferential edges, and the stationary sleeve inner end having a first circumferentially elongated terminal edge axially adjacent the locking sleeve second circumferential edge circumferentially between the locking sleeve axially extending edges and axially inwardly of the locking sleeve first circumferential edge, a second circumferentially elongated terminal edge axially adjacent and axially outwardly of the locking sleeve first circumferential edge, the stationary sleeve camming edge extending between the stationary sleeve first and second circumferential edges, and an axially edge extending axially between the stationary sleeve first and second circumferential edges that is a substantial distance circumferentially away from the stationary sleeve camming edge.

86. The outer barrel assembly of claim 84 characterized in that there is provided an orienting pin and spring means for mounting the orienting pin on the stationary sleeve and resiliently urging the pin toward the central axis.

87. A drill stem transverse outer barrel assembly comprising an outer barrel having a central axis, and an inner peripheral wall, a drive lug mounted on the outer barrel inner end to extend axially inwardly thereof, means for lockingly engaging a drill bit, and operative means mounted by the outer barrel for mounting the lock means axially inwardly of the outer barrel and moving the lock means between a drill bit locking position and a drill bit release position, the operative means comprising means rotatably mounted by the outer barrel for mounting the lock means for movement between its position, the outer barrel and rotatably mounted means having cooperating means for resiliently retaining the rotatable means in each of the lock means positions.

88. The outer barrel assembly of claim 87 further characterized in that the drive lug has a lock means recess, and that the lock means includes a lock member that is retracted into said recess when the lock means is moved from its locking position to its release position.

89. The outer barrel assembly of claim 87 further characterized in that the outer barrel has an axially inwardly extending drill bit orienting flange circumferentially spaced from the drive lug.

90. Drilling apparatus for drilling a drill hole to extend axially inwardly, a rotatably drivable drill stem having a central axis and an outer barrel assembly at its axial inner end, the outer barrel assembly including an axially elongated outer barrel having an axial inner end portion, and a drill bit drive lug mounted on the outer barrel inner end portion, a drill bit of a size to pass axially through the drill stem and having a drive lug abuttable surface, said outer barrel assembly and drill bit having cooperating means for lockingly retaining the drill bit on the outer barrel without imparting any significant drive force to the bit when the bit is in the bottom of the drill hole and an axially inwardly and rotatable drive force is applied to the drill stem, said cooperating means including a drill bit lock member engageable portion, an outer barrel assembly lock member movable between a lock member engagable portion locking position to lock the drill bit to the outer barrel and a drill bit release position, an outer barrel assembly operative means mounted by the outer barrel for mounting the lock member and moving it between its positions, and means on the outer barrel for mounting the operative means for rotary movement about said axis while retaining the operative means in a substantially fixed axial position relative the outer barrel.

91. The outer barrel assembly of claim 90 further characterized in that the operative means has a camming edge.

92. Drilling apparatus comprising a drill bit having a central axis and an inner peripheral wall defining a bore extending axially therethrough and centered with reference to said central axis and a drill string transverse outer barrel assembly that includes an axially elongated transverse outer tube having a circular outer peripheral surface, an axial inner end portion, operable first means mounted by the outer tube that is operable between a drill bit release position and a drill bit locking position for supportingly holding the drill bit, and a second means mounted by the outer tube inner end portion for drivingly engaging the drill bit, the drill bit being of a size to move through the outer tube and having a circumferential outer peripheral surface portion of a radius of curvature emanating from the bit central axis that is about the same as the radius of curvature of outer tube peripheral surface, a surface for being drivenly engaged by the second means, and third means for lockingly receiving the first means in its bit locking position.

93. Drilling apparatus comprising a drill bit and a drill string transverse outer barrel assembly that includes an axially elongated transverse outer tube having a circular outer peripheral surface, an axial inner end portion, operable first means mounted by the outer tube that is operable between a drill bit release position and a drill bit locking position for supportingly holding the drill bit, and second means mounted by outer tube inner end portion for drivingly engaged the drill bit, the drill bit being of a size to move through the outer tube and having a central axis, a circumferential outer peripheral surface portion of a radius of curvature emanating from the bit central axis that is about the same as the radius of curvature of the outer tube peripheral surface, a surface for being drivenly engaged by the second means, and third means for lockingly receiving the first means in its bit locking position, said bit being of a single piece unitary construction.

94. Drilling apparatus comprising a drill bit and a drill string transverse outer barrel assembly that includes an axially elongated transverse outer tube having a circular outer peripheral surface, an axial inner end portion, operable first means mounted by the outer tube that is operable between a drill bit release position and a drill bit locking position for supportingly holding the drill bit, and second means mounted by outer tube inner end portion for drivingly engaging the drill bit, the drill bit being of a size to move through the outer tube and having a central axis, a circumferential outer peripheral surface portion of a radius of curvature emanating from the bit central axis that is about the same as the radius of curvature of outer tube peripheral surface, a surface for being drivenly engaged by the second means, and third means for lockingly receiving the first means in its locking position, the first means including a lock key, and fourth means rotatably mounted by the outer tube for moving the lock key between a bit release position and a bit locking position, and the third means comprising drill bit wall portions that define a lock key recess.

95. The apparatus of claim 94 further characterized in that the fourth means includes means extending axially inwardly of the outer tube to mount the lock key spaced from the outer tube in an axial direction.

96. A drill stem surface tool for controlling the movement of a wire line comprising an axially elongated tool housing having an axial inner end, an axial outer end and means for mountingly engaging a drill stem, a first clamp subassembly mounted on the housing for releasably grippingly engaging a wire line, a second clamp subassembly for releasably gripping a wire line, and manually operated means mounted by the housing for mounting the second clamp subassembly and selectively moving the second clamp subassembly axially toward and away from the first clamp subassembly, the housing having opposite stud receiving recessed portions

97. A drill stem surface tool for controlling the movement of a wire line comprising an axially elongated tool housing having an axial inner end, an axial outer end and means for mountingly engaging a drill stem, a first clamp subassembly mounted on the housing for releasably grippingly engaging a wire line, a second clamp subassembly for releasably gripping a wire line, and manually operated means mounted by the housing for mounting the second clamp subassembly and selectively moving the second clamp subassembly axially toward and away from the first clamp subassembly, each clamp subassembly including a clamp block having a transverse axial outer surface, a transverse axial inner surface, a front surface extending between the block transverse inner and outer surfaces, a jaw recess that in part is defined by opposite wall surface portions that converge in an axial inward direction, a first wire line slot opening through the transverse outer surface and front surface and to the jaw recess, a second wire line slot axially aligned with the first slot and opening through the transverse inner surface and front surface and to the jaw recess and a front access opening opening through the front surface and to the jaw recess, a first and a second jaw mounted in the jaw recess for limited axial movement between a wire line clamping position and a wire line release position, the jaws having opposite wall surface portions that converge in an axial inward direction and first and second means extending through the access opening and joined to the first and second jaw respectively for manually moving the respective jaw to a wire line release position.

98. The tool of claim 97 further characterized in that each clamp subassembly includes resilient means for selectively retaining the jaw moving means in a jaw release position.

99. The tool of claim 97 further characterized in that each clamp subassembly includes a pair of jaw guide rods means mounted by the respective clamp block to extend into the clamp block recess in converging relationship in an axial downward direction and into the jaws to guide the jaws as they move between their clamping and release positions and means for constantly resiliently urging the jaws toward their clamping position and that the first clamp subassembly includes means for securing the first clamp subassembly block on the housing in a fixed position relative thereto.

100. A safety release tool for couplingly engaging a drilling tool comprising detent means for couplingly engaging a drilling tool, an annular detent means mounting member having an inner peripheral wall portion, an axial inner end and an axial outer end, and mounting the detent means for movement between a drilling tool coupled position and a release position, a wall portion joined to mounting member inner end axially inwardly of the detent means, plunger means extending within the mounting member and movable between an axial inward position abutting against said wall portion to retain the detent means in a drilling tool coupled position and an axial outward position permitting the detent means moving to the release position, and resilient means acting between the mounting member and the plunger means for constantly urging the plunger means to its axial inner position, the plunger means having an axial outer overshot couplingly engagable portion, said detent means comprising a latch mounted on the mounting member for pivotally movement about a transverse pivot axis and having an axially outwardly facing shoulder extending radially inwardly of said peripheral wall portion, and the plunger means including a plunger member having an axially elongated slot for the latch shoulder to pivot into, the plunger member having a wall portion defining the axial outer end of the slot, and roller means mounted in the slot and bearing against said shoulder and the plunger member wall portion when the plunger means is in its axial inner position.

101. The safety release tool of claim 100 further characterized in that the plunger means has a central axis, that the transverse pivot axis is located axially outwardly of the above mentioned shoulder and that the latch has a second shoulder axially between the first mentioned shoulder and the transverse pivot axis for the roller means to extend into when the plunger means is in its axial outer position, the second shoulder extending more remote from the central axis than the first shoulder when the detent means is in a drilling tool coupled position.

102. In a drilling tool, a head tube having a central axis, an axial inner end and an axial outer end, detent means mounted by the head tube for movement between a drill string latching engagement first position and a release second position, an axially elongated member axially movably extended into the head tube and having an axial inner end portion and an axial outer end portion, the elongated member comprising a second tube, cooperation means on the elongated member and the head tube for moving the detent means from its second position to its first position as the elongated member moves axially, an overshot coupling head portion, and means for connecting the head portion to the elongated member for moving the elongated member axially, the cooperating means including a cam member mounted by the head tube for rotation relative thereto for moving the detent means, a second tube wall portion defining a cam track, means for rotating the cam member as the second tube is moved axially, and cam follower means mounted by the head tube and extended into the cam track for rotating one of the head tube and the second tube relative the other during at least part of the axial movement of the elongated member relative the head tube.

103. The apparatus of claim 102 further characterized in that the cam track has a first track portion to limit the axial outward movement of the second tube relative the cam follower means when the detent means is in a release position, a second track portion axially outwardly of the first track portion and angularly spaced therefrom to limit the axial inward movement of the second tube relative the cam follower means, the cam member retaining the detent means in its first position when axial inward movement of the second tube is limited by the cam follower means in the second track portion.

104. The apparatus of claim 103 further characterized in that there is provided piston means acting between the elongated member and the head tube for moving the elongated member, including the second tube, axially inwardly from its first cam track portion axial outer limit position to its second cam track portion axial inner limit position.

105. The apparatus of claim 104 further characterized in that the cam member has a first recessed wall portion for having the detent means extended into when the second tube is in the first cam track portion axial outer limit position and a second recessed wall portion angularly spaced from the first recessed wall portion for the detent means moving to a release position, and that the cam track has a third track portion having an axial inner end portion a substantial distance axially inwardly of the first track portion and angularly on the opposite side of the second track portion from the first track portion, the second tube in moving axially outwardly from the second cam track portion axial inner limit position rotating the cam member to position its second recessed wall portion for the detent means to extend into to move from the drill string latching engagement position when the cam follower means moves through the third track portion inner end portion.

106. The apparatus of claim 105 further characterized in that there is provided operative means for lockingly engaging a drill bit and alternately for releasing the drill bit, and means connected to the elongated member for moving the drill bit engaging means between a drill string mounted position and a drill bit pass through the drill string position after the second tube has been moved from the second cam track portion inner limit position and prior to the cam follower passing through the third track portion inner end portion.

107. The apparatus of claim 106 further characterized in that the means for moving the drill bit engaging means includes means for operating the drill bit engaging means to release a drill bit after it has been moved to its drill bit pass through the drill string position to its drill bit mounted position and prior to the cam follower passing through the third track portion inner end portion.

108. A drill bit having a central axial axis, an axially inner transverse surface, an inner peripheral wall defining an axially extending central bore opening through the axial inner transverse surface, wall portions defining a plurality of circumferentially spaced bit replacement tool detent receiving recesses opening transversely to the bore, an axially outer transversely surface, a transversely outer, axially extending first side surface, a transversely outer, axially extending second side surface, each of the side surfaces having axially extending first and second side edges, an outer peripheral, generally circular surface portion extending between the first side surface first edge and the second side surface second edge, and means defining spaced drill stem outer barrel locking portion receiving recesses, the minimum spacing of the side surfaces from the central axis being less than the radius of curvature of the circular surface portion.

109. The bit of claim 108 further characterized in that each of the first and second side surfaces are generally planar and extend axially from the inner transverse surface to the outer transverse surface, the minimum radial spacing of each of the first and second side surfaces from the central axis being substantially less than the radial spacing of the circular surface portion from the central axis.

110. The bit of claim 108 further characterized in that each side surface is generally planar and extends through an angle of at least about 60° relative the central axis.

111. The drill bit of claim 108 further characterized in that said means are located more closely adjacent the central axis than the circular surface portion.

112. Drilling apparatus for drilling a drill hole to extend axially inwardly, a rotatably drivable drill stem having a central axis and an outer barrel assembly at its axial inner end, the outer barrel assembly including an axially elongated outer barrel having an inner end portion, and a drill bit drive lug mounted on the outer barrel inner end portion, a drill bit of a size to pass axially through the drill stem and having a drive lug abuttable surface, said outer barrel assembly and drill bit having cooperating means for lockingly retaining the drill bit on the outer barrel, the cooperating means including a drill bit lock member engagable portion, an outer barrel assembly lock means movable relative the outer barrel and the drill bit between a lock member engagable portion locking position to lock the drill bit to the outer barrel and a drill bit release position, and outer barrel assembly operative means mounted in the outer barrel for movement relative thereto and joined to the lock means for moving the lock means between its positions.

113. Drilling apparatus comprising a drill bit and a drill string transverse outer barrel assembly that includes an axially elongated transverse outer tube having a circular outer peripheral surface, an axial inner end portion, operable first means movably mounted by the outer tube that is operable between a drill bit release position and a drill bit locking position for supportingly holding the drill bit, and second means mounted by outer tube inner end portion for drivingly engaging the drill bit, the drill bit being of a size to move through the outer tube and having a central axis, a circumferential outer peripheral surface portion of a radius of curvature emanating from the bit central axis that is about the same as the radius of curvature of outer tube peripheral surface, diametrically opposed generally planar surfaces for being drivenly engaged by the second means, and third means for lockingly receiving the first means in its bit locking position, the second means comprising a pair of drive lugs that have diametrically opposed, generally planar drive surfaces and diametrically opposed circumferential outer peripheral surface portions that each is of a radius of curvature that is about the same as the radius of curvature of the outer tube peripheral surface.

* * * * *

UNITED STATES PATENT AND TRADEMARK OFFICE

CERTIFICATE OF CORRECTION

PATENT NO. : 4,281,722

DATED : August 4, 1981

INVENTOR(S) : John D. Tucker, Ronald E. Cozad and Robert A. Kaiser

It is certified that error appears in the above-identified patent and that said Letters Patent are hereby corrected as shown below:

First page, change the name of the Assignee from "Long Year Company" to --Longyear Company--.

Column 14, line 35, change "233" to --223--.

Column 36, line 30, change "and" to --an--.

Column 49, line 1, delete "means".

Signed and Sealed this

*Twenty-fourth* Day of *November 1981*

[SEAL]

*Attest:*

GERALD J. MOSSINGHOFF

*Attesting Officer*

*Commissioner of Patents and Trademarks*